US006997550B2

(12) United States Patent
Uchisako et al.

(10) Patent No.: US 6,997,550 B2
(45) Date of Patent: Feb. 14, 2006

(54) INK JET PRINTER HAVING MULTIPLE INK HEADS

(75) Inventors: Shoko Uchisako, Watford (GB); Nobuya Kishi, Yamatokoriyama (JP); Hiroki Watanabe, Yamatokoriyama (JP); Tetsuo Fukumoto, Sakurai (JP); Takateru Yamamoto, Uji (JP); Kenji Tanaka, Uji (JP); Keisuke Tateishi, Yamatokoriyama (JP); Masako Shinozuka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/912,189

(22) Filed: Aug. 6, 2004

(65) Prior Publication Data

US 2005/0007413 A1 Jan. 13, 2005

Related U.S. Application Data

(62) Division of application No. 09/670,840, filed on Sep. 28, 2000, now Pat. No. 6,896,354.

(30) Foreign Application Priority Data

Oct. 13, 1999 (JP) ..... 11-291290

(51) Int. Cl.
*B41J 2/01* (2006.01)
*B41J 2/145* (2006.01)
*B41J 11/00* (2006.01)

(52) U.S. Cl. ..... 347/104; 347/40; 400/124.08

(58) Field of Classification Search ..... 347/101–104, 347/40, 154; 346/136; 355/24; 399/401; 400/188, 124.08
See application file for complete search history.

(56) References Cited

U.S. PATENT DOCUMENTS 4,538,160 A 8/1985 Uchiyama
6,309,046 B1 * 10/2001 Izawa et al. ..... 347/40

FOREIGN PATENT DOCUMENTS

| | | |
|---|---|---|
| JP | 64-25136 | 2/1989 |
| JP | A624001 | 2/1994 |
| JP | A10 34902 | 2/1998 |

* cited by examiner

*Primary Examiner*—Shih-wen Hsieh
(74) *Attorney, Agent, or Firm*—Birch, Stewart, Kolasch & Birch, LLP

(57) ABSTRACT

Print is made on a recording paper by running an ink carriage along the supporting axis in a reciprocating motion. The ink carriage includes ink heads respectively provided with a front ink nozzle and a back ink nozzle facing their respective directions, so that print is made simultaneously at two portions on the recording paper along the transportation direction in which the recording paper is transported through a single transportation path one by one. Consequently, there can be provided an ink jet printer which can improve printing efficiency by increasing a printing rate and printing resolution, and realizing printing of an overstrike character, simultaneous printing of mixed information, double-side printing, etc.

8 Claims, 42 Drawing Sheets

PRINT DATA OF ODD-NUMBERED ROWS

PRINT DATA OF EVEN-NUMBERED ROWS

SUPERIMPOSING OF ODD-NUMBERED ROWS AND EVEN-NUMBERED ROWS

FIG. 21 (a)
FIG. 21 (b)
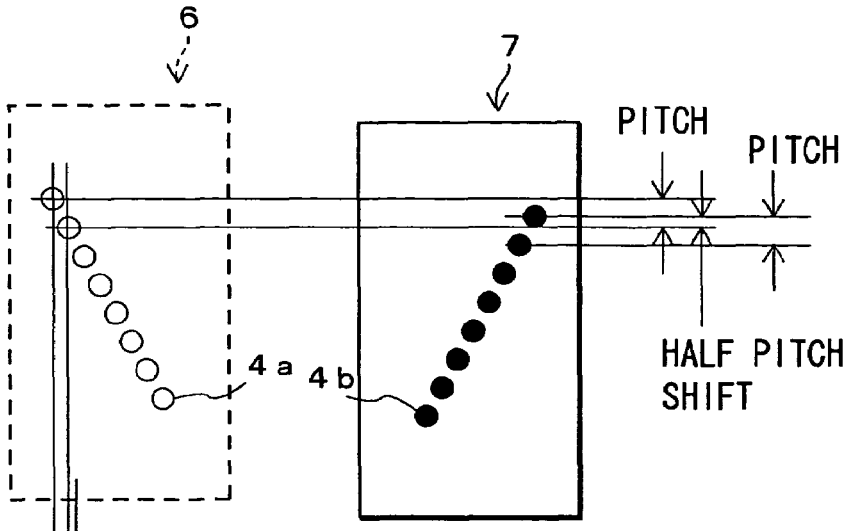
FIG. 21 (c)
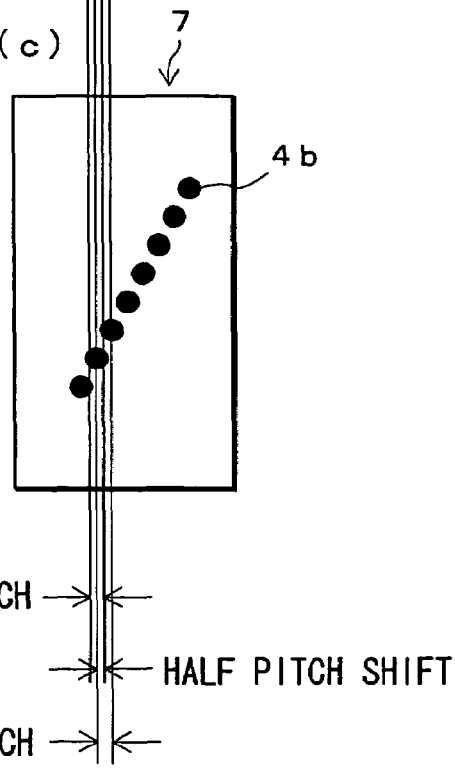

FIG. 23 (a)
FIG. 23 (b)
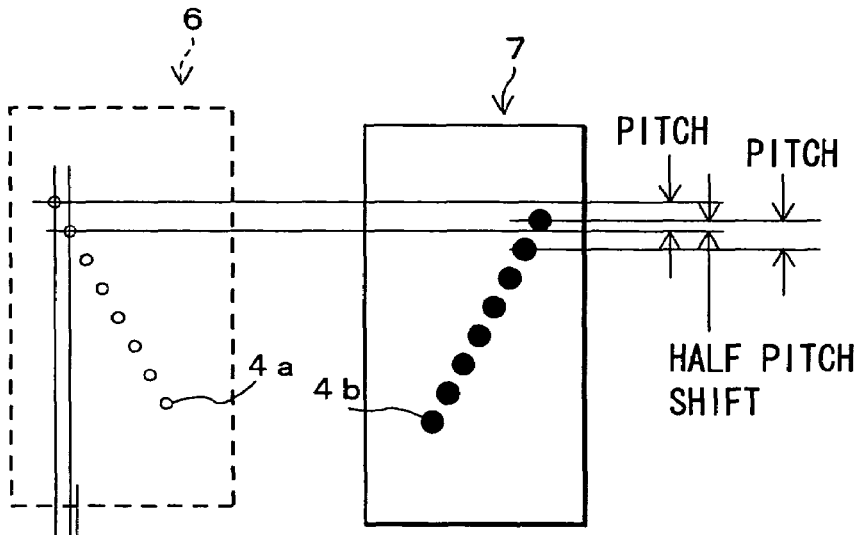
FIG. 23 (c)
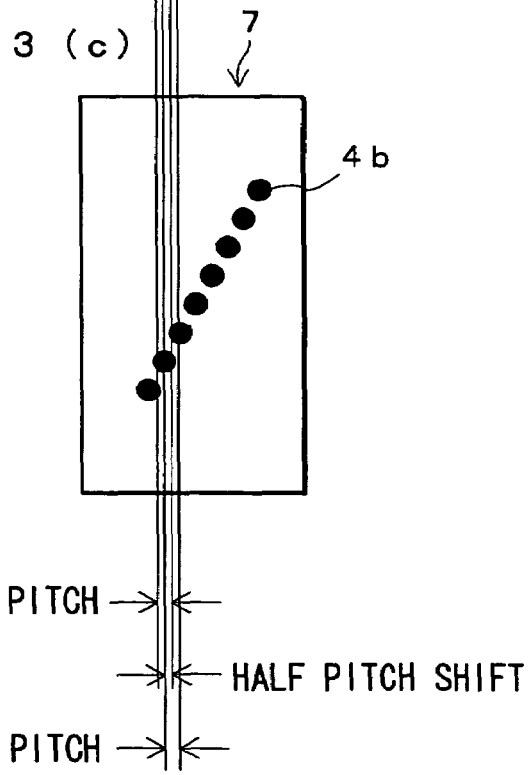

WATERMARK

PRINT DATA

SUPERIMPOSE PRINT MADE
BY TWO GROUPS OF NOZZLES

PRINT RESULT

INK JET PRINTER HAVING MULTIPLE INK HEADS

This application is a Divisional of application Ser. No. 09/670,840, filed on Sep. 28, 2000 now U.S. Pat. No. 6,896,354, and for which priority is claimed under 35 U.S.C. § 120; and this application claims priority of Application No. 11-291290 filed in Japan on Oct. 13, 1999 under 35 U.S.C. § 119; the entire contents of all are hereby incorporated by reference.

FIELD OF THE INVENTION

The present invention relates to an ink jet printer which makes print on a recording paper by running an ink carriage along a supporting axis in a reciprocating motion, and more particularly to an ink jet printer which can increase a printing rate.

BACKGROUND OF THE INVENTION

A conventional ink jet printer is disclosed in, for example, Japanese Laid-open Patent Application No. 24001/1994 (Japanese Official Gazette, Tokukaihei No. 6-24001, publishing date: Feb. 1, 1994).

As shown in FIG. 41(*a*), an ink jet printer disclosed in the above publication is arranged in such a manner that an ink carriage 100 is supported by a screw shaft 101 provided in a direction that intersects at right angles with a direction in which a recording paper 102 is transported, and the ink carriage 100 is allowed to run linearly along the screw shaft 101.

In addition, as shown in FIG. 41(*b*), the ink carriage 100 has four ink tanks including a yellow ink tank 103*a*, a red ink tank 103*b*, a blue ink tank 103*c*, and a black ink tank 103*d*, each provided with their respective ink heads 104*a*, 104*b*, 104*c*, and 104*d* formed on the bottom surfaces facing the recording paper 102 downward.

Each of the ink heads 104*a*, 104*b*, 104*c*, and 104*d* is provided with a line of a plurality of ink nozzles 105 (eight in the drawing). Accordingly, a jet of ink is directed to the recording paper 102 simultaneously from each ink nozzle 105 in the line, so that print is made per line height, for example.

Thus, as shown in FIG. 42, print is made by running the ink carriage 100 linearly directing a jet of ink downward to the recording paper 102 while the recording paper 102 is transported in the transportation direction.

However, the foregoing conventional ink jet printer has a problem that it can not increase a printing rate, because the printing rate is determined by a distance a recording paper has to travel in the printer, that is, the length of each line of the ink nozzles 105 and a running rate of the ink carriage 100.

The conventional ink jet printer has another problem that it can neither print out an overstrike character nor perform a double-side printing, and that it can not perform high-speed printing such that meets a user's demand when making print of high resolution or mixed information including, for example, a watermark and print data.

SUMMARY OF THE INVENTION

The present invention is devised to solve the above problems, and therefore, has an object to provide an ink jet printer which can improve printing efficiency by increasing a printing rate and printing resolution, and realizing printing of an overstrike character, simultaneous printing of mixed information, double-side printing, etc.

In order to fulfill the above and other objects, an ink jet printer of the present invention is an ink jet printer which makes print on a recording paper by running an ink carriage along a supporting axis in a reciprocating motion, characterized in that:

the ink carriage includes ink heads each provided with an ink nozzle facing a different direction, so that printing is effected on the recording paper simultaneously at more than one portion along a transportation direction in which the recording paper is transported through a transportation path sequentially one by one.

According to the above invention, the ink carriage includes the ink heads each provided with an ink nozzle facing a different direction, so that printing can be effected on the recording paper simultaneously at more than one portion along the transportation direction in which the recording paper is transported through the transportation path sequentially one by one.

For this reason, the printing can be effected simultaneously at more than one portion on the same recording paper by running one ink carriage. Thus, when monochrome printing is effected simultaneously at more than one portion along the transportation direction of the recording paper, the recording time can be shortened compared with a case using an ink head having an ink nozzle facing only one direction.

In addition, by allocating print data to the ink nozzles facing their respective directions, an overstrike character can be printed out, the print resolution can be improved, and mixed information can be recorded by transporting the recording paper only once. Further, by providing a switch-back path mechanism, the double-side printing can be realized.

Consequently, there can be provided an ink jet printer which can improve printing efficiency by increasing a printing rate and printing resolution, and realizing printing of an overstrike character, simultaneous printing of mixed information, double-side printing, etc.

For a fuller understanding of the nature and advantages of the invention, reference should be made to the ensuing detailed description taken in conjunction with the accompanying drawings.

BRIEF DESCRIPTION OF THE DRAWINGS

FIGS. 21(*a*) through 21(*c*) are explanatory views showing still another modified example of the ink jet printer, FIG. 21(*a*) showing the front ink head seen from the back when the front ink nozzles are assigned with even-numbered rows and columns, FIGS. 21(*b*) and 21(*c*) showing the back ink head seen from the back when the back ink nozzles are assigned with odd-numbered rows and columns;

FIGS. 23(*a*) through 23(*c*) are explanatory views showing still another modified example of the ink jet printer, FIG. 23(*a*) showing the front ink head seen from the back when the front ink nozzles are assigned with even-numbered rows and columns and the smaller diameter is given to the ink drop thereof, FIGS. 23(*b*) and 23(*c*) showing the back ink head seen from the back when the back ink nozzles are assigned with odd-numbered rows and columns and the larger diameter is given to the ink drop thereof;

DESCRIPTION OF THE EMBODIMENTS (Embodiment 1)

Referring to FIGS. 1 through 10, the following description will describe one embodiment of the present invention. In the present embodiment, a color printer is used as an example of an ink jet printer, but it should be appreciated that the present invention is not limited to the color printer, and can be a monochrome printer as well.

Figure 2:
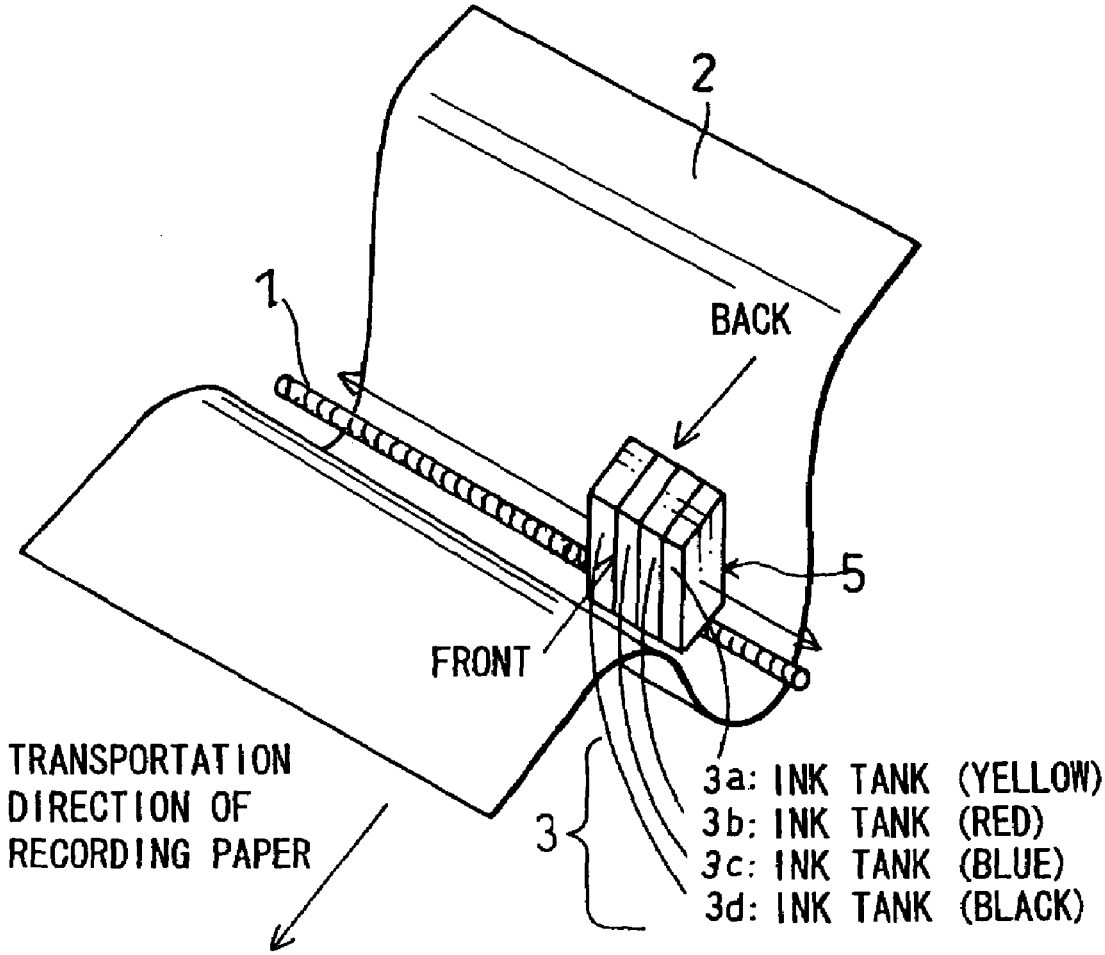
FIG. 2 is a perspective view depicting an arrangement of ink tanks on the ink carriage.

As shown in FIG. 2, an ink jet printer of the present embodiment is provided with a supporting axis 1 set in a direction that intersects at right angles with a direction in which a recording paper 2 is transported and in a direction substantially parallel to the surface of the recording paper 2 being transported, and an ink carriage 5 is attached to the supporting axis 1 in such a manner that it is allowed to run to-and-fro along the supporting axis 1. The ink carriage 5 runs linearly, and a runway portion and an overrun portion are secured at the both ends, respectively.

The ink carriage 5 includes an ink tank 3 composed of a yellow ink tank 3*a*, a red ink tank 3*b*, a blue ink tank 3*c*, and a black ink tank 3*d*, which are aligned sequentially and filled with yellow ink, red ink, blue ink, and black ink, respectively.

Figure 3:
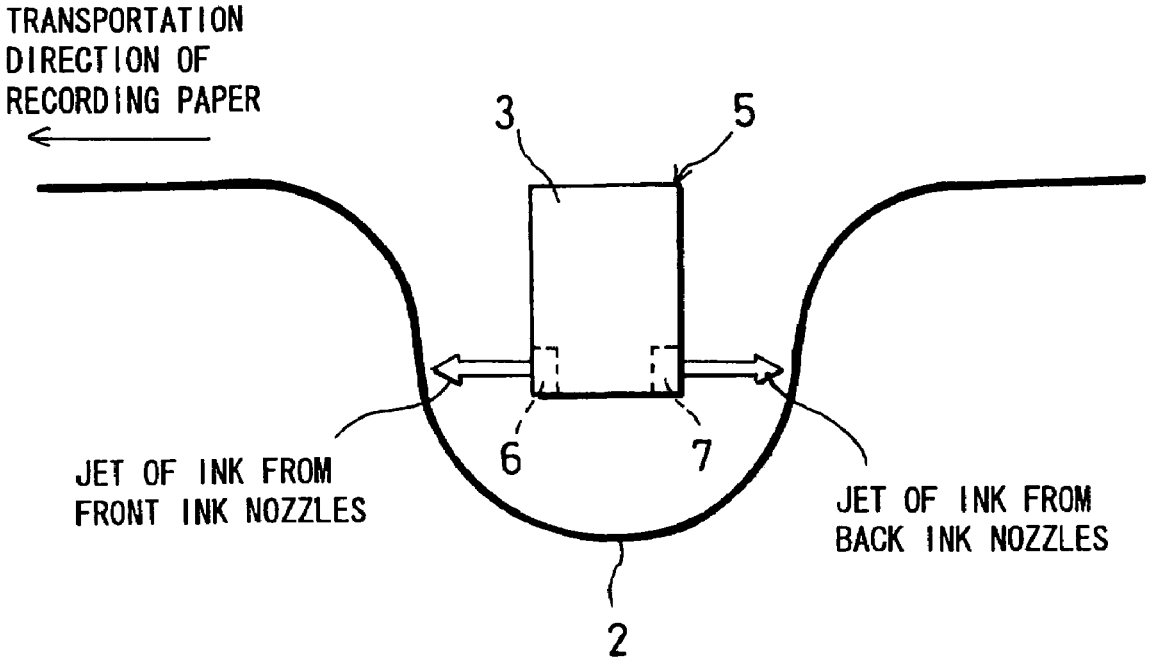
FIG. 3 is a side elevation showing a state where a jet of ink is directed to a recording paper simultaneously from a front ink head and a back ink head provided on the ink carriage.

As shown in FIG. 3, the ink carriage 5 of the present embodiment is provided with a front ink head 6 and a back ink head 7 facing their respective directions, so that the printing can be effected on the recording paper 2 simultaneously at two portions along the transportation direction in which the recording paper 2 is transported through a single transportation path sequentially one by one.

In other words, as shown in the drawing, the front ink head 6 is provided at the bottom of the front surface of the ink tank 3 so as to face the front side, whereas the back ink head 7 is provided at the bottom of the back surface so as to face the back side. Thus, it is arranged such that the directions of jets of ink from the front ink head 6 and back ink head 7 are horizontal and oppose each other.

On the other hand, the transportation path of the recording paper 2 is substantially a U-shape as curved along (going around) the outer surface of the ink carriage 5. Thus, the transportation path is also curved along the outer surface of the supporting axis 1. According to this arrangement, the outer surface of the ink carriage 5 opposes the curved transportation path at the front and back, and it is preferable that substantially the same space is given between the transportation path and the outer surface opposing at the front and back. Also, at least one of the supporting axis 1 and ink carriage 5 is provided to block a virtual extension line of the transportation path heading the printing portions by the ink carriage 5. By providing the transportation path in the above manner, the printing at two portions from the front ink head 6 and back ink head 7 can be effected in a reliable manner.

Figure 4A:
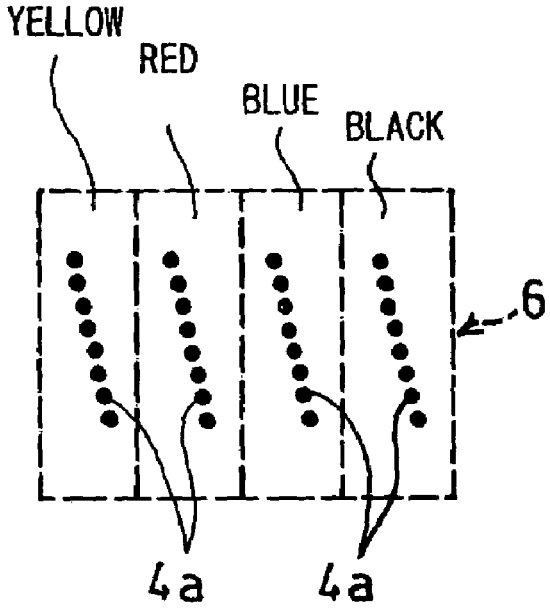
FIGS. 4(*a*) and 4(*b*) are views depicting an arrangement of each ink head on the ink carriage, FIG. 4(*a*) being a view of the front ink head on the ink carriage seen from the back, FIG. 4(*b*) being a view of the back ink head on the ink carriage seen from the back.
Figure 4B:
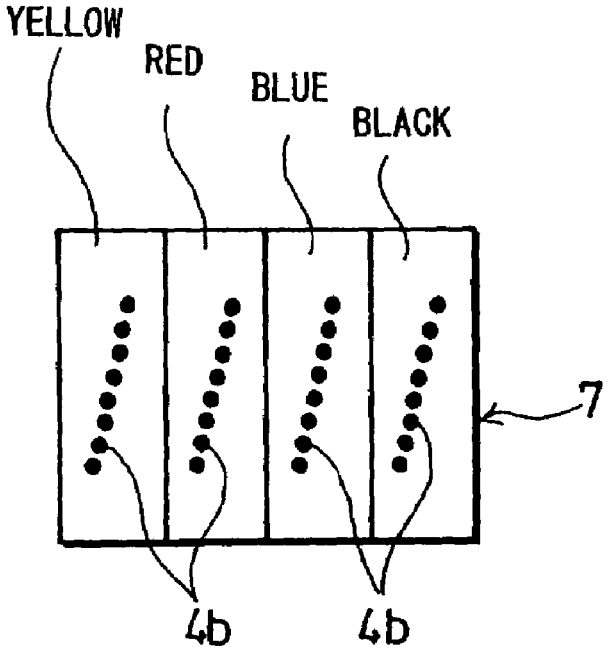

As shown in FIG. 4(*a*), the front ink head 6 is provided with lines of front ink nozzles 4*a* in their respective colors, each line being slanted downward to the right and composed of, for example, eight nozzle holes. Consequently, a jet of ink is directed to the recording paper 2 from each line of the ink nozzles 4*a* on the front surface of the ink carriage 5 simultaneously in a horizontal direction per line height.

On the other hand, as shown in FIG. 4(*b*), the back ink head 7 is provided with lines of back ink nozzles 4*b* in their respective colors, each line being slanted downward to the left and composed of eight nozzle holes. Consequently, a jet of ink is directed to the recording paper 2 from each line of the ink nozzles 4*b* on the back surface of the ink carriage 5 simultaneously in a horizontal direction per line height in the same manner as the front ink head 6.

Figure 1:
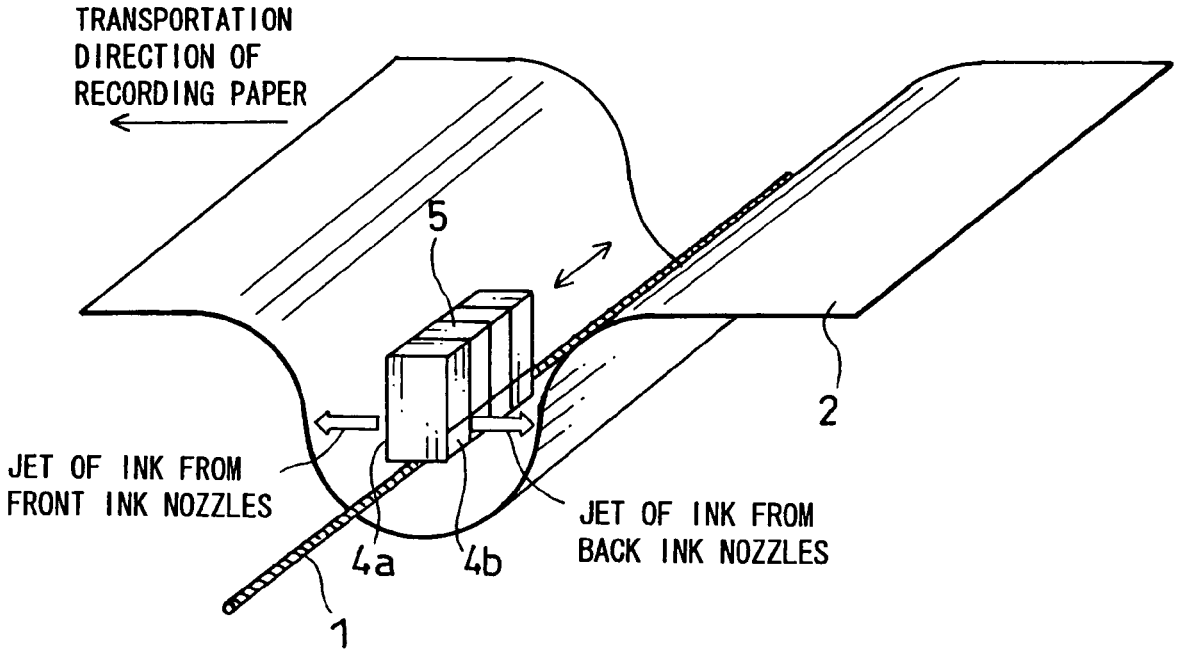
FIG. 1 shows one embodiment of an ink jet printer of the present invention, and is a perspective view showing a state where a jet of ink is directed to a recording paper simultaneously from each of two groups of nozzles provided on an ink carriage and facing their respective directions.

Therefore, as shown in FIG. 1, while one recording paper 2 is transported through the transportation path so as to pass by the ink carriage 5 from the back to the front by going under, a jet of ink is directed to the recording paper 2 from the front ink nozzles 4*a* to print out the first half of data, for example, data of first 15 lines in the transportation direction, while at the same time, a jet of ink is directed to the recording paper 2 from the back nozzles 4*b* to print out the latter half of the data, that is, data of 15 lines following the first 15 lines. It should be appreciated that the number of lines printed out by each group of the front ink nozzles 4*a* and back ink nozzles 4*b* is determined by software run for the printing job. Therefore, the arrangement is not limited to the foregoing, and a jet of ink can be directed to the recording paper 2 from the front ink nozzles 4*a* to print out data of the first 5 lines in the transportation direction, while at the same time, a jet of ink can be directed to the recording paper 2 from the back nozzles 4*b* to print out data of the latter 5 lines in the transportation direction.

In the present embodiment, the ink carriage 5 includes two ink heads provided with the front ink head 6 and back ink head 7 facing their respective directions so that printing is effected on the recording paper 2 simultaneously at two portions along the transportation direction in which the recording paper 2 is transported through a single transportation path sequentially one by one. However, the arrangement is not limited to the foregoing, and the printing can be effected simultaneously at more than two portions on the recording paper 2 along its transportation direction. For example, by providing an unillustrated ink head facing downward in addition to the front ink head 6 and back ink head 7, printing can be effected simultaneously at three portions along the transportation direction of the recording paper 2 adequately by the three ink heads facing their respective directions each assigned by software with any number of lines that should be printed.

As has been discussed, the supporting axis 1 is used to allow the ink carriage 5 to run along the main running direction in a stable manner while the recording paper 2 is transported. Because the printing is effected by the front ink nozzles 4*a* and back ink nozzles 4*b* respectively provided on the two opposing side surfaces of the ink carriage 5, the supporting axis 1 is provided under the ink carriage 5 so as not cause any trouble during the printing.

Figure 5:
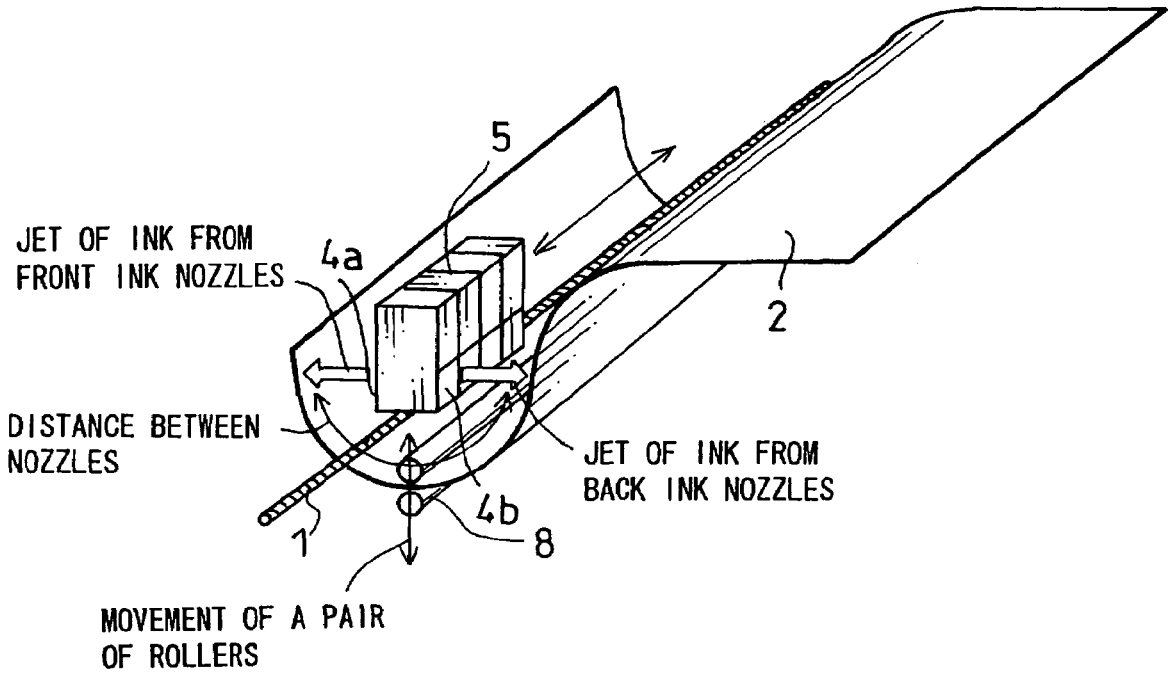
FIG. 5 is a perspective view showing a state where a pair of paper length adjusting rollers provided below a supporting axis are allowed to move vertically.

When the ink carriage 5 is allowed to move in the main running direction, it moves to-and-fro along the supporting axis 1 in association with the recording paper 2 transported for the transmission data. As shown in FIG. 5, the recording paper 2 is transported by passing a space between a pair of paper length adjusting rollers 8 provided below the supporting axis 1 as nozzle distance adjusting means.

Figure 6A:
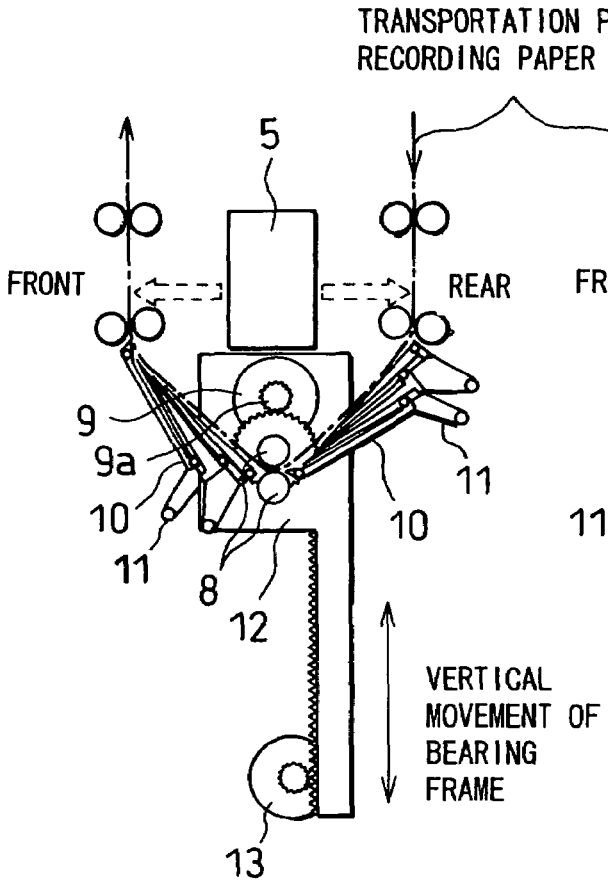
FIGS. 6(*a*) and 6(*b*) are views explaining an arrangement such that allows the pair of paper length adjusting rollers to move vertically, FIG. 6(*a*) showing a state when the shortest distance is given between the nozzles, FIG. 6(*b*) being a state when the longest distance is given between the nozzles.
Figure 6B:
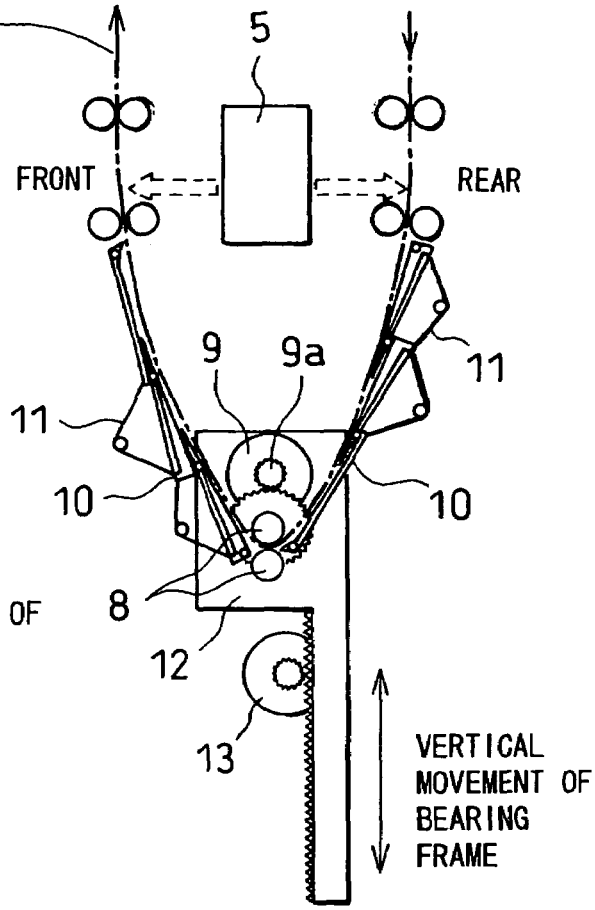

As shown in FIGS. 6(*a*) and 6(*b*), the pair of paper length adjusting rollers 8 transport the recording paper 2 when driven by a roller driving motor 9 having a gear 9*a* that engages with one of the paper length adjusting rollers 8 at the driving end.

The pair of paper length adjusting rollers 8 of the present embodiment are arranged so as to change their position vertically by allowing a paper length adjusting bearing frame 12 to move vertically depending on the length (hereinafter, referred to as full length) in the sub-running direction (transportation direction) of the recording paper 2 being transported.

More specifically, the pair of paper length adjusting rollers 8 and roller driving motor 9 are provided in a mechanism of the paper length adjusting bearing frame 12 that moves vertically in association with the operation of a frame driving motor 13, and the pair of paper length adjusting rollers 8 provided in the paper length adjusting bearing frame 12 move vertically in association with the operation of the frame driving motor 13.

Thus, when the full length of the recording paper 2 is short, the paper length adjusting bearing frame 12 approximates to the ink carriage 5 as shown in FIG. 6(*a*). On the other hand, when the full length of the recording paper 2 is long, the paper length adjusting bearing frame 12 moves away from the ink carriage 5 as shown in FIG. 6(*b*).

Therefore, by vertically moving the pair of paper length adjusting rollers 8 for the recording paper 2 of any length, the ink jet position of the front ink nozzles 4*a* can be set exactly where the first line in the first half of the recording paper 2 should be printed out, while at the same time the ink jet position of the back ink nozzles 4*b* can be set exactly where the first line in the latter half of the recording paper 2 should be printed out.

Figure 7:
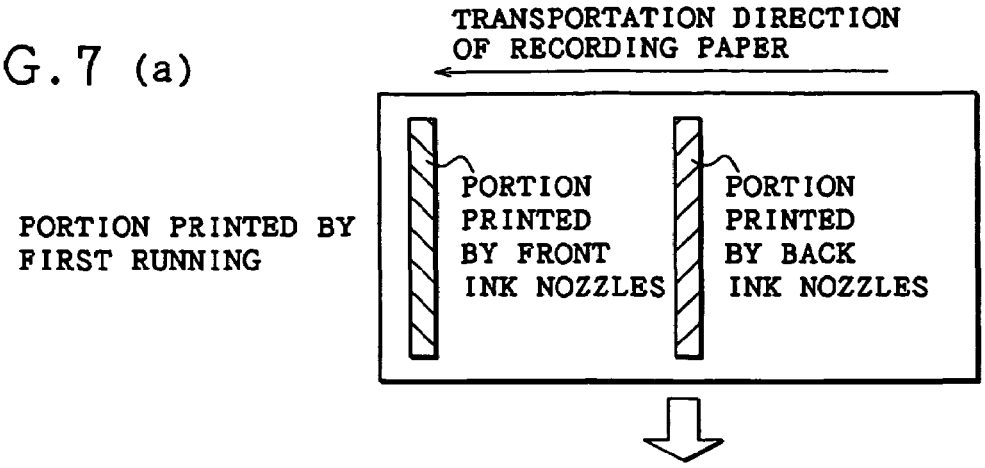
FIGS. 7(*a*) through 7(*c*) are explanatory views showing a position of a portion on the recording paper printed by the front ink nozzles in relation to a position of a portion on the recording paper printed by the back ink nozzles, FIG. 7(*a*) showing a state where the first line of the first half of the recording paper is printed out by the front ink nozzles and the first line of the latter half of the recording paper is printed out by the back ink nozzles, FIG. 7(*b*) showing a state where the second line of the first half of the recording paper is printed out by the front ink nozzles and the second line of the latter half of the recording paper is printed out by the back ink nozzles, FIG. 7(*c*) showing a state where the printing of the first half of the recording paper by the front ink nozzle and the printing of the latter half of the recording paper by the back ink nozzles are completed.
Figure 7:
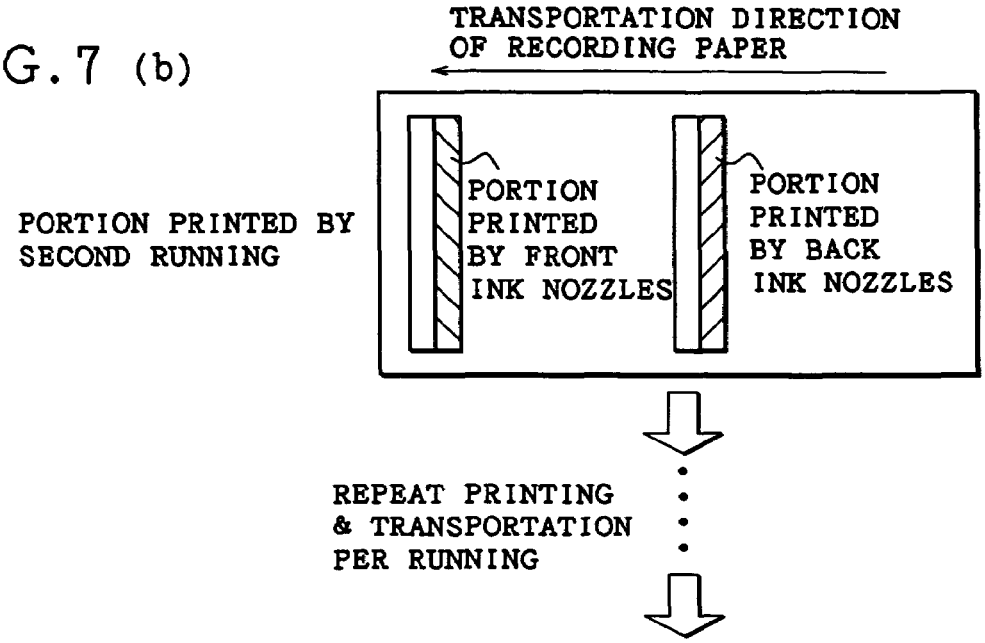
Figure 7:
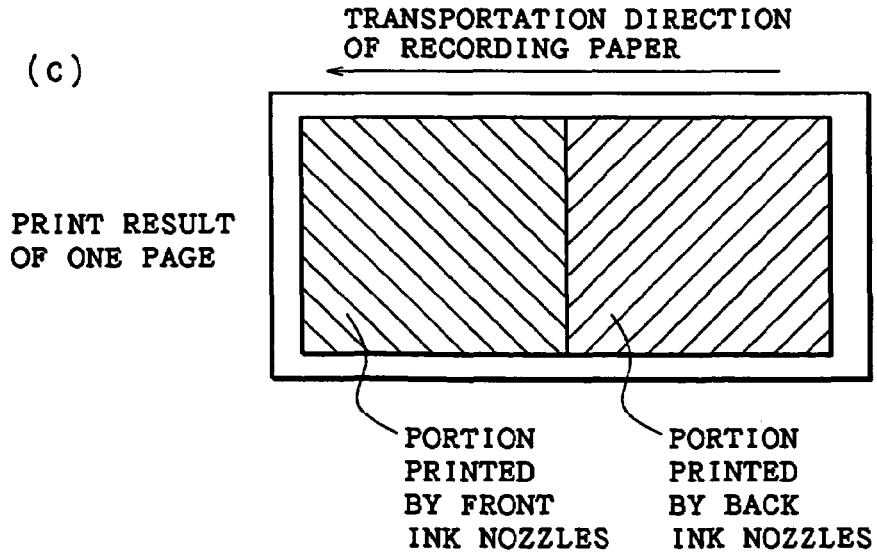

As shown in FIG. 7(*a*), by running the ink carriage 5 forward in the main running direction under these conditions, a jet of ink is directed from the front ink nozzles 4*a* to the recording paper 2, whereby the first line in the first half of the recording paper 2 along its transportation direction is printed out, while at the same time, a jet of ink is directed from the back ink nozzles 4*b* to the recording paper 2, whereby the first line in the latter half of the recording paper 2 along its transportation direction is printed out.

Next, as shown in FIG. 7(*b*), by running the ink carriage 5 backward in the main running direction, the second line in the first half of the recording paper 2 along its transportation direction is printed out by the front ink nozzles 4*a*, while at the same time the second line in the latter half of the recording paper 2 along its transportation direction is printed out by the back ink nozzles 4*b*.

By repeating the above operations, the first half data for the recording paper 2 is printed out by the front ink nozzles 4*a* and while at the same time the latter half data for the recording paper 2 is printed out by the back ink nozzles 4*b*.

Then, as shown in FIG. 7(*c*), the last line printed out by the front ink nozzles 4*a* is connected to the first line printed out by the back ink nozzles 4*b*, thereby making it possible to print out the full data by each of the two groups of ink nozzles 4*a* and 4*b*.

Incidentally, in the present embodiment, as shown in FIGS. 6(*a*) and 6(*b*), extendable guides 10 are provided in the transportation path of the recording paper 2 respectively at the front and back of the pair of paper length adjusting rollers 8 as extendable guiding means. The extendable guides 10 guide the recording paper 2 to secure the transportation path of an adequate length between the two groups of ink nozzles 4*a* and 4*b*, so that the recording paper 2 is transported to the accurate position at the front of the ink carriage 5 through a space between the pair of paper length adjusting rollers 8.

In other words, as has been discussed, because the pair of paper length adjusting rollers 8 move vertically depending on the full length of the recording paper 2, the recording paper 2 may not be transported smoothly if the length of the guides is fixed.

Therefore, the extendable guides 10 are made adjustable, that is, allowed to extend or contract in association with the movement of the paper length adjusting bearing frame 12 in response to the full length of the recording paper 2, thereby making it possible to transport the recording paper 2 smoothly.

Each of the extendable guides 10 respectively positioned at the front side and back side is of a three-fold structure. For example, a translot is provided to each piece of each guide, and three pieces each are linked by inserting unillustrated pins into the translots. Thus, when the paper length adjusting bearing frame 12 moves vertically in response to the full length of the recording paper 2, each extendable guide 10 of the three-fold structure linked at the translots extends or contracts.

Further, each extendable guide 10 is provided with springs 11, so that the extendable guides 10 move in a well organized manner when transporting the recording paper 2. Accordingly, the extendable guides 10 are controlled so as not to move differently from each other.

More specifically, a pair of springs 11 are provided to each extendable guide 10: one is to link the top guide and middle guide at the outer side, and the other is to link the middle guide and the bottom guide at the outer side. When extendable guides 10 extend, the springs 11 also extend, and when the extendable guides 10 contracts, the springs 11 also contract. Consequently, the movements of the extendable guides 10, each composed of three pieces and respectively provided at the front and back sides, can be controlled adequately. It should be appreciated that the number of pieces forming each extendable guide 10 is not limited to three, and can be any desired number greater than one.

Figure 8:
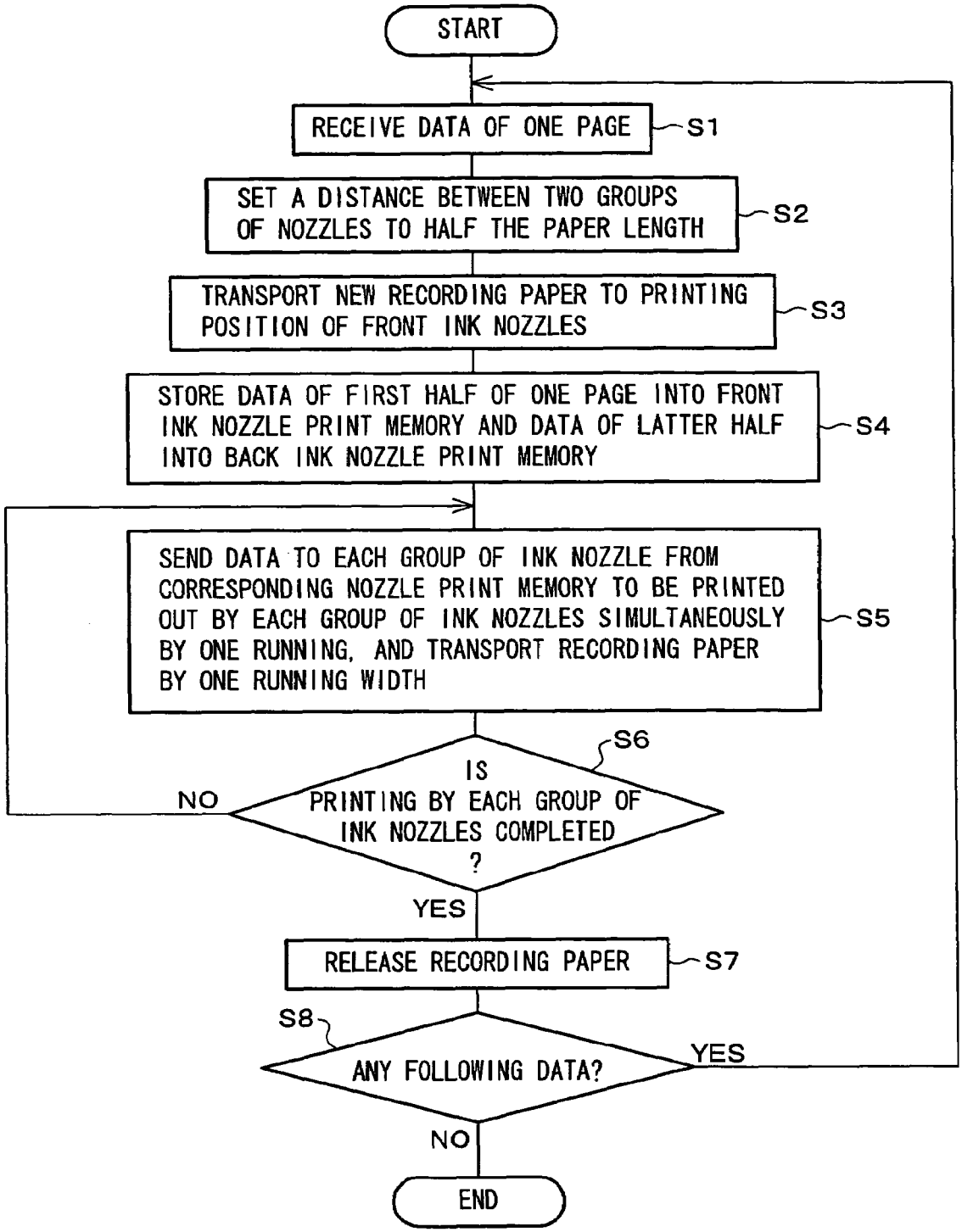
FIG. 8 is a flowchart detailing a control operation when the printing is effected simultaneously on the first half and latter half of one recording paper by the front ink nozzles and back ink nozzles, respectively.

Next, the following description will describe an operation involved in the printing step of the foregoing ink jet printer with reference to the flowchart of FIG. 8.

In the first place, upon receipt of data of one page (Step 1, hereinafter, Step is abbreviated to S), the ink jet printer moves the pair of paper length adjusting rollers 8 vertically by moving the paper length adjusting bearing frame 12 vertically, and sets the length of the transportation path between the two ink heads, that is, front ink head 6 and back ink head 7, to half the print length of the recording paper 2 (S2).

Then, the recording paper 2 is transported to the position at which the first line in the first half of the recording paper 2 is printed out by the front ink nozzles 4*a* (S3). Accordingly, the recording paper is also set to the position at which the first line in the latter half of the recording paper 2 is printed out by the back ink nozzles 4*b*.

Then, the first half data of one page is stored in a print memory for the front ink nozzles 4*a*, while the latter half data of one page is stored in a print memory for the back ink nozzles 4*b* (S4).

Subsequently, the data is sent to the front ink nozzles 4*a* and back ink nozzles 4*b* from their respective print memories, and simultaneous printing by the two groups of ink nozzles 4*a* and 4*b* is effected by running the ink carriage 5 once, after which the recording paper 2 is transported by a running width, that is, one line (S5).

Then, whether or not the data of one page has been printed out by the two groups of ink nozzles is judged (S6), and if not, the flow returns to S5 to repeat the printing and paper-transportation by a running width. On the other hand, if the data of one page has been printed out in S6, the recording paper 2 is released (S7).

Whether there is data of a next page or not is judged (S8), and if there is no data, the flow ends; otherwise, the flow returns to repeat S1 and S1–S8 are repeated.

By effecting the printing of the first half and latter half simultaneously in the above manner, a high-speed printing can be realized.

As has been discussed, in the ink jet printer of the present embodiment, the ink carriage 5 includes the front ink head 6 and back ink head 7 respectively provided with the front ink nozzles 4*a* and back ink nozzles 4*b* facing their respective directions, so that the printing can be effected on the recording paper 2 simultaneously at more than one portion along the transportation direction in which the recording paper 2 is transported through the single transportation path sequentially one by one.

Thus, by running one ink carriage 5, the printing can be effected simultaneously at more than one portion on the same recording paper 2 along the transportation direction thereof. Accordingly, in case of monochrome printing, the printing time can be shortened compared with a case using an ink head provided with ink nozzles facing only one direction.

Also, by allocating the print data to the front ink nozzles 4*a* and back ink nozzles 4*b* facing their respective directions, an overstrike character can be printed out, the printing resolution can be improved, or mixed information can be recorded by transporting the recording paper 2 only once. The recording of mixed information referred to herein includes a case where a jet of ink of a different color is directed from each group of the back ink nozzles 4*b* and front ink nozzles 4*a*.

Further, by providing a switchback path mechanism, the double-side printing can be realized.

Consequently, there can be provided an ink jet printer which can improve printing efficiency by increasing a printing rate and printing resolution, and realizing printing of an overstrike character, simultaneous printing of mixed information, double-side printing, etc.

Also, in the ink jet printer of the present embodiment, the ink carriage 5 includes the front ink head 6 and back ink head 7 respectively provided with the front ink nozzles 4*a* and back ink nozzles 4*b* facing their respective directions, so that the printing can be effected on the recording paper 2 simultaneously at two portions along the transportation direction in which the recording paper 2 is transported through the single transportation path sequentially one by one.

Thus, by running one ink carriage 5, the printing can be effected simultaneously at two portions on the same recording paper 2 along the transportation direction thereof. Accordingly, in case of monochrome printing, the printing time can be shortened to half the printing time when using an ink head provided with ink nozzles facing only one direction.

Also, by allocating the print data to the front ink nozzles 4*a* and back ink nozzles 4*b* facing their respective directions, an overstrike character can be printed out, the printing resolution can be improved, and mixed information can be recorded by transporting the recording paper 2 only once. The recording of the mixed information referred to herein includes a case where a jet of ink of a different color is directed from each group of the back ink nozzles 4*b* and front ink nozzles 4*a*.

Further, by providing the switchback path mechanism as will be discussed below, the double-side printing can be realized.

Consequently, there can be provided an ink jet printer which can improve printing efficiency by increasing a printing rate and printing resolution, and realizing printing of an overstrike character, simultaneous printing of mixed information, double-side printing, etc.

Incidentally, in order to effect the printing at two portions exactly at the preset recording position in the recording paper 2 by the front ink head 6 provided with the front ink nozzles 4*a* facing one direction and the back ink head 7 provided with the back ink nozzles 4*b* facing another direction with respect to the transportation direction of the recording paper 2, a distance between the groups of ink nozzles facing their respective directions in the transportation path has to be adjusted; otherwise the printing can not be effected exactly at two intended portions on the recording paper 2.

However, according to the ink jet printer of the present embodiment, the pair of paper length adjusting rollers 8 are provided to adjust a distance between the front ink nozzles 4*a* and back ink nozzles 4*b* facing their respective directions in the transportation path, so that the printing can be effected at the two set recording positions on the recording paper 2 by the front ink head 6 provided with the front ink nozzles 4*a* facing one direction and the back ink head 7 provided with the back ink nozzles 4*b* facing another direction with respect to the transportation direction of the recording paper 2.

By adjusting the distance between the front ink nozzles 4*a* and back ink nozzles 4*b* in the transportation path by the pair of paper length adjusting rollers 8, printing can be effected exactly at the intended two portions on the recording paper 2 along the transportation direction thereof.

In addition, because the pair of paper length adjusting rollers 8 adjust the distance between the front ink nozzles 4*a* and back ink nozzles 4*b* in the transportation path, printing can be effected exactly at the intended two portions on the recording paper 2 of any length along the transportation direction thereof.

Consequently, there can be provided an ink jet printer which can improve printing efficiency by increasing a printing rate and printing resolution, and realizing printing of an overstrike character, simultaneous printing of mixed information, etc.

According to the present embodiment, half the length of the recording paper 2 set for the printing is given as a length of the transportation path between the front ink nozzles 4*a* and back ink nozzles 4*b*, so that the printing can be effected simultaneously on each of the first half and latter half of the recording paper 2 by the ink carriage 5 provided with the front ink nozzles 4*a* and back ink nozzles 4*b* facing their respective directions.

Consequently, printing can be effected simultaneously at the first half and latter half of one recording paper 2 by the back ink nozzles 4*a* and front ink nozzles 4*b*, thereby making it possible to shorten the printing time to half the printing time when using an ink head provided with ink nozzles facing only one direction.

According to the present embodiment, half the length of the recording paper 2 used for the printing is given as a length of the transportation path between the front ink nozzles 4*a* and back ink nozzles 4*b*, so that the printing can be effected simultaneously on each of the first half and latter half of the recording paper 2 by the ink carriage 5 provided with the front ink nozzles 4*a* and back ink nozzles 4*b* facing their respective directions while the recording paper 2 is transported such that where the first line should be printed out is at the printing position of the front ink nozzles 4*a*.

Consequently, printing can be effected simultaneously at the first half and latter half of one recording paper 2 by the front ink nozzles 4*a* and back ink nozzles 4*b*, thereby making it possible to shorten the printing time to half.

According to the present embodiment, half the length of the recording paper 2 used for the printing is given as a length of the transportation path between the front ink nozzles 4*a* and back ink nozzles 4*b*, so that the printing can be effected simultaneously on each of the first half and latter half of the recording paper 2 by the ink carriage 5 provided with the front ink nozzles 4*a* and back ink nozzles 4*b* facing their respective directions while the recording paper 2 is transported such that where the first line of the latter half should be printed out is at the printing position of the back ink nozzles 4*b*.

Consequently, the front ink nozzles 4*a* can effect the printing on the first half of the recording paper 2. In other words, the front ink nozzles 4*a* can start the printing from where the first line is supposed to start.

According to the present embodiment, based on the length of the recording paper 2 set for the printing, half the length thereof is set as a length of the transportation path between the front ink nozzles 4*a* and back ink nozzles 4*b*, so that the ink carriage 5 makes print on each of the first half and latter half of the recording paper 2 simultaneously by using the front ink nozzles 4*a* and back ink nozzles 4*b* provided on the ink carriage 5 and facing their respective directions, and the recording paper 2 is transported in such a manner that, and the recording paper 2 is transported in such a manner that the front ink nozzles 4*b* starts the printing from the position at which the printing in the latter half of the recording paper 2 is supposed to start.

Consequently, the back ink nozzles 4*b* can effect the printing of the latter half of the recording paper 2. In other words, the front ink nozzles 4*a* can effect the printing in the latter half of the recording paper 2 adequately.

According to the present embodiment, the distance between the front ink nozzles 4*a* and back ink nozzles 4*b* on the transportation path is adjusted by the pair of paper length adjusting rollers 8 at command from a paper selection switch provided on an unillustrated display panel of the ink jet printer.

Consequently, the printing position can be set adequately for the recording paper 2 of any size the user selected.

According to the present embodiment, print data is divided into the first half image data and the latter half image data by an unillustrated control section, which are sent simultaneously to the front ink nozzles 4*a* and back ink nozzles 4*b*, respectively.

Not only by dividing the printing section into two, but also by dividing the print data to the first half data and latter half data by the control section and sending the data simultaneously to the corresponding front ink nozzles 4*a* and back ink nozzles 4*b*, the printing can be effected simultaneously by the front ink nozzles 4*a* and back ink nozzles 4*b*, thereby making it possible to increase the printing rate and efficiency.

On the other hand, when the distance between the two groups of ink nozzles facing their respective directions on the transportation path is adjusted by the pair of paper length adjusting rollers 8, the recording paper 2 can not be transported adequately unless a guide for guiding the same through the extended/shortened distance between the two groups of ink nozzles facing their respective directions is provided.

Hence, the ink jet printer of the present embodiment is provided with the extendable guides 10 for guiding the recording paper 2 through the extended/shortened transportation path between the front ink nozzles 4*a* and back ink nozzles 4*b* facing their respective directions.

Thus, even when the distance between the two groups of ink nozzles facing their respective directions in the transportation path is extended or shortened as a result of adjustment by the pair of paper length adjusting rollers 8, the recording paper 2 can be guided through the transportation path over the extended/shortened distance between the two groups of ink nozzles facing their respective directions, and therefore, can be transported in an adequate manner.

In addition, the extendable guides 10 can guide and transport the recording paper 2 of any size through the transportation path between the back ink nozzles 4*b* and front ink nozzles 4*a* whether the transportation path is extended or shortened.

Consequently, there can be provided an ink jet printer which can improve printing efficiency by increasing a printing rate and printing resolution, and realizing printing of an overstrike character, simultaneous printing of mixed information, double-side printing, etc.

Further, the recording paper 2 of any size is available.

According to the present embodiment, not only the pair of paper length adjusting rollers 8 are provided to extend/shorten the transportation path in response to the paper size, but also the extendable guides 10 are provided on the transportation path so as to operate in association with the pair of paper length adjusting rollers 8.

Therefore, the transportation path of an adequate length can be secured by extending/shortening the extendable guides 10 in response to the paper size. In addition, because the back ink nozzles 4*b* and front ink nozzles 4*a* facing their respective directions are provided, the printing can be effected simultaneously at two portions by the back ink nozzles 4*b* and front ink nozzles 4*a* by running the ink carriage 5 once. Therefore, the printing efficiency can be improved while the printing time is shortened. In addition, the transportation path can be readily adjusted, and the recording paper 2 of any size is available.

In the present embodiment, the printing is effected by directing a jet of ink from the front ink nozzles 4*a* and back ink nozzles 4*b* to the first half and latter half of one recording paper 2 simultaneously and respectively. However, the arrangement is not limited to the foregoing, and the printing may be effected simultaneously on two recording papers 2 by using the above scheme.

Figure 9:
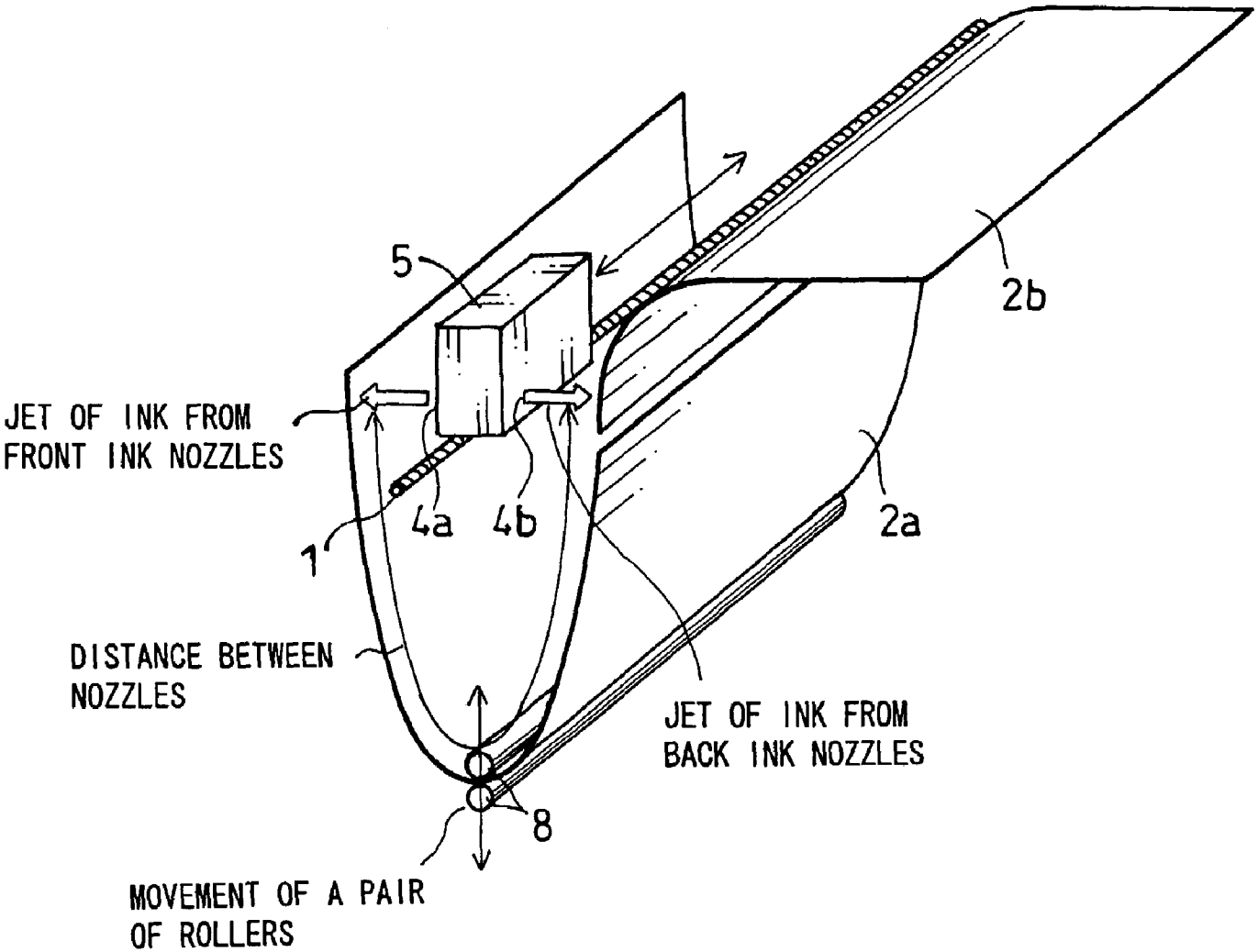
FIG. 9 is a perspective view showing a state where print is made on a first recording paper by the front ink nozzles and print is made on a second recording paper by the back ink nozzles simultaneously in the above ink jet printer.

In other words, as shown in FIG. 9, when more than one recording paper 2 transported one by one exists in the single transportation path, the printing can be accelerated by directing jets of ink from the front ink nozzles 4*a* to the first recording paper 2*a* and a jet of ink from the back ink nozzles 4*b* to the second recording paper 2*b*.

More specifically, as shown in the drawing, the pair of paper length adjusting rollers 8 are moved to meet the full length of the recording papers 2*a* and 2*b*.

Then, the first recording paper 2*a* is transported in such a manner that the top end thereof reaches the opposing position to the front ink jet nozzles 4*a*, and the second recording paper 2*b* is transported in such a manner that the top end thereof reaches the opposing position to the back ink jet nozzles 4*b*, so that the printing can be started from the intended position in each recording paper.

Then, the print data for each recording paper is sent respectively to the front ink nozzles 4*a* and back ink nozzles 4*b*, and the printing is effected by running the ink carriage 5 and directing jets of ink to the recording papers 2*a* and 2*b*, respectively. In other words, the printing on the first recording paper 2*a* is effected by the front ink nozzles 4*a*, while at the same time the printing is effected on the second recording paper 2*b* by the back ink nozzles 4*b*, whereby the printing can be effected on the two recording papers 2*a* and 2*b* simultaneously.

Figure 10:
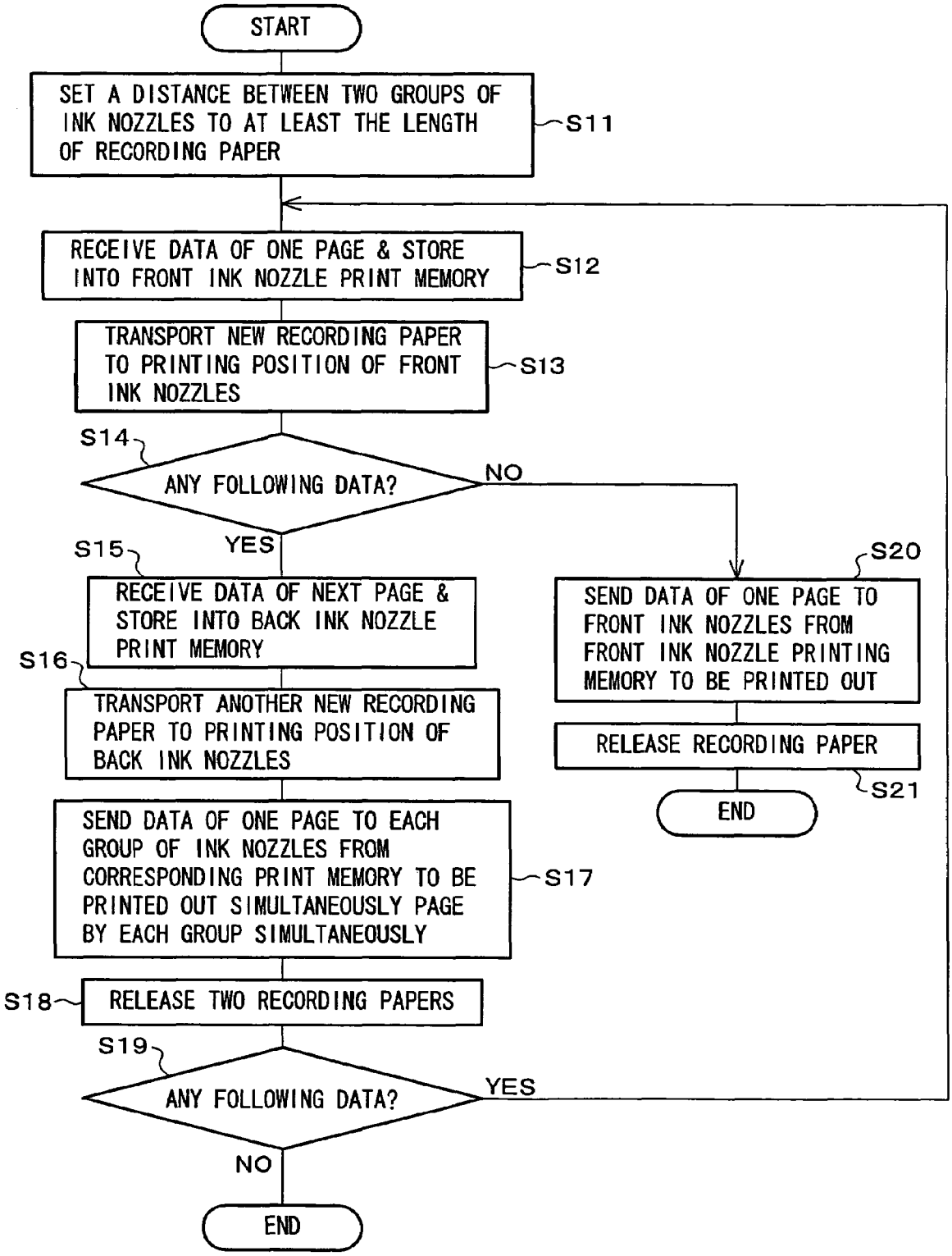
FIG. 10 is a flowchart detailing a control operation when print is made on the first recording paper by the front ink nozzles and print is made on the second recording paper by the back ink nozzles simultaneously.

The following description will describe the control action when effecting the printing is effected simultaneously on two recording papers with reference to the flowchart of FIG. 10.

In the first place, the pair of paper length adjusting rollers 8 are set at a position to secure a distance as long as or longer than the full length of the recording paper 2. In other words, the pair of paper length adjusting rollers 8 are set such that the latter end of the recording paper 2 is transported beyond the ink jet directing position of the back ink nozzles 4*b* (S11). Then, the ink jet printer receives data of one page, and stores the same in the print memory of the front ink nozzles 4*a* (S12).

Then, the first recording paper 2*a* is transported (S13). Here, whether there is data of a second page or not is checked (S14). If so, the ink jet printer receives the data for the second recording paper 2*b*, and stores the same in the print memory of the back ink nozzles 4*b* (S15), and the second recording paper 2*b* is transported to a position such that the printing is effected thereon by the back ink nozzles 4*b* (S16).

Then, the data is sent to the front ink nozzles 4*a* and back ink nozzles 4*b* from their respective print memories, and a jet of ink is directed to each of the first and second recording papers 2*a* and 2*b* simultaneously by the front ink nozzles 4*a* and back ink nozzles 4*b*, respectively, whereby data of one page is printed out on each of the recording papers 2*a* and 2*b* (S17).

When the printing ends, the recording papers 2*a* and 2*b* are released sequentially in this order (S18).

When there is data of the following page after the two recording papers 2*a* and 2*b* are released (S19), the flow returns to S12, and S12–S19 are repeated.

Also, when there is data of only one page in S14, data of one page is sent to the front ink nozzles 4*a* from the print memory, and printed out on the recording paper 2*a* (S20). When the printing ends, the printed recording paper 2*a* is released (S21).

Simultaneous printing on two recording papers can be realized by the foregoing steps.

As has been discussed, in the present embodiment, a distance as long as or longer than the length of the recording paper 2 used for the printing is secured as a distance of the transportation path between the two groups of the back ink nozzles 4*b* and front ink nozzles 4*a* provided on the ink carriage 5, and the printing is effected simultaneously on the two recording papers 2*a* and 2*b* by the two groups of the front ink nozzles 4*a* and back ink nozzles 4*b*, respectively.

Consequently, the printing can be effected simultaneously on the two separate recording papers 2*a* and 2*b* by the two groups of the front ink nozzles 4*a* and back nozzles 4*b*, respectively. Thus, in case that the printing is effected on more than one recording paper 2, the printing time can be shortened to half the printing time when using the ink head provided with ink nozzles facing only one direction.

According to the present embodiment, when the printing is effected simultaneously on two recording papers 2*a* and 2*b* by the two groups of the front ink nozzles 4*a* and back ink nozzles 4*b*, respectively, by securing a distance as long as or longer than the length of the recording paper 2 used for the printing as a distance of the transportation path between the two groups of the back ink nozzles 4*b* and front ink nozzles 4*a* provided on the ink carriage 5 based on the length of the recording paper 2 set for the printing, the printing is effected simultaneously on the recording papers 2*a* an 2*b* after the recording papers 2*a* and 2*b* are transported such that when the top ends thereof reach the printing positions of the front ink nozzles 4*a* and back ink nozzles 4*b*, respectively.

Therefore, in case that the printing is effected on more than one recording paper, the printing is effected on the recording papers 2*a* and 2*b* by the front ink nozzles 4*a* and back ink nozzles 4*b* from their respective top positions, thereby making it possible to increase the printing rate and efficiency.

According to the present embodiment, when the printing is effected simultaneously on two recording papers 2*a* and 2*b* by the two groups of the front ink nozzles 4*a* and back ink nozzles 4*b*, respectively, by securing a distance as long as or longer than the length of the recording paper 2 used for the printing as a distance of the transportation path between the two groups of the back ink nozzles 4*b* and front ink nozzles 4*a* provided on the ink carriage 5 based on the length of the recording paper 2 set for the printing, the printing is effected simultaneously on two recording papers 2*a* and 2*b* by the two groups of the front ink nozzles 4*a* and back ink nozzles 4*b*, respectively, under the condition that the top end of the recording paper 2*a* is at the printing position of the front ink nozzles 4*a* and the latter end thereof is beyond the printing position of the back ink nozzles 4*b* on the transportation path.

Consequently, the latter end of the recording paper 2*a* fed first does not overlap the top end of the recording paper 2*b* set at the printing position of the back ink nozzles 4*b* so that the printing is effected by the same, thereby making it possible to effect the printing on two recording papers simultaneously.

According to the present embodiment, when the printing is effected simultaneously on two recording papers 2*a* and 2*b* by the two groups of the front ink nozzles 4*a* and back ink nozzles 4*b*, respectively, by securing a distance as long as or longer than the length of the recording paper 2 used for the printing as a distance of the transportation path between the two groups of the back ink nozzles 4*b* and front ink nozzles 4*a* provided on the ink carriage 5 based on the length of the recording paper 2 set for the printing, the printing is effected simultaneously on two recording papers 2*a* and 2*b* by the two groups of the front ink nozzles 4*a* and back ink nozzles 4*b*, respectively, under the condition that the top end of the recording paper 2*a* is at the printing position of the front ink nozzles 4*a* and the latter end thereof is beyond the printing position of the back ink nozzles 4*b* on the transportation path while the top end of the following recording paper 2*b* is set at the printing position of the back ink nozzles 4*b*.

Consequently, the recording papers 2*a* and 2*b* do not overlap one on the other, whereby the printing can be effected on the two recording papers 2*a* and 2*b* from the first line in each.

According to the present embodiment, when the printing is effected simultaneously on two recording papers 2*a* and 2*b* by the two groups of the front ink nozzles 4*a* and back ink nozzles 4*b*, respectively, by securing a distance as long as or longer than the length of the recording paper 2 used for the printing as a distance of the transportation path between the two groups of the back ink nozzles 4*b* and front ink nozzles 4*a* provided on the ink carriage 5 based on the length of the recording paper 2 set for the printing, the printing is effected simultaneously on two recording papers 2*a* and 2*b* by the two groups of the front ink nozzles 4*a* and back ink nozzles 4*b*, respectively, by providing the same with different kinds of data.

Consequently, mixed data can be printed out at a higher rate and improved efficiency.

According to the present embodiment, when the printing is effected simultaneously on two recording papers 2*a* and 2*b* by the two groups of the front ink nozzles 4*a* and back ink nozzles 4*b*, respectively, by securing a distance as long as or longer than the length of the recording paper 2 used for the printing as a distance of the transportation path between the two groups of the back ink nozzles 4*b* and front ink nozzles 4*a* provided on the ink carriage 5 based on the length of the recording paper 2 set for the printing, the printing is effected simultaneously on two recording papers 2*a* and 2*b* by the two groups of the front ink nozzles 4*a* and back ink nozzles 4*b*, respectively, by providing the same with the same print data.

Consequently, the data can be printed out on a plurality of recording papers efficiently at a high-speed even if the printing rate is reduced to half.

(Embodiment 2)

Figures 11A, 11B:
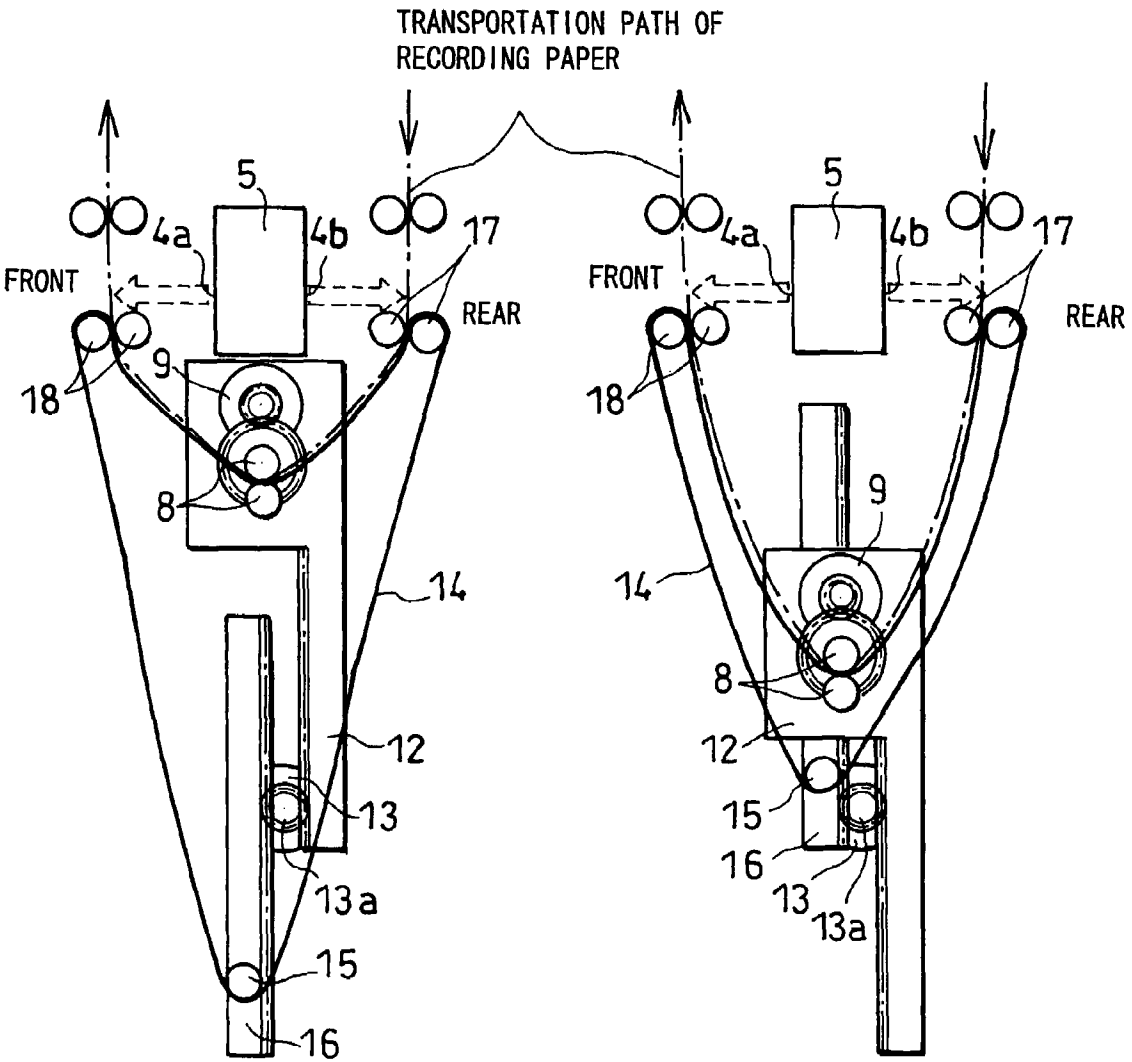
FIGS. 11(*a*) and 11(*b*) are views depicting an arrangement of an ink jet printer in accordance with another embodiment of the present invention, FIG. 11(*a*) showing a state when the shortest distance is given between the two groups of nozzles in case that a recording paper is guided by a transportation guide belt through the shortened/extended transportation path, FIG. 11(*b*) showing a state when the longest distance is given between the two groups of nozzles in the same case.
Figures 12A, 12B:
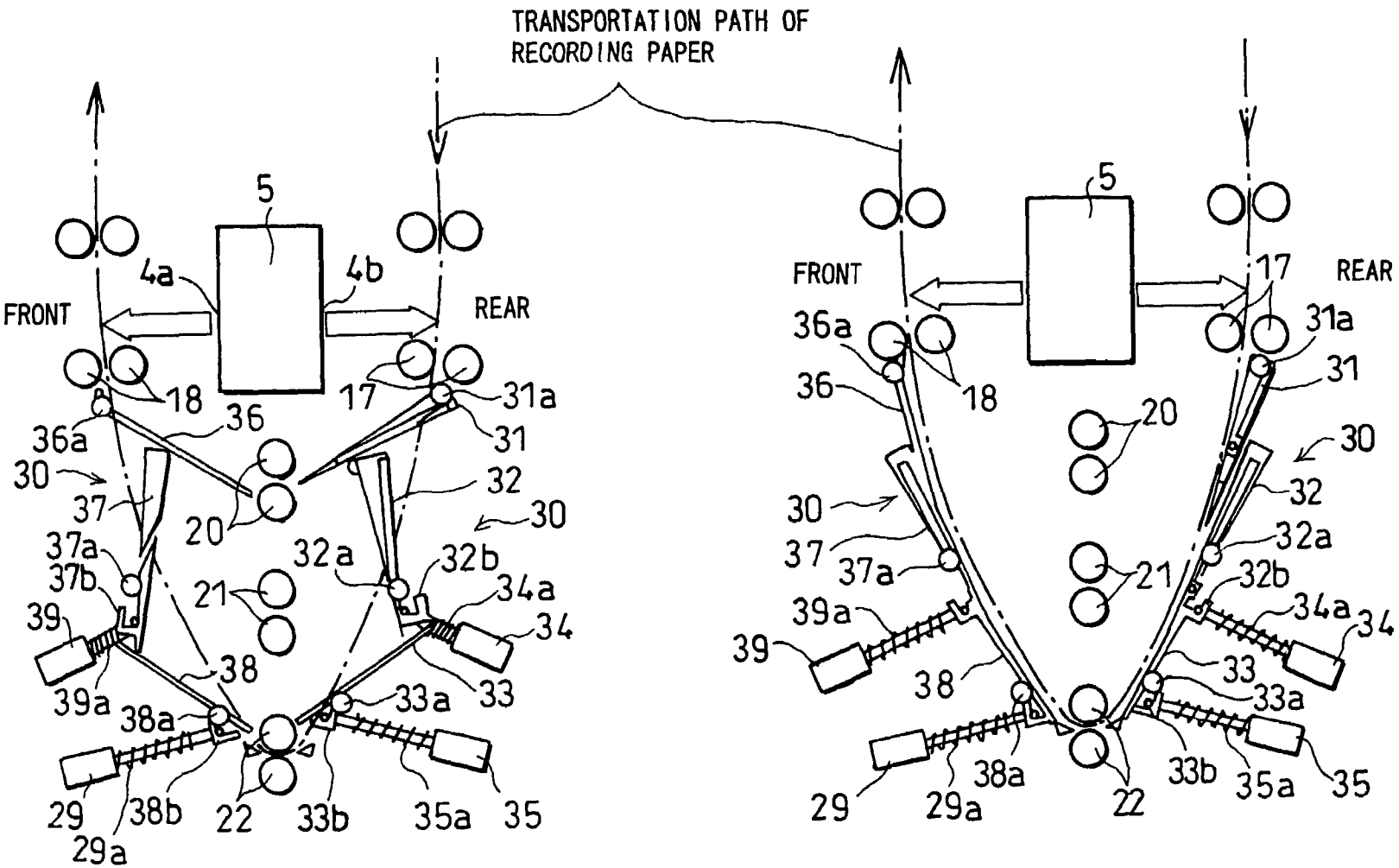
FIGS. 12(*a*) and 12(*b*) are views showing a modified arrangement of the ink jet printer, FIG. 12(*a*) showing a state when the shortest distance is given between the two groups of nozzles in case that the transportation path between the two groups of nozzles is formed by extendable guides and pairs of fixed paper length adjusting rollers in three stages are used, FIG. 12(*b*) showing a state when the longest distance is given to the distance between the two groups of nozzles in case that the transportation path between the two groups of nozzles is formed by extendable guides and pairs of fixed paper length adjusting rollers in three stages are used.
Figure 13:
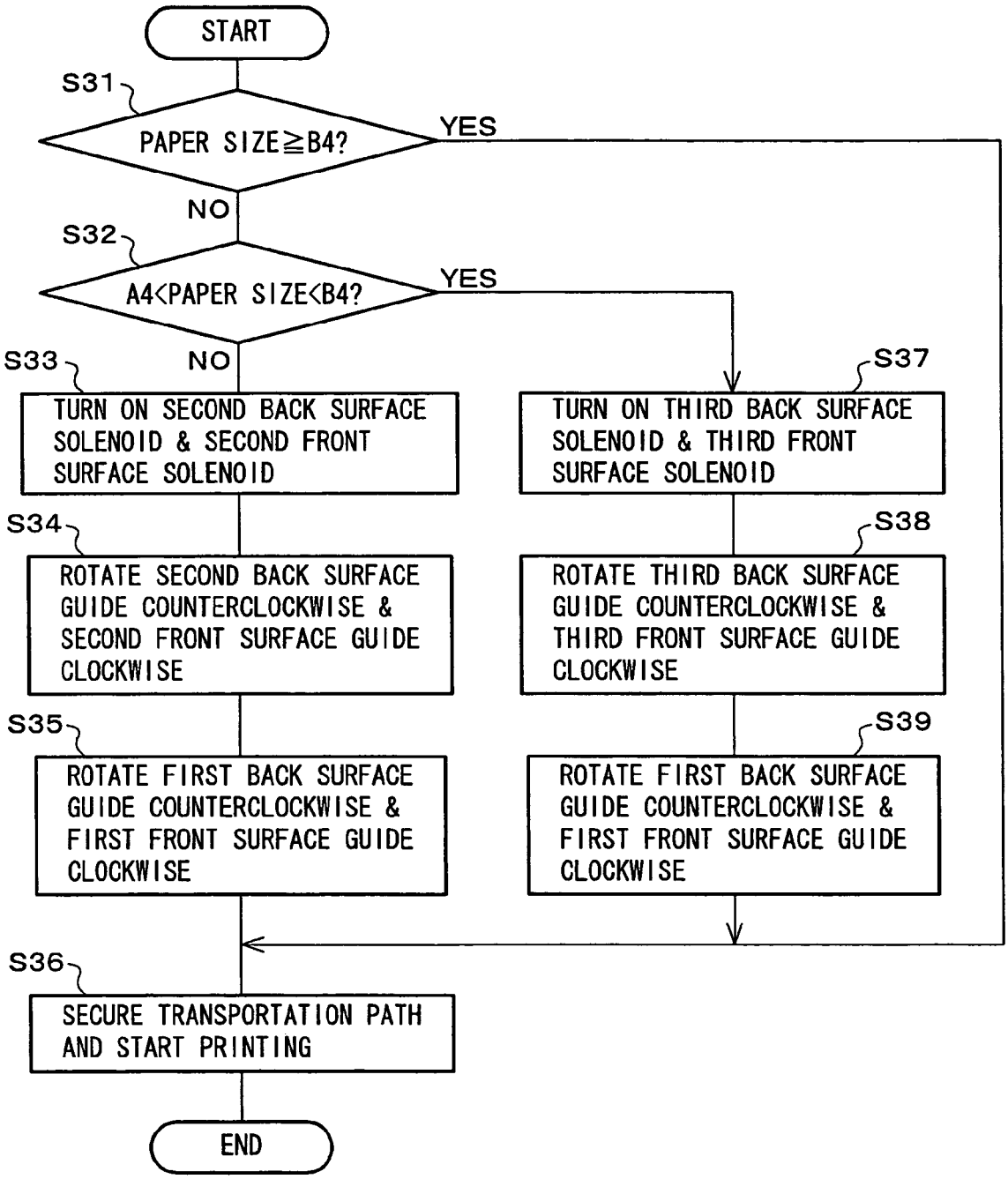
FIG. 13 is a flowchart detaining a control operation of the ink jet printer when the transportation path between the two groups of nozzles is formed by extendable guides and pairs of fixed paper length adjusting rollers in three stages are used.

Referring to FIGS. 11 through 13, the following description will describe another embodiment of the present invention. Hereinafter, like components are labeled with like reference numerals with respect to Embodiment 1, and the description of these components is not repeated for ease of explanation.

In Embodiment 1 above, as shown in FIGS. 6(*a*) and 6(*b*), the extendable guides 10 are provided as extendable guiding means at the front and back of the pair of paper length adjusting rollers 8 on the transportation path of the recording paper 2, whereby the recording paper 2 is guided so as to reach the front of the ink carriage 5 through a space between the pair of paper length adjusting rollers 8 adequately.

However, the extendable guiding means for realizing smooth transportation of the recording paper 2 is not limited to the extendable guides 10.

In other words, in the present embodiment, as shown in FIGS. 11(*a*) and 11(*b*), for example, a transportation guide belt 14 is provided as the extendable guiding means instead of the extendable guides 10.

The transportation guide belt 14 is put across four rollers: (1) a back post-printing transportation roller 17 on the rear side, which is one of a pair of back post-printing transportation rollers 17 provided at a position where the printing on the recording paper 2*b* by the back ink nozzles 4*b* provided on the ink carriage 5 is just finished: (2) one of the paper length adjusting rollers 8 at the top end; (3) a front pre-printing transportation roller 18 on the front side, which is one of the pair of front post-printing transportation rollers 18 provided at a position where the printing on the recording paper 2*b* by the front ink nozzles 4*a* is just started; and (4) a tension roller 15 which is provided at the bottom and rotates in association with the rotation of the transportation guide belt 14.

The tension roller 15 is provided to a belt bearing frame 16 which fits into a motor gear 13*a* of the frame driving motor 13. Thus, by driving the frame driving motor 13, the belt bearing frame 16 moves vertically, in accordance with which the tension roller 15 moves vertically.

In addition, as has been discussed in Embodiment 1, the motor gear 13*a* of the frame driving motor 13 also fits into the paper length adjusting bearing frame 12. Hence, when the paper length adjusting bearing frame 12 moves upward, the belt bearing frame 16 moves downward, and when the paper length adjusting bearing frame 12 moves downward, the belt bearing frame 16 moves upward.

Consequently, when the pair of paper length adjusting rollers 8 provided to the paper length adjusting bearing frame 12 move upward/downward, the tension roller 15 moves downward/upward in a reverse manner, which applies tension of a certain level constantly on the transportation guide belt 14. This prevents unwanted loosening and stretching of the transportation guide belt 14 caused by the vertical movement of the pair of paper length adjusting rollers 8.

Accordingly, after the recording paper 2*b* passes through a space between the pair of back post-printing transportation rollers 17, it is guided by the transportation guide belt 14 to go through a space between the pair of paper length adjusting rollers 8 and a space between the pair of front pre-printing transportation rollers 18 to reach the ink jet directing position of the front ink nozzles 4*a* in an adequate manner depending on the distance between the ink nozzles 4*a* and 4*b*.

On the other hand, another method can be also adopted as the extendable guiding means for guiding the recording paper 2*b*.

In the above-discussed method, the pair of paper length adjusting rollers 8 serving as nozzle distance adjusting means are provided to the paper length adjusting bearing frame 12 and thereby being allowed to move vertically. However, in the alternative method, as shown in FIGS. 12(*a*) and 12(*b*), a pair of short paper length adjusting rollers 20, a pair of medium paper length adjusting rollers 21, and a pair of long paper length adjusting rollers 22 are provided sequentially in three stages as the nozzle distance adjusting means fixed somewhere below the ink carriage 5 at positions corresponding to their respective paper length.

Then, each of extendable guides 30 serving as the extendable guiding means of the present embodiment is composed of, like the extendable guides 10 discussed in Embodiment 1, a first back surface guide 31, a second back surface guide 32, and a third back surface guide 33 for the one at the rear side, and a first front surface guide 36, a second front surface guide 37, and a third front surface guide 38 for the one at the front side. However, different from the extendable guides 10, the springs 11 used in extending and contracting the same are omitted.

The extendable guides 30 are instead arranged in the following manner. That is, the first back surface guide 31, second back surface guide 32, and third back surface guide 33 are allowed to rotate around their respective linking axes 31*a*, 32*a*, and 33*a*. Likewise, the first front surface guide 36, second front surface guide 37, third surface guide 38 are allowed to rotate around their respective linking axes 36*a*, 37*a*, and 38*a*.

Also, the second back surface guide 32, third back surface guide 33, second front surface guide 37, third front surface guide 38 are provided with a second back surface guide solenoid 34, a third back surface guide solenoid 35, a second front surface guide solenoid 39, and a third front surface guide solenoid 29, respectively.

Further, the second back surface guide 32 and third back surface guide 33, the second front surface guide 37 and third front surface guide 38 are provided with ribs 32*b* and 33*b*, and ribs 37*b* and 38*b* to which the arm portions of the second back surface guide solenoid 34 and third back surface guide solenoid 35, and the second front surface guide solenoid 39 and third front surface guide solenoid 29 are hooked, respectively. The first back surface guide 31, second back surface guide 32, and third back surface guide 33, and the first front surface guide 36, second front surface guide 37, and third front surface guide 38 are operated in accordance with the forward/backward movement of the second back surface guide solenoid 34, third back surface guide solenoid 35, second front surface guide solenoid 39, and third front surface guide solenoid 29, respectively.

Also, springs 34*a* and 35*a* and springs 39*a* and 29*a* are inserted into the arm portions of the second back surface guide solenoid 34, third back surface guide solenoid 35, second front surface guide solenoid 39, and third front surface guide solenoid 29, respectively, which form mechanism such that smoothly opens the second back surface guide solenoid 34, third back surface guide solenoid 35, second front surface guide solenoid 39, and third front guide solenoid 29, respectively.

The following will explain a control operation of each guide by the above-arranged extendable guides 30 upon detection of the paper size with reference to the flowchart of FIG. 13.

In the first place, whether the recording paper 2 is of an ISO size B4 or larger is judged (S31). When the recording paper 2 is a large-size paper, such as ISO size A3 and ISO size B4, as shown in FIG. 12(*b*), the recording paper 2 is transported and the printing is effected thereon with the second back surface guide solenoid 34, third back surface guide solenoid 35, second front surface guide solenoid 39, and third front surface guide solenoid 29 all being released (S36).

When the recording paper 2 is judged as being smaller than the ISO size B4 in S31, then whether the recording paper 2 is larger than the ISO size A4 or not is judged (S32).

When the recording paper 2 is judged as being not larger than the ISO size A4 in S32, such as the ISO size A4 or B5, as shown in FIG. 12(*a*), the second back surface guide solenoid 34 and second front surface guide solenoid 39 are turned ON (S33), whereupon the second back surface guide 32 and second front surface guide 37 rotate around their respective linking axes 32*a* and 37*a* (S34).

At this point, the second back surface guide 32 and second front surface guide 37 respectively touch the first back surface guide 31 and first front surface guide 36 which are placed above adjacently at the ends opposite to the ends pulled by the second back surface guide solenoid 34 and second front surface guide solenoid 39. Hence, the first back surface guide 31 and first front surface guide 36 rotate around their respective linking axes 31*a* and 36*a* toward the pair of short paper length adjusting rollers 20 (S35). Accordingly, the transportation path for the small size paper is secured, which prevents the recording paper 2 from being transported to the second back surface guide 32, third back surface guide 33, second front surface guide 37, and third front surface guide 38 provided below, and the recording paper 2 is transported and the printing is effected thereon under these conditions (S36).

When the printing on the recording paper 2 ends, the second back surface guide solenoid 34 and second front surface guide solenoid 39 are turned OFF, and as shown in FIG. 12(*b*), the extendable guides 30 are restored to secure the transportation path for a large-size paper due to the returning power of the springs 34*a* and 39*a*.

On the other hand, in case that the recording paper 2*b* is judged as being the medium size larger than the ISO size A4 and smaller than the ISO size B4, that is, A4R and B5R, the third back surface guide solenoid 35 and third front guide solenoid 29 are turned ON (S37).

Accordingly, the third back surface guide 33 and third front surface guide 38 rotate (S38), whereby the second back surface guide 32 and second front surface guide 37 placed above rotate toward the pair of medium paper length adjusting rollers 21 (S39) and the transportation path below the same is closed. Consequently, the flow proceeds to S36, where the recording paper 2 is transported and the printing is effected thereon under these conditions.

When the printing on the recording paper 2 ends, the third back surface guide solenoid 35 and third front surface guide solenoid 29 are turned OFF, and as shown in FIG. 12(*b*), the extendable guides 30 are restored to secure the transportation path for a large-size paper due to the returning power of the springs 35*a* and 29*a*.

In this manner, the ink jet printer of the present embodiment uses the transporting guide belt 14 instead of the two extendable guides 10, and includes the tension roller 15 which maintains the tension of the transporting guide belt 14 at a constant level so as to keep the transportation performance. The position of the tension roller 15 varies in association with the movement of the pair of paper length adjusting rollers 8 which change its position in response to the paper size.

Consequently, the adequate transportation path for the recording paper 2 of any length used in printing can be secured. In addition, because the back ink nozzles 4*b* and front ink nozzles 4*a* facing their respective directions are provided, the printing can be effected simultaneously at two portions by the back ink nozzles 4*b* and front ink nozzles 4*a* by running the ink carriage 5 once, thereby realizing efficient printing while shortening the printing time. Further, the transportation path can be readily adjusted and the recording paper of any size can be used.

In addition, by using the transportation guide belt 14, the occurrence of a transportation jamming trouble caused when, for example, the recording paper 2 is hooked by the rib or the like can be reduced.

Further, by providing the tension roller 15, stable transportation performance can be offered all the time.

Also, by moving the tension roller 15 in association with the pair of paper length adjusting rollers 8 by means of one motor, the arrangement of the pair of paper length adjusting rollers 8 and transportation guide belt 14 can be simplified, while at the same time, the recording paper 2 can be guided in a precise manner depending on its paper length. Consequently, the ink jet printer can be designed at a low cost.

In addition, according to the present embodiment, the pair of short paper length adjusting rollers 20, the pair of medium paper length adjusting rollers 21, the pair of long paper length adjusting rollers 22 are provided sequentially in the three stages as the nozzle distance adjusting means, and three guides including the first back surface guide 31, second back surface guide 32, third back surface guide 33 are provided at the rear side, and three guides including the first front surface guide 36, second front surface guide 37, and third front surface guide 38 are provided at the front side. Further, the foregoing guides are provided with linking axes 31*a*, 32*a*, 33*a*, 36*a*, 37*a*, and 38*a* each serving as a rotating axis. Also, by pulling the end portions of the second back surface guide 32, third back surface guide 33, second front surface guide 37, third front surface guide 38 by the second back surface guide solenoid 34, third back surface guide solenoid 35, second front surface guide solenoid 39, and third front surface guide solenoid 29, respectively, the first back surface guide 31, second back surface guide 32, third back surface guide 33, first front surface guide 36, second front surface guide 37, and third front surface guide 38 are rotated around their respective linking axes 31*a*, 32*a*, 33*a*, 36*a*, 37*a*, and 38*a*, whereby the transportation path is adjusted depending on the size of the recording paper 2 used.

Thus, the adequate transportation path can be secured for the recording paper of any size. In addition, because the back ink nozzles 4*b* and front ink nozzles 4*a* facing their respective directions are provided, the printing can be effected simultaneously at two portions by the back ink nozzles 4*b* and front ink nozzles 4*a* by running the ink carriage 5 once, thereby realizing efficient printing while shortening the printing time.

In addition, the transportation path can be readily adjusted. Further, the recording paper 2 of any size can be used.

Moreover, the nozzle distance adjusting means and extendable guiding means can be provided in a small space. Further, not only can the extendable guides 30 be adjusted precisely depending on the paper size, but also the paper size can be changed mechanically in a short time.

(Embodiment 3)

Referring to FIGS. 14 through 24, the following description will describe still another embodiment of the present invention. Hereinafter, like components are labeled with like reference numerals with respect to Embodiments 1 and 2, and the description of these components is not repeated for ease of explanation.

An ink jet printer of the present embodiment is identical with its counterpart of Embodiment 1 having two groups of front ink nozzles 4*a* and back ink nozzles 4*b* on the single ink tank 3, except that holes of the front ink nozzles 4*a* are shifted by half the pitch in the running direction from the holes of the back ink nozzles 4*b* so as to realize high resolution printing. One pitch referred to herein means a distance (length) the recording paper 2 moves per running, and a space between the printing position for a running and the printing position for the next running.

Figure 14:
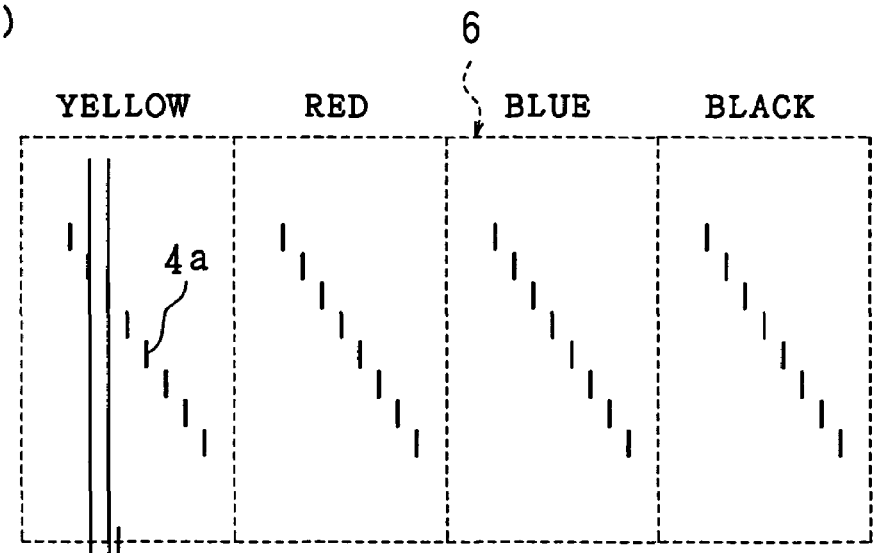
FIGS. 14(*a*) and 14(*b*) are explanatory views showing an ink jet printer in accordance with still another embodiment of the present invention, FIG. 14(*a*) showing the front ink head seen from the back when the front ink nozzles are assigned with odd-numbered columns, FIG. 14(*b*) showing the back ink head seen from the back when the back ink nozzles are assigned with even-numbered columns.
Figure 14:
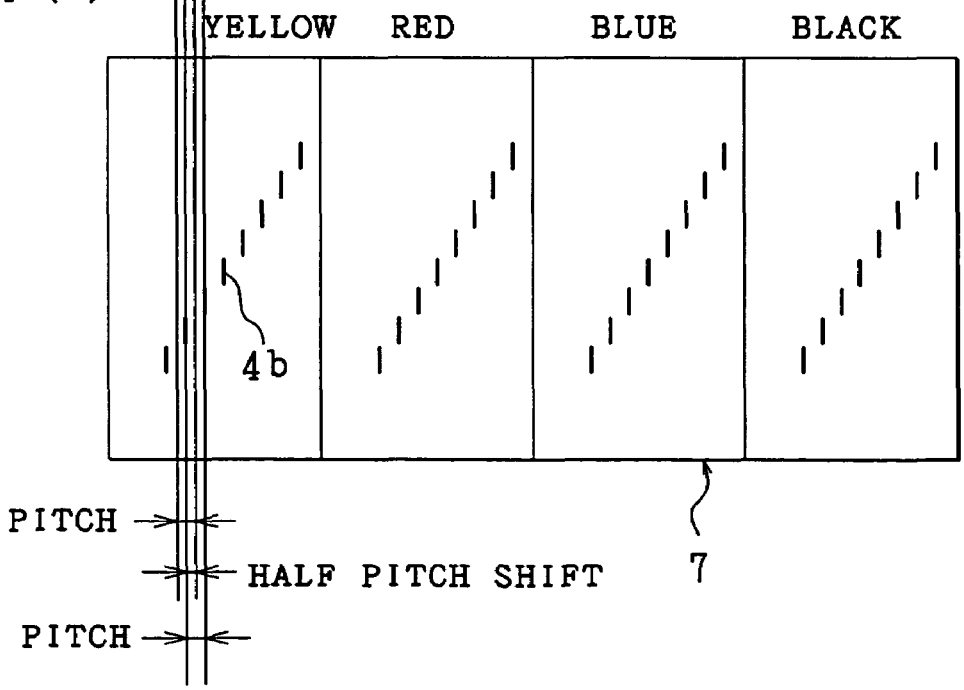

In other words, as shown in FIG. 14(*a*), the front ink nozzles 4*a* in the front ink head 6 are aligned in a line slanted downward to the right with respect to the main running direction which is in parallel with the supporting axis 1 and each is shifted by one pitch in the main running direction. Consequently, as shown in FIG. 15(*a*), a jet of ink is directed from the front ink nozzles 4*a* to form print data in the odd-numbered columns.

On the other hand, as shown in FIG. 14(*b*), the back ink nozzles 4*b* in the back ink head 7 are aligned in a line slanted downward to the left with respect to the main running direction which is in parallel with the supporting axis 1 and each is shifted by one pitch in the main running direction. Consequently, as shown in FIG. 15(*b*), a jet of ink is directed from the back ink nozzles 4*b* to form print data in the even-numbered columns.

In other words, as shown in FIGS. 14(*a*) and 14(*b*), the holes of the front ink nozzles 4*a* and the those of the back ink nozzles 4*b* are shifted by half the pitch with respect to each other.

Figure 15:
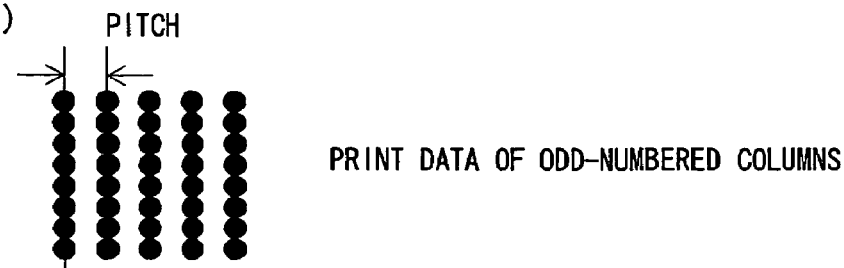
FIGS. 15(*a*) through 15(*c*) are explanatory views of a printing state of the ink jet printer, FIG. 15(*a*) showing print data of odd-numbered columns printed by the front ink nozzles, FIG. 15(*b*) showing print data of even-numbered columns printed by the back ink nozzles, FIG. 15(*c*) showing a state when print of even-numbered columns and print of odd-numbered columns are superimposed one on the other.
Figure 15:
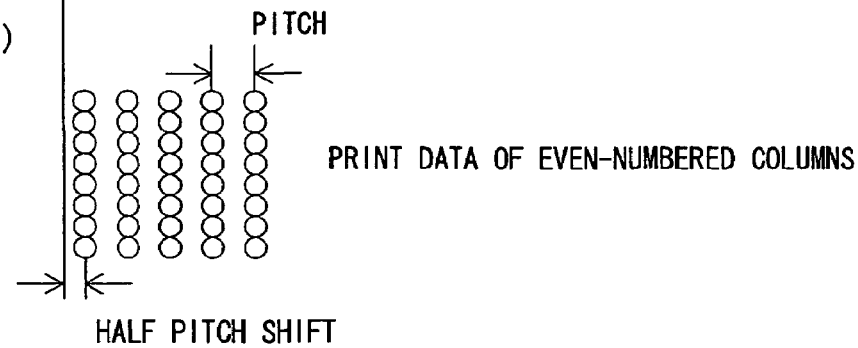
Figure 15:
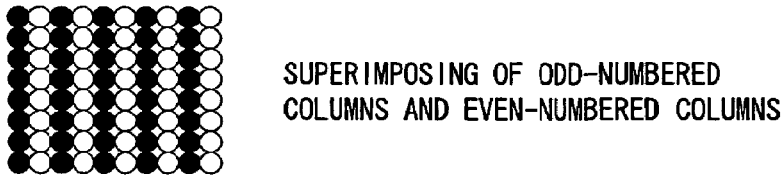

Thus, the front ink nozzles 4*a* and back ink nozzles 4*b* are assigned for the printing of odd-numbered columns and the printing of even-numbered columns, respectively, and as shown in FIG. 15(*a*), the odd-numbered columns are printed out first by the back ink nozzles 4*b*, and then, as shown FIG. 15(*b*), the even-numbered columns are printed out by the front ink nozzles 4*a* on the recording paper 2 so as to be superimposed on the corresponding odd-numbered columns. Consequently, the print of the odd-numbered columns and the print of the even-numbered columns are superimposed one on the other. Hence, as shown in FIG. 15(*c*), print data with the resolution twice as high in the main running direction can be obtained.

In the foregoing, the front ink nozzles 4*a* are assigned for the printing of odd-numbered columns and the back ink nozzles 4*b* are assigned for the printing of even-numbered columns. However, switching such an assignment does not cause any problem.

Figure 16:
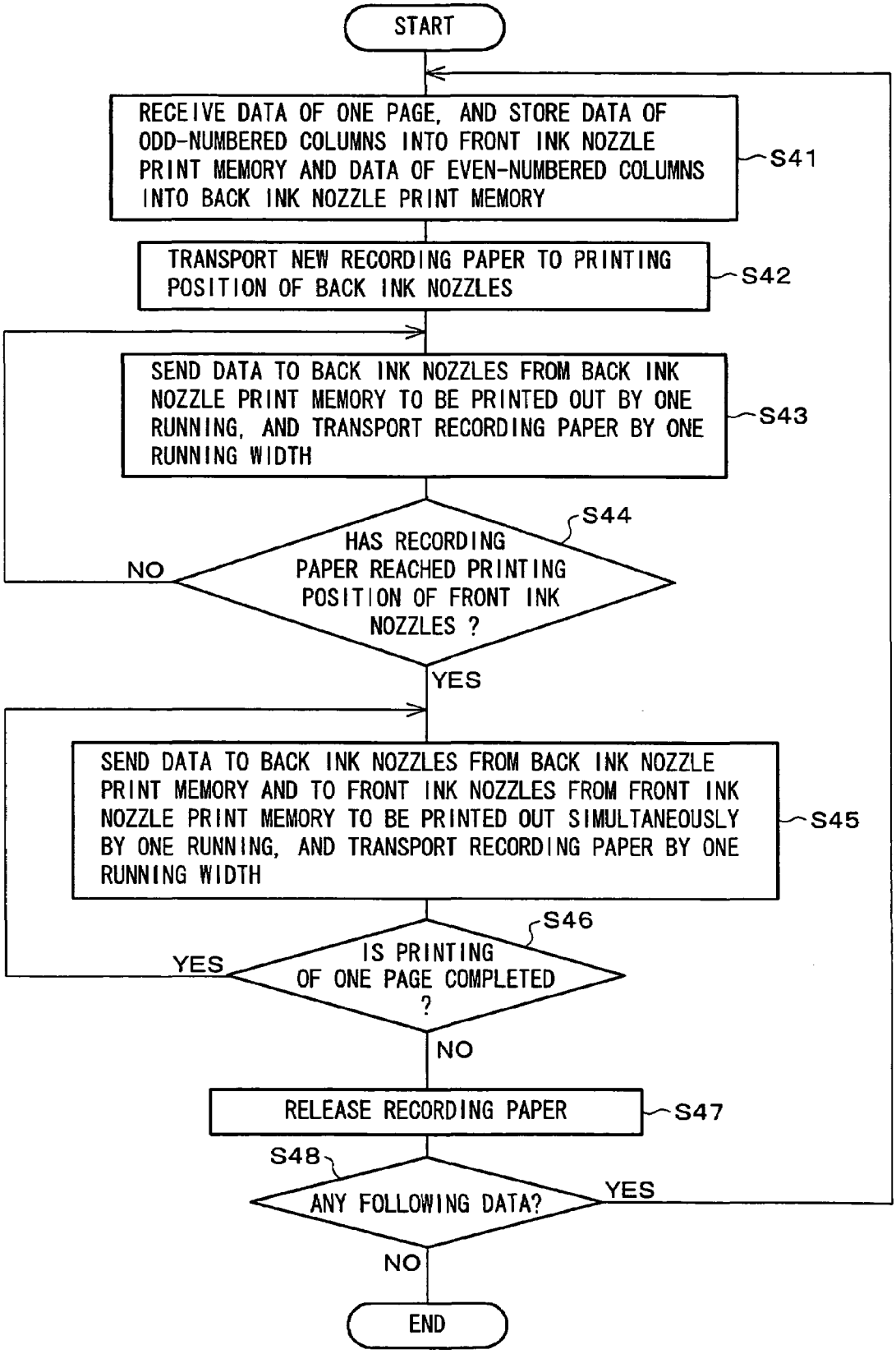
FIG. 16 is a flowchart detailing a control operation when print data of even-numbered columns printed out by the back ink nozzles and print data of odd-numbered columns printed out by the front ink nozzles are superimposed one on the other.

The following description will describe the control operation in the foregoing superimpose printing with reference to the flowchart of FIG. 16.

In the first place, the ink jet printer receives data of one page, and data of the odd-numbered columns is stored in the front ink nozzle print memory, while data of the even-numbered columns is stored in the back ink nozzle print memory (S41). Then, the recording paper 2 is transported to the printing position of the back ink nozzles 4*b* (S42), and the data is sent to the back ink nozzles 4*b* from the back surface ink nozzle print memory. Subsequently, the printing is effected by running the ink carriage 5 once, and the recording paper 2 is transported by one running width, that is, by one line (S43).

Then, whether the recording paper 2 has reached the printing position of the front ink nozzles 4*a* or not is judged (S44). If not, the flow returns to S43, and S43 and S44 are repeated until the recording paper 2 reaches the printing position of the front ink nozzles 4*a*.

When it is judged that the recording paper 2 has reached the printing position of the front ink nozzles 4*a* in S44, data is sent to the back ink nozzles 4*b* from the back ink nozzles print memory, while at the same time data is sent to the front ink nozzles 4*a* from the front ink nozzle print memory, so that data is printed out by the two groups of ink nozzles 4*a* and 4*b* simultaneously by running the ink carriage 5 once, after which the recording paper 2 is transported by one running width (S45).

Then, whether the printing of one page is completed or not is judged (S46), and if not, the flow returns to S45, and S45 and S46 are repeated until the printing is completed.

When the printing is completed in S46, the recording paper 2 is released (47).

If there is data for a following page when the printing on the recording paper 2 is completed (S48), the flow returns to S41, and S41–S48 are repeated.

By carrying the foregoing steps, print with the resolution two times greater can be made.

As has been discussed, according to the ink jet printer of the present embodiment, each group of the back ink nozzles 4*b* and front ink nozzles 4*a* facing their respective directions along the transportation direction of the recording paper 2 is provided with a plurality of ink holes aligned in a line slanted with respect to the main running direction along the supporting axis 1 and the transportation direction of the recording paper 2 for each color. In addition, the plurality of ink holes for the same color in each group of the back ink nozzles 4*b* and front ink nozzles 4*a* facing their respective directions are shifted by half the pitch with respect to each other as to the intervals among the ink nozzles in the running direction along the supporting axis 1.

For this reason, the first printing is effected by the back ink nozzles 4*b* facing one direction, and the second printing is effected by the front ink nozzles 4*a* facing another direction by shifting the intervals in the running direction along the supporting axis 1 half the pitch, so that the second print is superimposed on the first print. Accordingly, resolution and printing density in the running direction along the supporting axis 1 can be increased twice.

Consequently, there can be provided an ink jet printer which can improve printing efficiency by improving printing resolution, etc.

It should be appreciated that the present invention is not limited to the above embodiment and can be modified in various manners within the scope of the present invention. For example, in the above embodiment, the holes of the front ink nozzles 4*a* and back ink nozzles 4*b* are of the identical size. However, the size of the ink nozzles can be changed.

Figure 17:
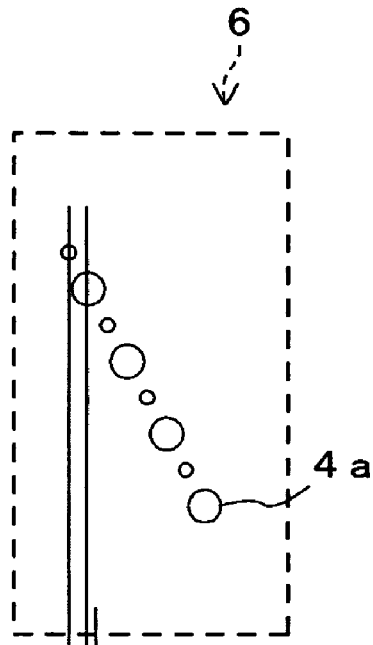
FIGS. 17(*a*) and 17(*b*) are explanatory views showing a modified example of the ink jet printer, FIG. 17(*a*) showing the front ink head seen from the back when the diameters of the ink drop of the front ink nozzles are made in order of "small", "large", "small", "large", in even-numbered columns, FIG. 17(*b*) showing the back ink head seen from the back when the diameters of the ink drop of the back ink nozzles are made in order of "large", "small", "large", "small", in odd-numbered columns.
Figure 17:
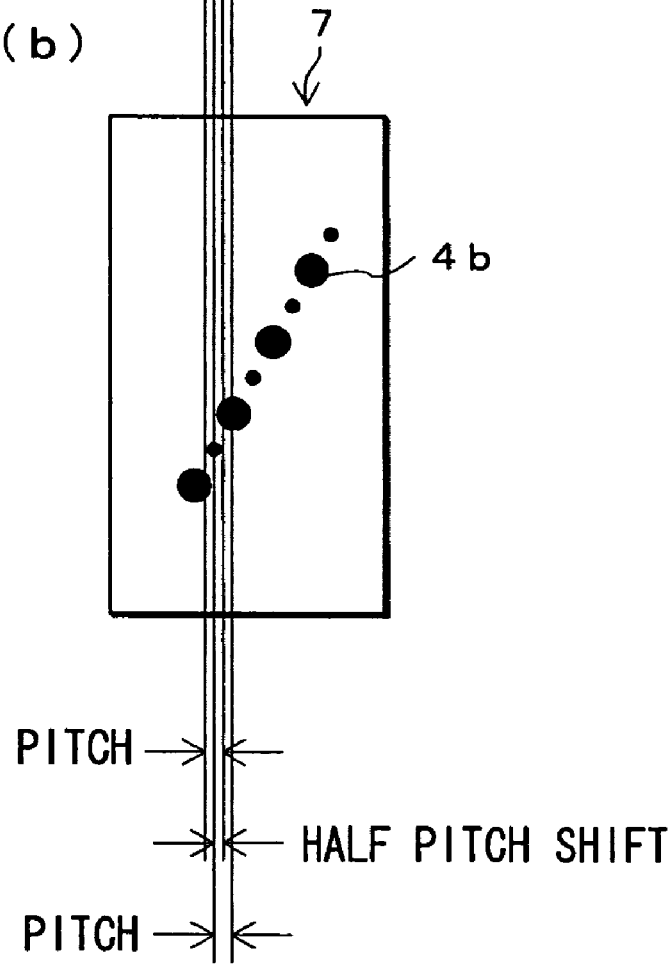

For example, as shown in FIG. 17(*b*), the diameter of the ink drop from the back ink nozzles 4*b* of the back ink head 7 of the ink tank 3 provided on the ink carriage 5 may be arranged in order of "large", "small", "large", "small", On the other hand, as shown in FIG. 17(*a*), the diameter of the ink drop from the front ink nozzles 4*a* of the front ink head 6 on the ink tank 3 provided on the ink carriage 5 may be arranged in order of "small", "large", "small", "large", The ink drop of the large or small diameter can be formed by changing the size of the ink nozzle holes, or alternatively can be formed from the ink nozzles holes of the same size by changing a quantity of ink to be dropped.

Figure 18:
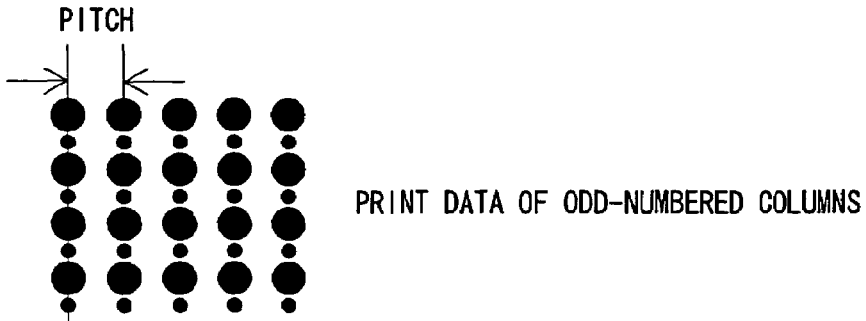
FIGS. 18(*a*) through 18(*c*) are explanatory views showing a printing state by the ink jet printer having more than one diameter of the ink drop, FIG. 18(*a*) showing print data of odd-numbered columns printed out by the back ink nozzles, FIG. 18(*b*) showing print data of even-numbered columns printed out by the front ink nozzles, FIG. 18(*c*) showing a state when print of odd-numbered columns and print of even-numbered columns are superimposed one on the other.
Figure 18:
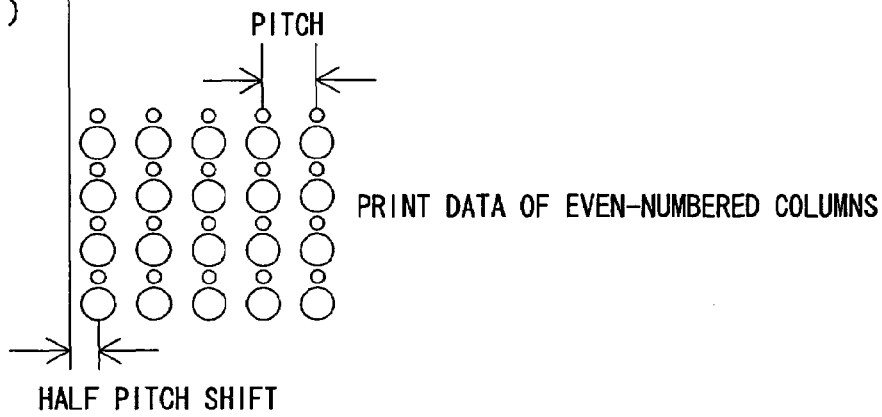
Figure 18:
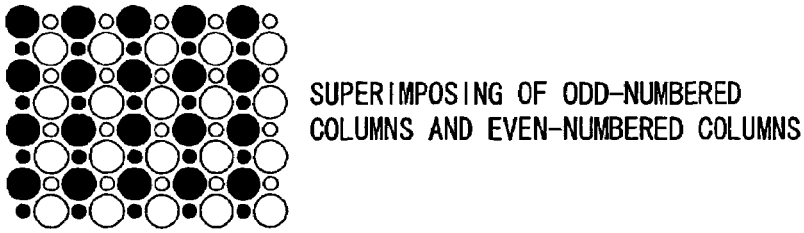

When the printing is effected by such an ink drop alignment, as shown in FIG. 18(*a*), print data in the odd-numbered columns are printed out by the back ink nozzles 4*b* of the back ink head 7. Here, in case of the back ink head 7 shown in FIG. 17(*b*), the print data to be printed out from top to bottom on the recording paper 2 is assigned to the back ink nozzles 7*b* from bottom to top, and therefore, in FIG. 18(*a*), the print is upside down.

Then, as shown in FIG. 18(*b*), print data of the even-numbered columns is printed out by the front ink nozzles 4*a* by the front ink head 6. By superimposing the printing of the odd-numbered columns and the printing of the even-numbered columns, spaces between dots of a larger diameter are filled with dots of a smaller diameter as shown in FIG. 18(C), there by making it possible to obtain the print data at high resolution and density.

As has been discussed, according to the ink jet printer of the present embodiment, the ink holes of the back ink nozzles 4*b* and those of the front ink nozzles 4*a* facing their respective directions along the transportation direction of the recording paper 2 are shifted by half the pitch with respect to each other as to the intervals in the running direction along the supporting axis 1. Also, for example, the diameter of the ink drops from the back ink nozzles 4*b* may be changed in order of large and small in alternation, and the diameter of the ink drops from the front ink nozzles 4*a* may be changed in order of small and large in alternation.

According to the above arrangement, after the first printing by the back ink nozzles 4*b* is completed, the second printing by the front ink nozzles 4*a* is effected in such a manner that it is shifted by half the pitch in the scanning direction and dot spaces in the first printing are filled with the front ink nozzles 4*a*. Consequently, the resolution in the running direction can be increased two times and the printing density can be increased.

In short, compared with a case where the printing is effected by one group of ink nozzles, the printing is effected without leaving dot spaces.

In the present embodiment, the print of the odd-numbered columns and the print of the even-numbered columns are superimposed with respect to the running direction. However, the arrangement is not limited to the foregoing, and the print made by the front ink nozzles 4*a* can be superimposed on the print made by the back ink head 7 in the sub-running direction, that is, in the transportation direction of the recording paper 2.

Figure 19:
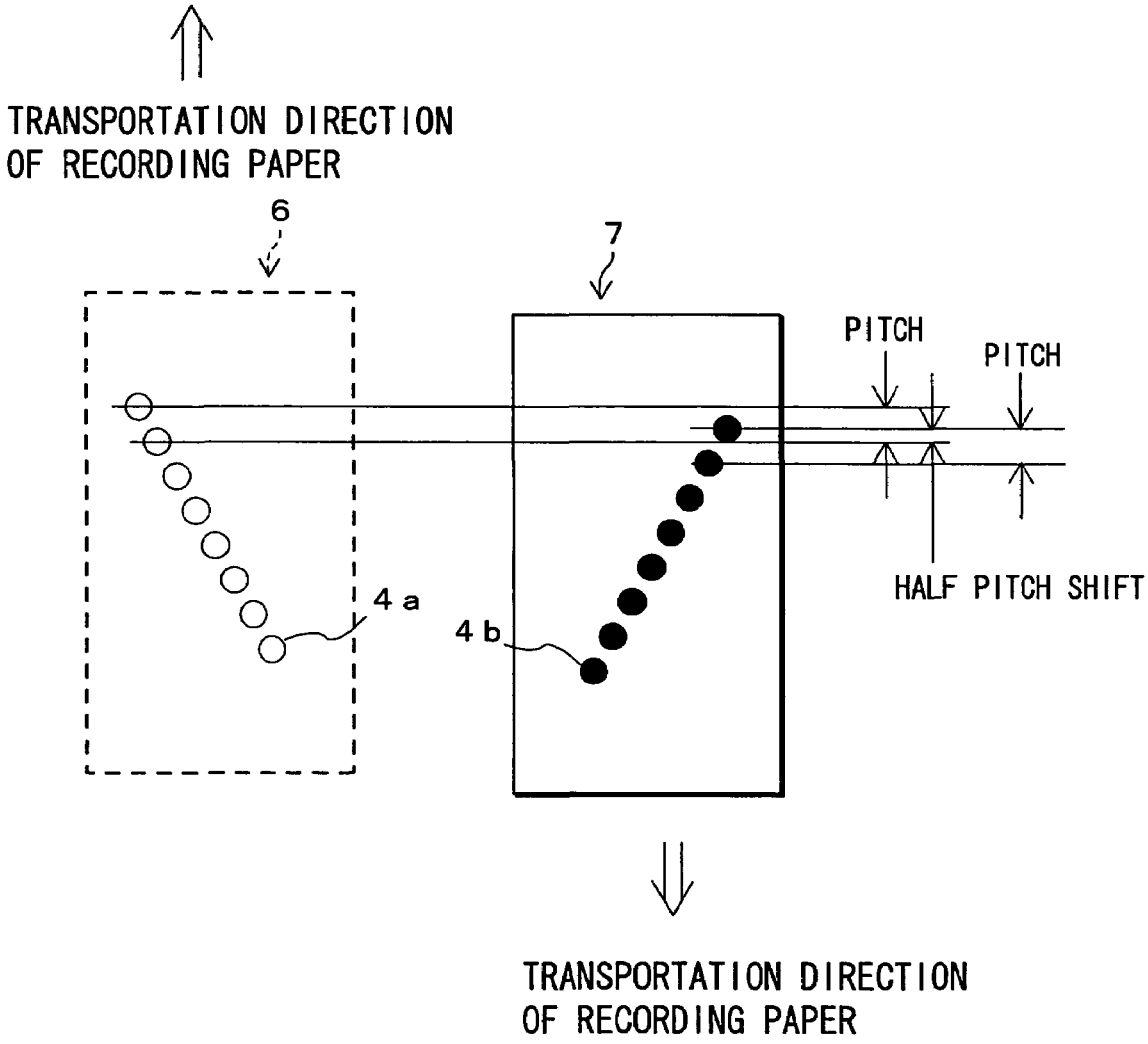
FIGS. 19(*a*) and 19(*b*) are explanatory views showing another modified example of the ink jet printer, FIG. 19(*a*) showing the front ink head seen from the back when the front ink nozzles are assigned with even-numbered rows, FIG. 19(*b*) showing the back ink head seen from the back when the back ink nozzles are assigned with odd-numbered rows.

To be more specific, as shown in FIGS. 19(*a*) and 19(*b*), the front ink nozzles 4*a* of the front ink head 6 are assigned to the odd-numbered rows, and the back ink nozzles 4*b* of the back ink head 7 are assigned to the even-numbered rows, and the dividing pitch is shifted by half the pitch with respect to the print resolution in the transportation direction of the recording paper 2.

Figure 20:
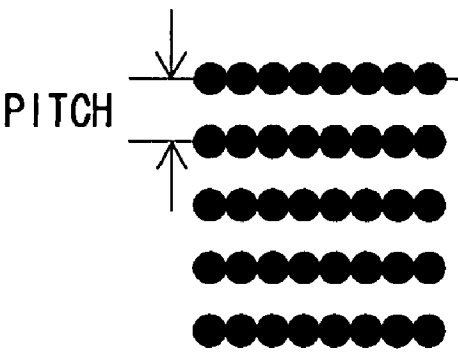
FIGS. 20(*a*) through 20(*c*) are explanatory views showing a printing state by the ink jet printer, FIG. 20(*a*) showing print data of odd-numbered rows printed out by the back ink nozzles, FIG. 20(*b*) showing print data of even-numbered rows printed out by the front ink nozzles, FIG. 20(*c*) showing a state when print of the odd-numbered rows and print of the even-numbered rows are superimposed one on the other.
Figure 20:
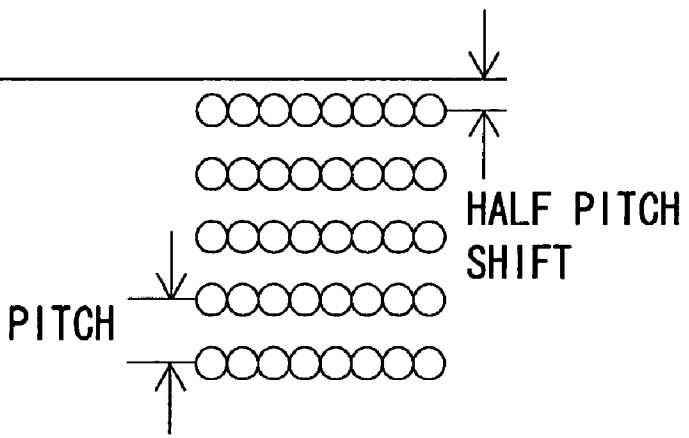
Figure 20:
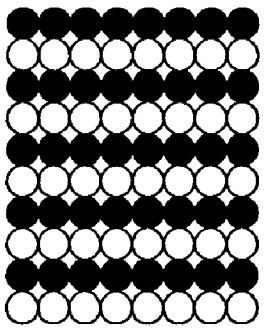

When the printing is effected with the foregoing nozzle assignment, as shown in FIG. 20(*a*), print data of the odd-numbered rows is printed out by the back ink nozzles 4*b*, and then, as shown in FIG. 20(*b*), print data of the even-numbered rows is printed out by the front ink nozzles 4*a*. Accordingly, the print of the odd-numbered rows and the print of the even-numbered rows are superimposed one on the other, and as shown in FIG. 20(*c*), print data with its resolution increased twice in the sub-running direction can be obtained.

As has been discussed, in the ink jet printer of the present embodiment, each group of the back ink nozzles 4*b* and front ink nozzles 4*a* facing their respective directions along the transportation direction of the recording paper 2 includes a plurality of ink holes aligned in a line slanted with respect to the running direction along the supporting axis 1 and the transportation direction of the recording paper 2 for the respective colors. Also, the ink holes of the back ink nozzles 4*b* and those of the front ink nozzles 4*a* of the same color are shifted by half the pitch with respect to each other as to the interval in the transportation direction of the recording paper 2.

Hence, the first printing is effected by the back ink nozzles 4*b* facing one direction, and the second printing is effected by the front ink nozzles 4*a* facing another direction by shifting the intervals in the transportation direction of the recording paper 2 half the pitch, so that the second print is superimposed on the first print. Accordingly, resolution and printing density in the transportation direction of the recording paper 2 can be increased twice.

Consequently, an ink jet printer which can improve printing efficiency by improving printing resolution, etc. can be provided.

Also, as shown in FIGS. 21(*a*), 21(*b*), and 21(*c*), the front ink nozzles 4*a* of the front ink head 6 and the back ink nozzles 4*b* of the back ink head 7 may be assigned with the odd-numbered columns and rows, and even-numbered columns and rows, respectively.

In this case, half the pitch with respect to the printing resolution in the main running direction of the ink carriage 5 is given as the dividing pitch, while half the pitch with respect to the printing resolution in the transportation direction of the recording paper 2 is also given as the dividing pitch.

Figure 22:
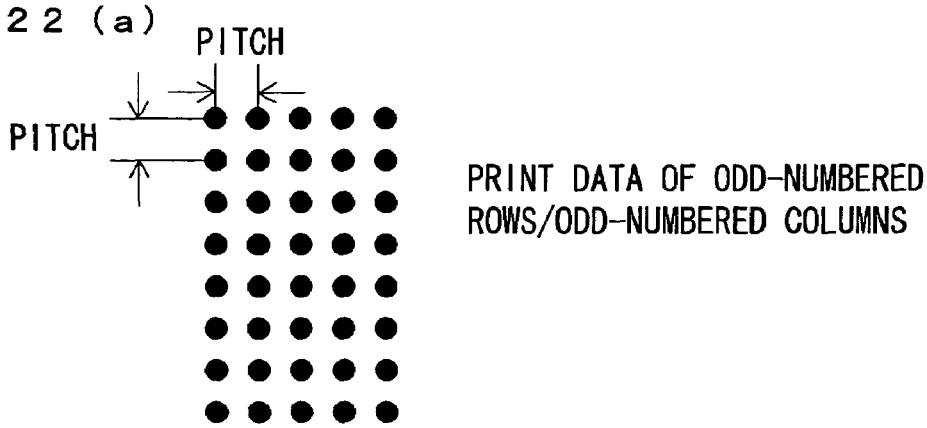
FIGS. 22(*a*) through 22(*c*) are explanatory views showing a printing state by the ink jet printer, FIG. 22(*a*) showing print data of odd-numbered rows and columns printed out by the back ink nozzles, FIG. 22(*b*) showing print data of even-numbered rows and columns printed out by the front ink nozzles, FIG. 22(*c*) showing a state when print of the odd-numbered rows and columns and print of the even-numbered rows and columns are superimposed one on the other.
Figure 22:
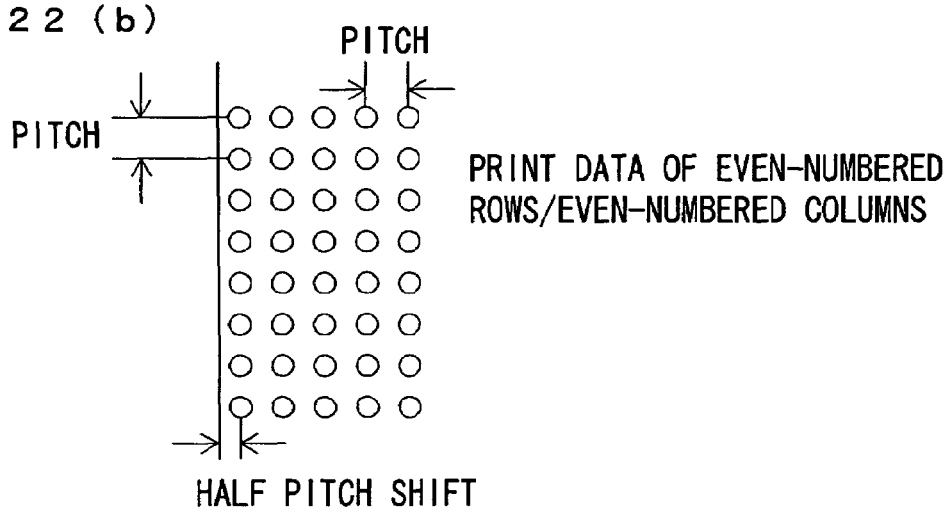
Figure 22:
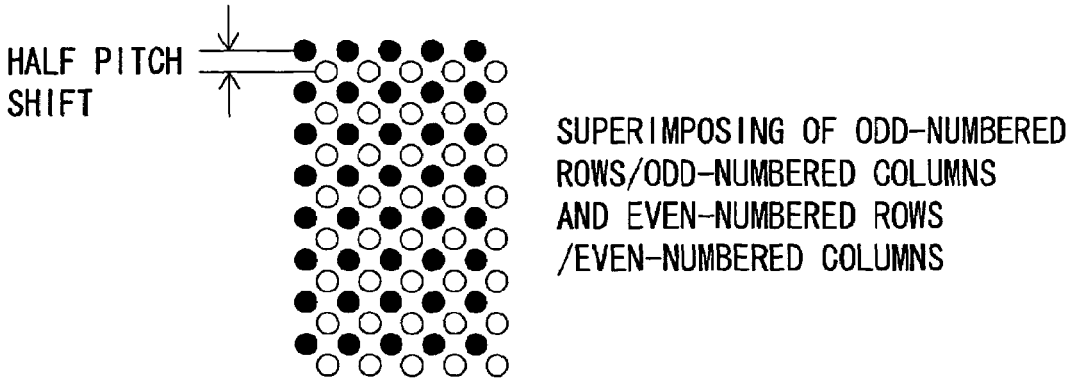

When the printing is effected with such a nozzle assignment, as shown in FIG. 22(*a*), a matrix (odd number matrix) composed of the odd-numbered columns and rows is printed out by the back ink nozzles 4*b* first, and thence, as shown in FIG. 22(*b*), a matrix (even number matrix) composed of the even-numbered columns and rows is printed out by the front ink nozzles 4*a*. Consequently, the even number matrix is superimposed on the odd number matrix, and as shown in FIG. 22(*c*), print data with resolution and density increased twice both in the main running direction and sub-running direction can be obtained.

As has been discussed, according to the ink jet printer of the present embodiment, each group of the back ink nozzles 4*b* and front ink nozzles 4*a* facing their respective directions along the transportation direction of the recording paper 2 includes a plurality of ink holes aligned in a line slanted with respect to the running direction along the supporting axis 1 and the transportation direction of the recording paper 2 for the respective colors. In addition, the plurality of ink nozzle holes aligned for each color in each group of the back ink nozzles 4*b* and front ink nozzles 4*a* facing their respective directions are shifted with respect to each other by half the pitch as to the intervals in the running direction along the supporting axis 1 and the transportation direction of the recording paper 2.

Hence, by effecting the first printing by the back ink nozzles 4*b* facing one direction, and the second printing by the front ink nozzles facing another direction by shifting the intervals both in the scanning direction along the supporting axis 1 and the intervals in the transportation direction of the recording paper 2 so as to be superimposed on the print made by the first printing, the resolution and printing density both in the scanning direction along the supporting axis 1 and the intervals in the transportation direction of the recording paper 2 can be increased-twice.

Consequently, an ink jet printer which can improve printing efficiency by improving printing resolution, etc. can be provided.

Further, the diameter of the ink drop is the same in the above embodiment, but the diameter can be changed.

More specifically, as shown in FIGS. 23(*a*), 23(*b*), and 23(*c*), the front ink nozzles 4*a* of the front ink head 6 and the back ink nozzles 4*b* of the back ink head 7 are assigned to the printing of odd-numbered columns and row, and the printing of the even-numbered columns and rows, respectively. Also, the dividing pitches are shifted to each other by half the pitch for the printing resolution both in the main running direction of the ink carriage 5 and the transportation direction of the recording paper 2, that is, the sub-running direction.

The diameter of the ink drop for the back ink nozzles 4*b* that print out the odd-numbered columns and rows is made smaller than the diameter of the ink drop for the front ink nozzles 4*a* that print out the even-numbered columns and rows.

Figure 24:
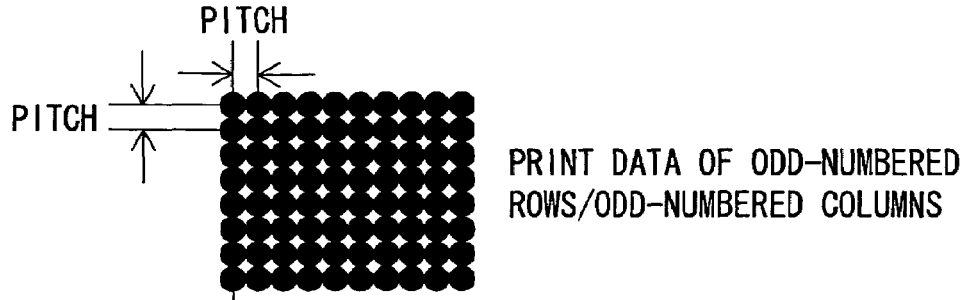
FIGS. 24(*a*) through 24(*c*) are explanatory views showing a printing state by the ink jet printer, FIG. 24(*a*) showing print data of odd-numbered rows and columns printed out by the back ink nozzles with the ink drop of the larger diameter, FIG. 24(*b*) showing print data of even-numbered rows and columns printed out by the front ink nozzles with the ink drop of the smaller diameter, FIG. 24(*c*) showing a state when print of the odd-numbered rows and columns and print of the even-numbered rows and columns are superimposed one on the other.
Figure 24:
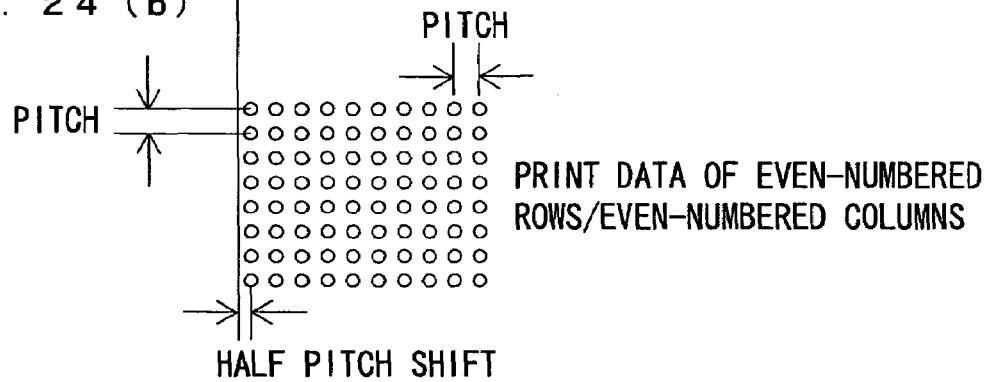
Figure 24:
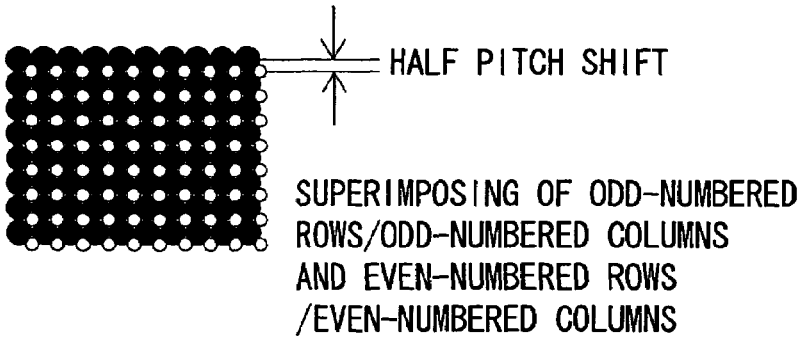

When the printing is effected with such a nozzle assignment, as shown in FIG. 24(*a*), a matrix of the odd-numbered rows columns (odd number matrix) is printed out by the back ink nozzles 4*b* first, and then, as shown in FIG. 24(*b*), a matrix of the even-numbered rows and columns (even number matrix) is printed out by the front ink nozzles 4*a*. Accordingly, the even number matrix is superimposed on the odd number matrix, and as shown in FIG. 24(*c*), spaces among the larger dots are filled with the smaller dots both in the main running direction and sub-running direction, thereby making it possible to obtain print data at higher resolution and higher density.

As has been discussed, according to the ink jet printer of the present embodiment, each group of the back ink nozzles 4*b* and front ink nozzles 4*a* facing their respective directions along the transportation direction of the recording paper 2 includes a plurality of ink holes aligned in a line slanted with respect to the running direction along the supporting axis 1 and the transportation direction of the recording paper 2 for the respective colors. In addition, the plurality of ink nozzle holes aligned for each color in each of the groups of back ink nozzles 4*b* and front ink nozzles 4*a* facing their respective directions are shifted with respect to each other by half the pitch as to the intervals in the scanning direction along the supporting axis 1 and the transportation direction of the recording paper 2.

Further, for example, the larger diameter is given to the ink drop directed from the back ink nozzles 4*b* and the smaller diameter is given to the ink drop directed from the front ink nozzles 4*a*.

Hence, by effecting the first printing by the back ink nozzles 4*b* facing one direction, and the second printing by the front ink nozzles 4*a* facing another direction by shifting the intervals both in the scanning direction along the supporting axis 1 and in the transportation direction of the recording paper 2 so as to superimpose on the print made by the first printing, the resolution and printing density both in the scanning direction along the supporting axis 1 and the intervals in the transportation direction of the recording paper 2 can be increased twice.

In addition, by superimposing the first print and second print so as to fill the spaces among dots on the first print, the resolution and density can be increased both in the running direction and paper transportation direction.

Consequently, there can be provided an ink jet printer which can improve printing efficiency by improving printing resolution, etc.

(Embodiment 4)

Figure 25A:
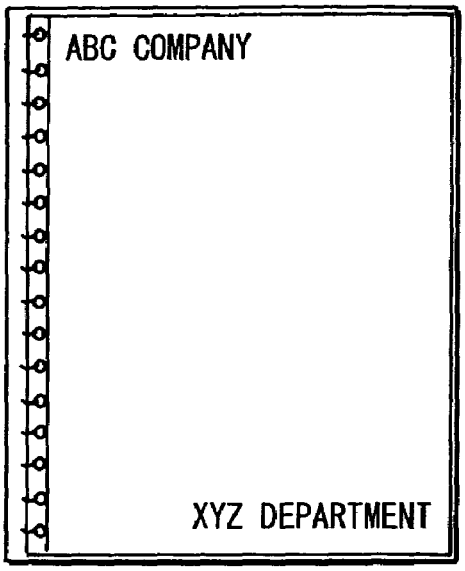
FIGS. 25(*a*) through 25(*c*) are explanatory views showing an ink jet printer in accordance with still another embodiment of the present invention, by which a watermark and print data are superimposed and printed out on the same recording paper, FIG. 25(*a*) showing a water mark, FIG. 25(*b*) showing print data, FIG. 25(*c*) showing resulting print when the watermark and print data are superimposed.
Figure 25B:
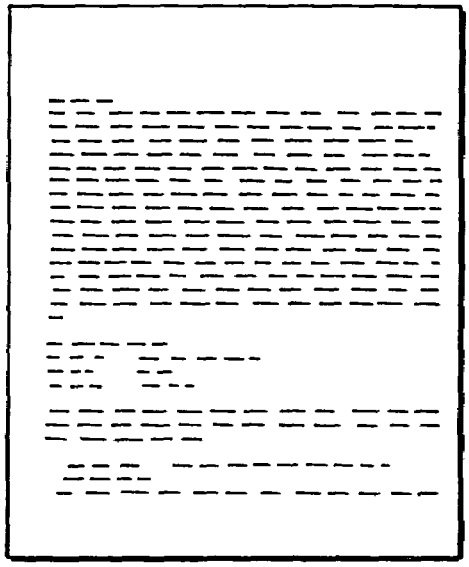
Figure 25C:
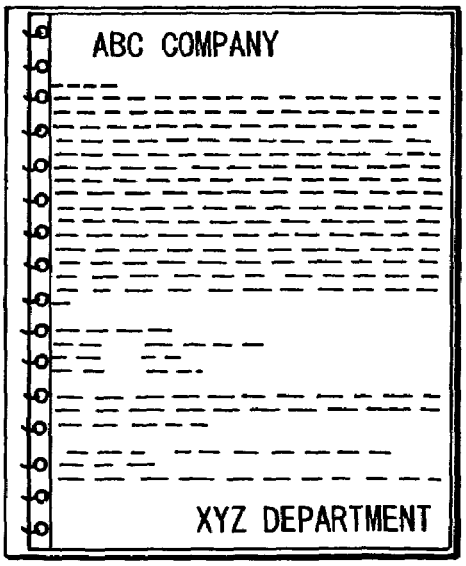
Figure 26:
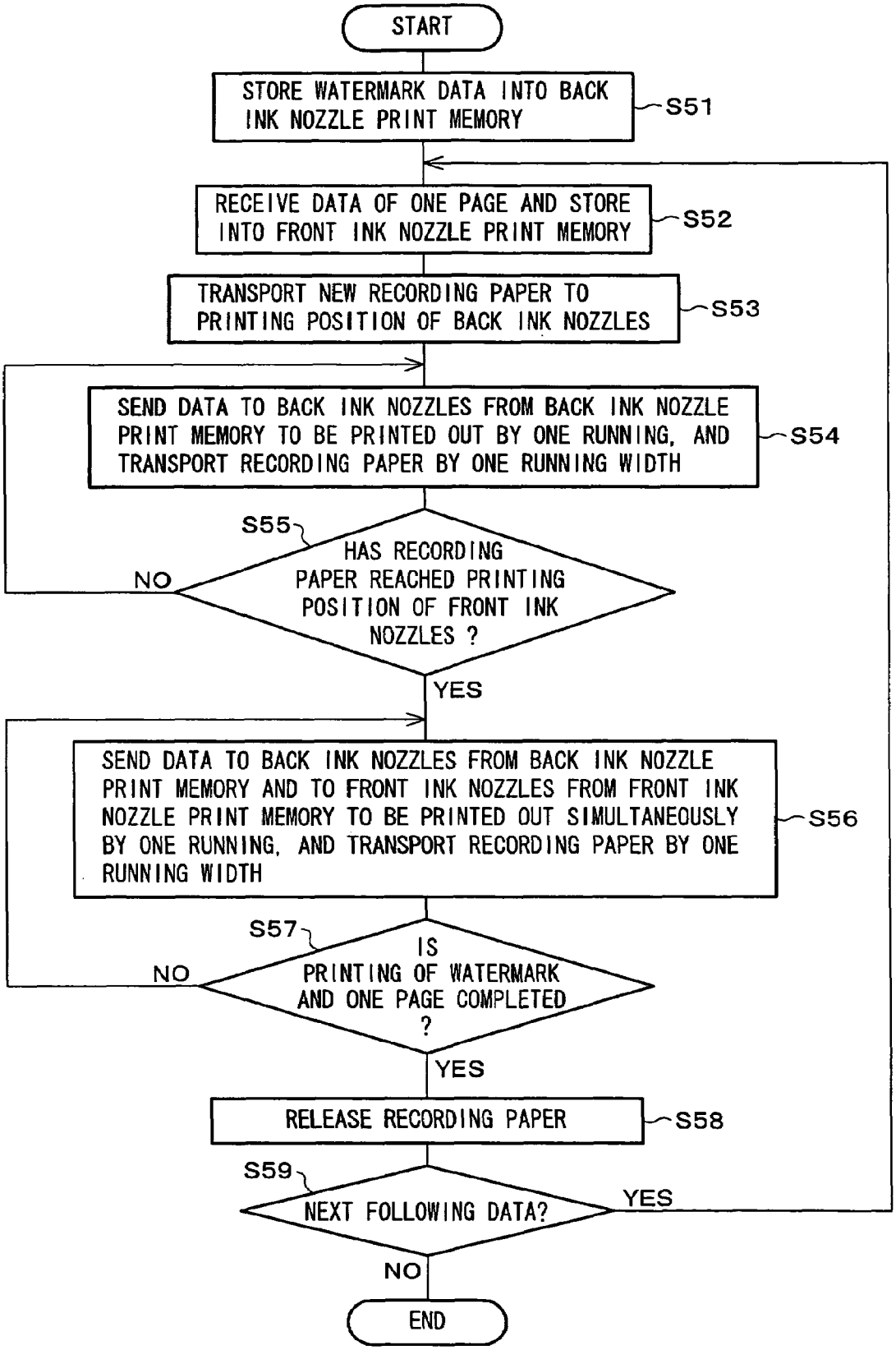
FIG. 26 is a flowchart detailing a control operation when the watermark and print data are superimposed and printed out on the same recording paper.

Referring to FIGS. 25 and 26, the following description will describe still another embodiment of the present invention. Hereinafter, like components are labeled with like reference numerals with respect to Embodiments 1–3, and the description of these components is not repeated for ease of explanation.

According to an ink jet printer of the present embodiment, a watermark is printed out on one recording paper 2 as first print data by the back ink nozzles 4*b*, one of the two groups of ink nozzles provided on the ink carriage and facing their respective directions, and print data as second print data is printed out by the front ink nozzles 4*a* so as to be superimposed on the print made by the back ink nozzles 4*b*. Consequently, printing with a watermark can be effected without running an superimposing job of the water mark and print data by a personal computer or the like. In short, image information can be printed out over a repetitive format, such as a logo.

As shown in FIG. 25(*a*), the ink jet printer prints out the watermark alone by the back ink nozzles 4*b*, while as shown in FIG. 25(*b*), document data is printed out by the front ink nozzles 4*a*. Consequently, as shown in FIG. 25(*c*), by printing out the latter on the former, the document data can be printed out over the repetitive format, such as a logo.

Once the watermark data sent from the personal computer is stored, it is no longer necessary to download the data for each time the watermark is printed out.

Consequently, the printing time can be shortened and the cost can be decreased.

The print control operation by the ink jet printer will be explained with reference to the flowchart of FIG. 26.

Initially, the watermark data is stored in the back ink nozzle print memory (S51). Then, the ink jet printer receives data of one page, which is stored in the front ink nozzle print memory (S52). Then, a new recording paper 2 is transported to the printing position of the back ink nozzles 4*b* (S53), and the data is sent to the back ink nozzles 4*b* from the back ink nozzle print memory, after which the printing is effected by one running and the recording paper 2 is transported further by one running width (S54).

Then, whether the recording paper 2 has reached the printing position of the front ink nozzles 4*a* or not is checked (S55). If not, the flow returns to S54 and S54–S55 are repeated until the recording paper 2 reaches the printing position of the front ink nozzles 4*a*.

When it is judged in S55 that the recording paper 2 has reached the printing position of the front ink nozzles 4*a*, the data is sent to the back ink nozzles 4*b* from the back ink nozzles print memory while at the same time the data is sent to the front ink nozzles 4*a* from the front ink nozzles print memory, after which the printing is effected for one running and the recording paper 2 is transported further by one running width (S56).

Then, whether the watermark and the data of one page have been printed out or not is judged (S57). If not, the flow returns to S56 and S56–S57 is repeated until the printing for one page is completed.

When it is judged in S57 that the data of one page is completed, the recording paper 2 is released (S58).

Then, whether there is any following data or not is judged (S59), and if there is no following data, the job is completed. Otherwise, the flow returns to S52 and S52–S59 are repeated.

By carrying out the above procedure, the printing time can be shortened and the cost can be saved.

As has been discussed, according to the ink jet printer of the present embodiment, the first print data, such as a watermark, is printed out by the back ink nozzles 4*b*, one of the two groups of ink nozzles facing their respective directions, while the second print data of a different kind from the first print data, such as text information, is printed out by the other front ink nozzles 4*a*.

In other words, the first print data, such as a watermark, is printed out on one recording paper 2 by the back ink nozzles 4*b*, one of the two groups of ink nozzles facing their respective directions, and then the second print data, such as text information, is printed out by the other front ink nozzles 4*a* on the same recording paper.

Consequently, mixed recording information can be printed out simultaneously by transporting the recording paper 2 once. In other words, image data can be printed out with appended data.

Consequently, there can be provided an ink jet printer which can improve a printing efficiency by accelerating the printing time including the paper transporting time and realizing simultaneously printing of mixed information.

In addition, in the present embodiment, the image information is printed out by using either the back ink nozzles 4*b* or front ink nozzles 4*a* only when a print request is issued.

Consequently, the image information can be printed out by using one of the back ink nozzles 4*b* and front ink nozzles 4*a* at a print request, while at the same time, for example, printing out appended information by the other ink nozzles.

In addition, in the present embodiment, appended information can be printed out by the other ink nozzles, for example.

Consequently, the print data at request and appended information can be printed out in a reliable manner on the same recording paper 2 by transporting the same once.

In addition, in the present embodiment, the appended information can be a particular format, a logo, a ruled line, etc.

Accordingly, the data at request can be printed out together with appended data including repetitive information, such as a particular format, a model, a ruled line, a corporation name, an organization name, the address and telephone number, etc., and logos, such as "TOP SECRET", "SECRET", "CONFIDENTIAL", "COPY", etc.

In addition, in the present embodiment, the appended information can be downloaded from the personal computer to the memory of the ink jet printer, so that it can be read out from that memory when printed out thereafter.

Consequently, when the same appended information is printed out more than once, the appended information is downloaded to the memory of the ink jet printer from the personal computer to be held therein. Thus, the appended information does not have to be downloaded each time it is printed on the recording paper 2.

In addition, by printing out the appended information by reading the same from the memory in the ink jet printer, a volume of transmission data from the personal computer to the ink jet printer can be reduced, thereby making it possible to shorten the transmission time and hence the printing time.

(Embodiment 5)

Referring to FIGS. 27 through 37, the following description will describe still another embodiment of the present invention. Hereinafter, like components are labeled with like reference numerals with respect to Embodiments 1–4, and the description of these components is not repeated for ease of explanation.

An ink jet printer of the present embodiment is an ink jet printer having two groups of ink nozzles for one ink tank and provided with mechanism that realizes switchback of one recording paper between the two groups of ink nozzles, whereby printing is effected on both the front and back surfaces of the recording paper by the two groups of ink nozzles, respectively.

Figure 27:
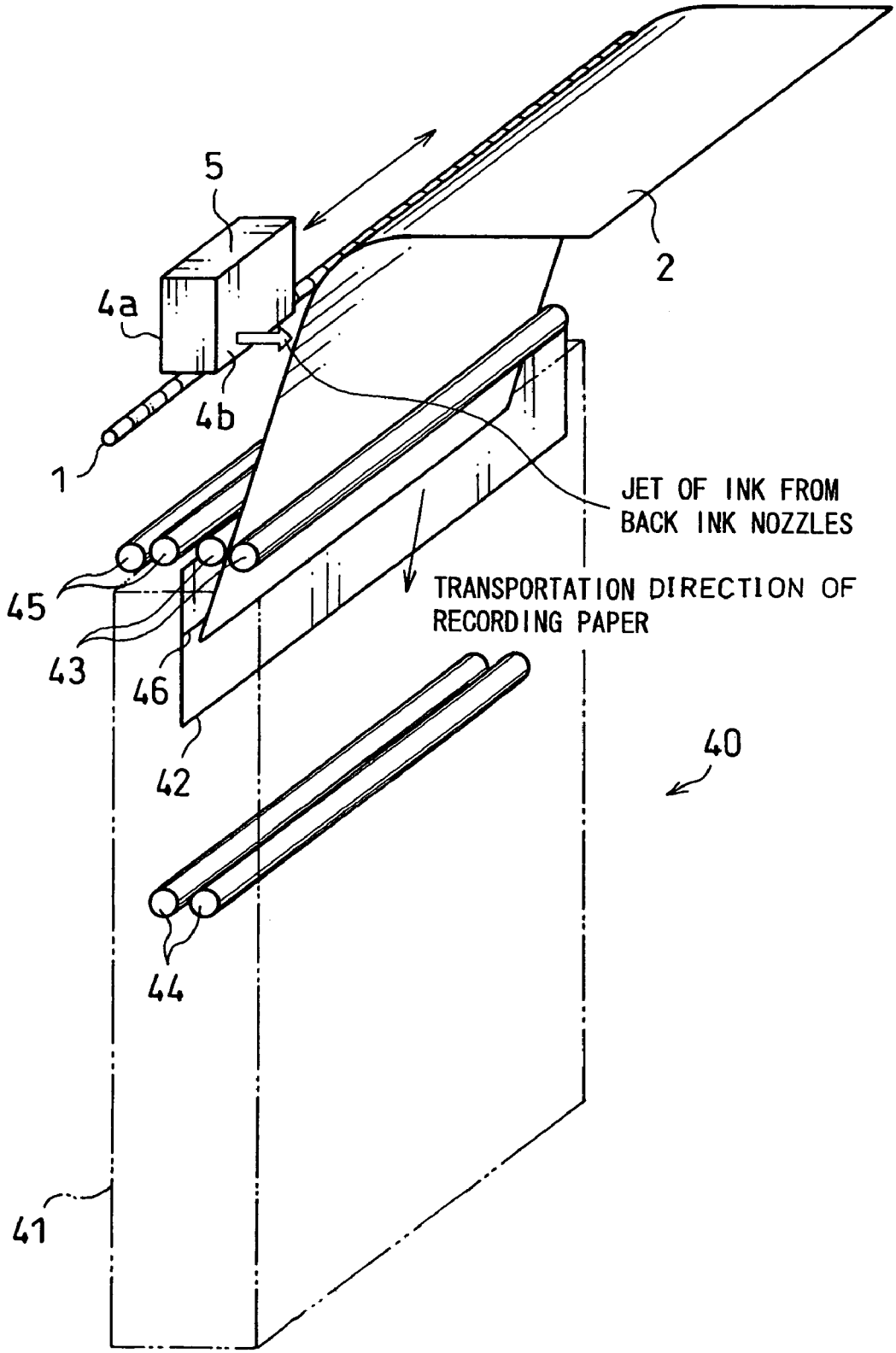
FIG. 27 is a perspective view showing an arrangement of a switchback path mechanism provided in an ink jet printer in accordance with still another embodiment of the present invention.

In other words, according to the ink jet printer of the present embodiment, as shown in FIG. 27, a switchback path mechanism 40 as paper reversing means for realizing the double-side printing of the recording paper 2 is provided below the ink carriage 5.

The switchback path mechanism 40 comprises a pair of back ink nozzle rollers 43 and a pair of front ink nozzles rollers 45 provided below the ink carriage 5 for transporting the recording paper 2, a paper guide 42 extending downward somewhere between the pair of back ink nozzle rollers 43, and the pair of the front ink nozzle rollers 45, a pair of paper direction switching rollers 44 provided below the paper guide 42 and capable of rotating in either direction, and a switchback case 41.

The pair of the back ink nozzle rollers 43 are rollers to transport the recording paper 2 to the switchback case 41 after print is made on the front surface thereof by the back ink nozzles 4*b*. Thus, the pair of the front ink nozzle rollers 43 is provided below the ink carriage 5 on the side where the back ink nozzles 4*b* are provided.

In addition, the pair of front ink nozzle rollers 45 are the rollers that transport the recording paper 2 toward the front ink nozzles 4*a*, so that print will be made on the back surface of the recording paper 2 on which print has been made by the back ink nozzles 4*b* at the front surface. Thus, the pair of front ink nozzle rollers 45 are provided below the ink carriage 5 on the side where the front ink nozzles 4*a* are provided, so that the recording paper 2 transported from the paper guide 42 is transported further to the front ink nozzles 4*a*.

Figure 28:
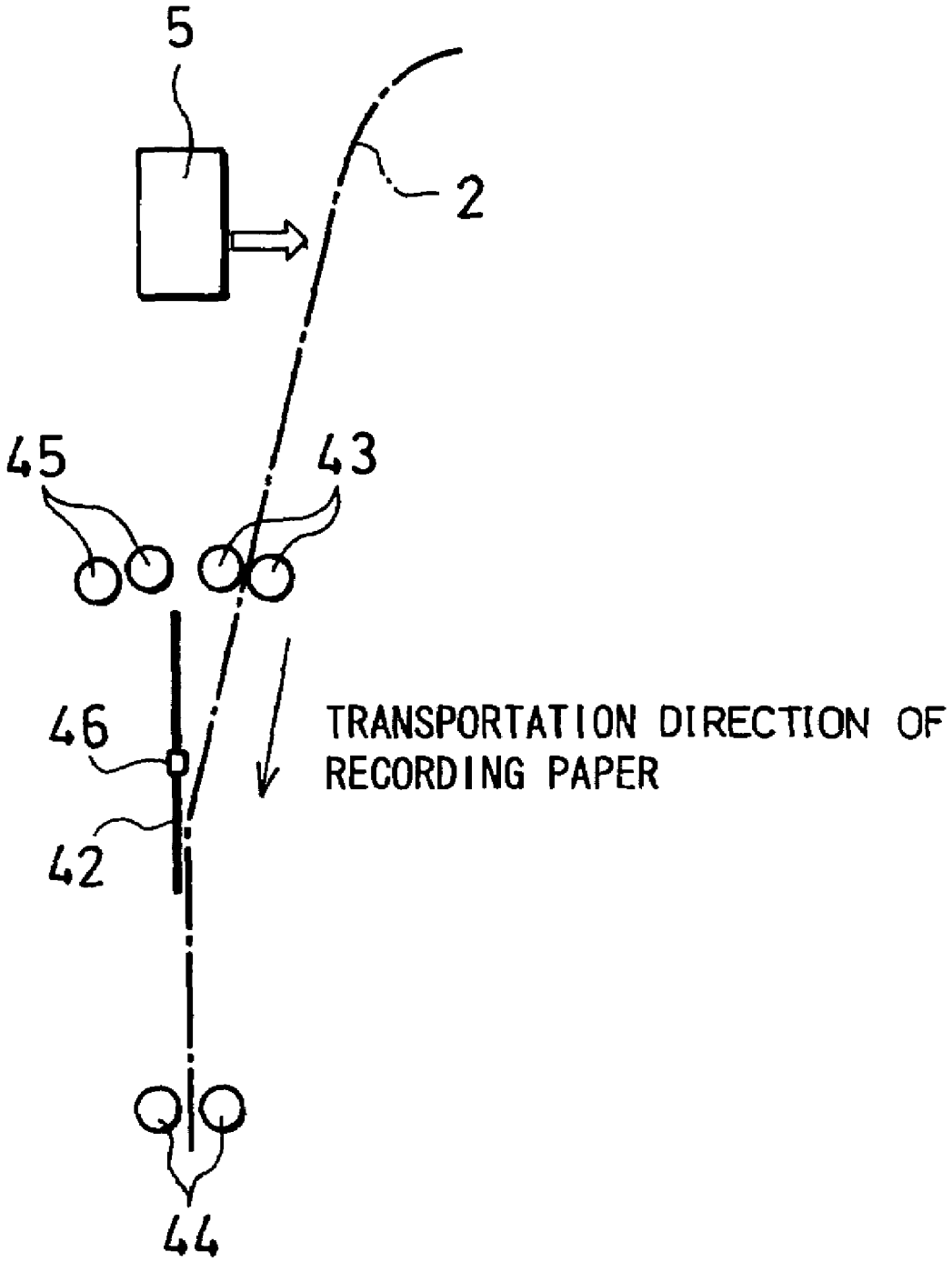
FIG. 28 is an explanatory view showing a transportation path, through which a recording paper is transported after print is made thereon by the back ink nozzles so as to be stored in a switchback case in the ink jet printer provided with the switchback path mechanism.

On the other hand, as shown in FIG. 28, the paper guide 42 is provided with a paper guide rotating axis 46 at substantially the middle in the vertical direction, so that the paper guide 42 is allowed to rotate around the paper guide rotating axis 46 by an unillustrated solenoid or the like.

Figure 29:
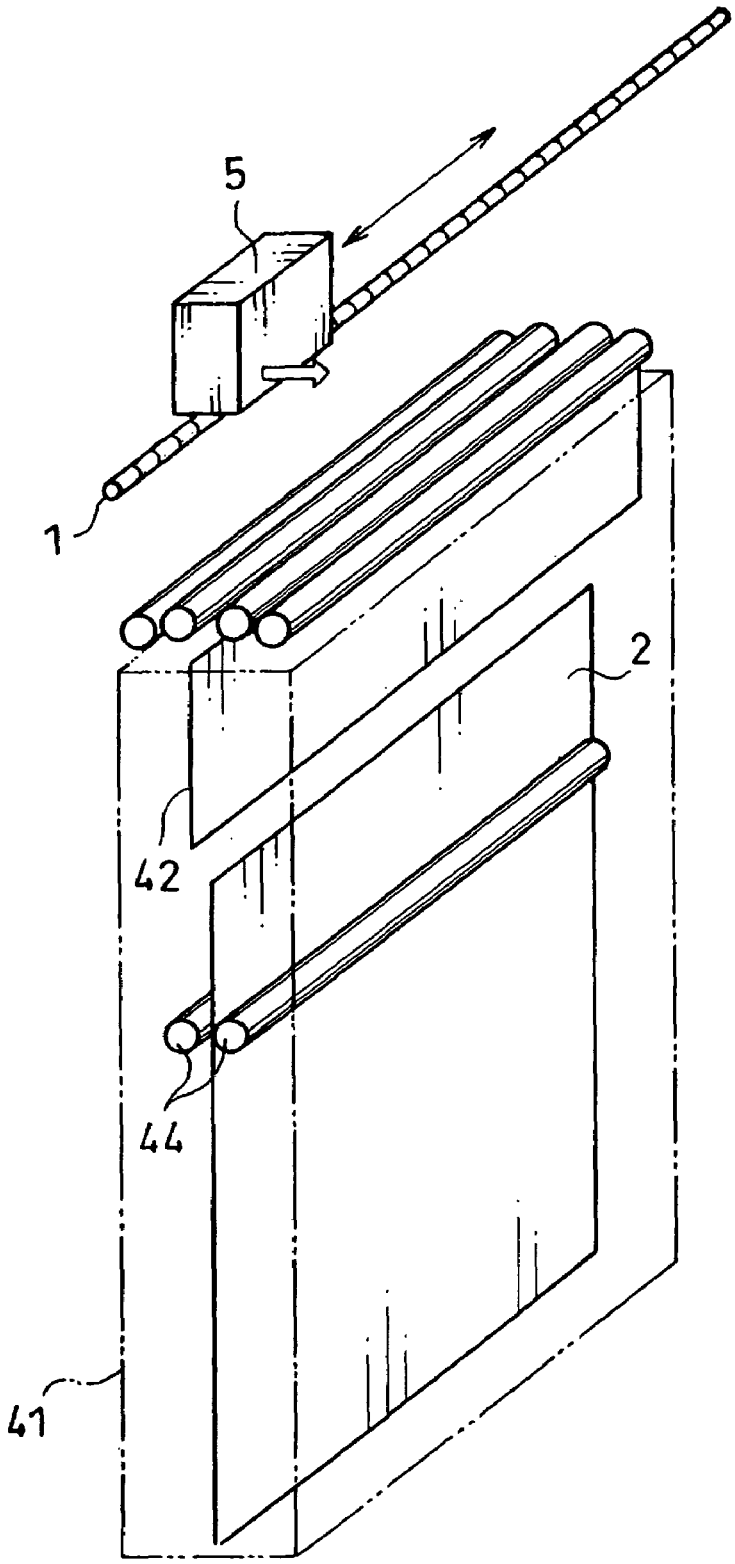
FIG. 29 is a perspective view showing a state of the recording paper stored in the switchback case in the ink jet printer provided with the switchback path mechanism.

Thus, the recording paper 2 having passed through a space between the pair of the back ink nozzle rollers 43 is transported to the pair of paper direction switching rollers 44 with its top end sliding along the paper guide 42, whereby, as shown in FIG. 29, the recording paper standing upright is stored in the switchback case 41.

Figure 30:
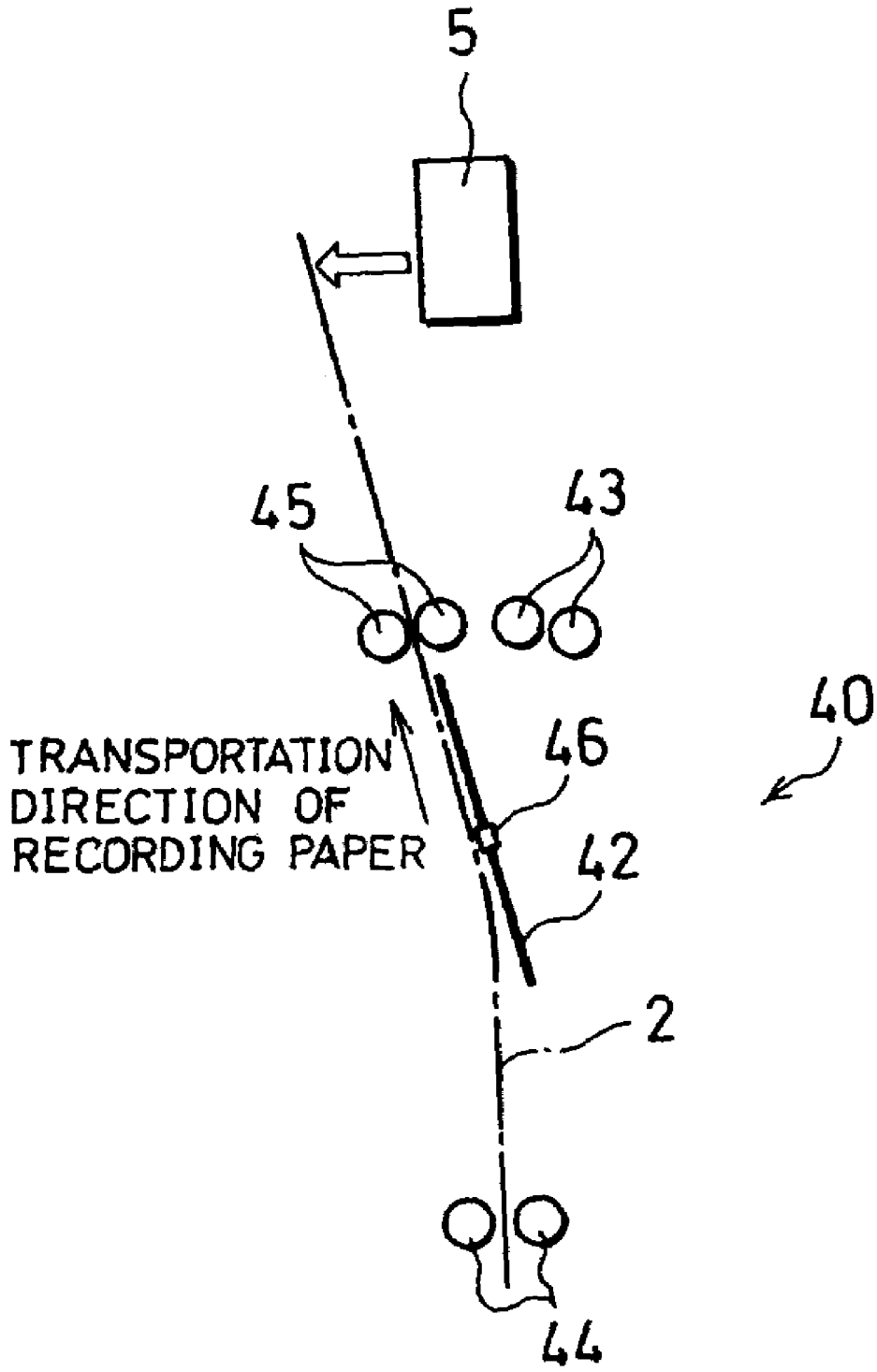
FIG. 30 is an explanatory view showing a transportation path from the switchback case to the front ink nozzle position in the ink jet printer provided with the switchback path mechanism.

Then, when the printing is effected by the front ink nozzles 4*a* on the back surface of the recording paper 2, the paper guide 42 is tilted toward the pair of front ink nozzle rollers 45 with respect to the paper guide rotating axis 46 as shown in FIG. 30.

Subsequently, the recording paper 2 stored in the switchback case 41 is moved vertically by rotating the pair of paper direction switching rollers 44 in a reverse direction. Then, the latter end of the recording paper 2, that is, the top end of the recording paper 2 in the transportation direction is guided as it slides along the paper guide 42. Hence, the recording paper 2 passes by a space between the pair of front ink nozzle rollers 45 to reach the printing position of the front ink nozzles 4*a*, whereupon the printing is effected on the back surface of the recording paper 2 by the front ink nozzles 4*a*.

In this case, the characters printed out by the back ink nozzles 4*b* and those printed out by the front ink nozzles 4*a* are upside down with each other. However, this can be prevented by using an adequate software program.

Figure 31:
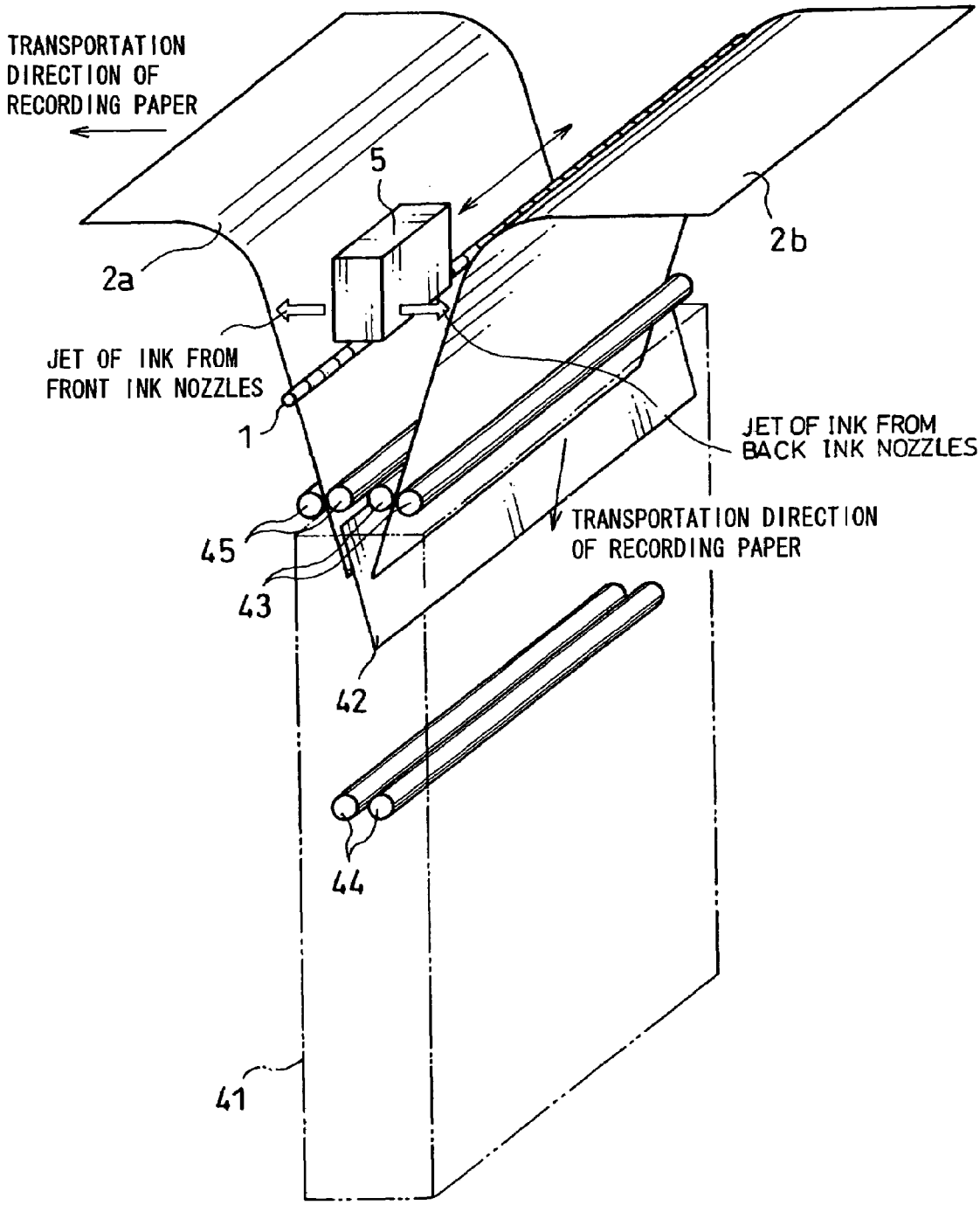
FIG. 31 is a perspective view showing a state when the double-side printing is effected simultaneously on a plurality of recording papers by the ink jet printer provided with the switchback path mechanism.

Here, as shown in FIG. 31, the switchback path mechanism 40 is arranged in such a manner that, when the print data is printed out on the both sides of more than one recording paper 2, the printing can be effected simultaneously on the back surface of the first recording paper 2*a* and the front surface of the second recording paper 2*b* by the two groups of ink nozzles 4*a* and 4*b*, respectively.

In other words, when data of more than one page is printed out, the printing is effected on the second recording paper 2*b* by the back ink nozzles 4*b* and on the first recording paper 2*a* by the front ink nozzles 4*a* simultaneously, thereby making it possible to increase the printing rate.

Figure 32:
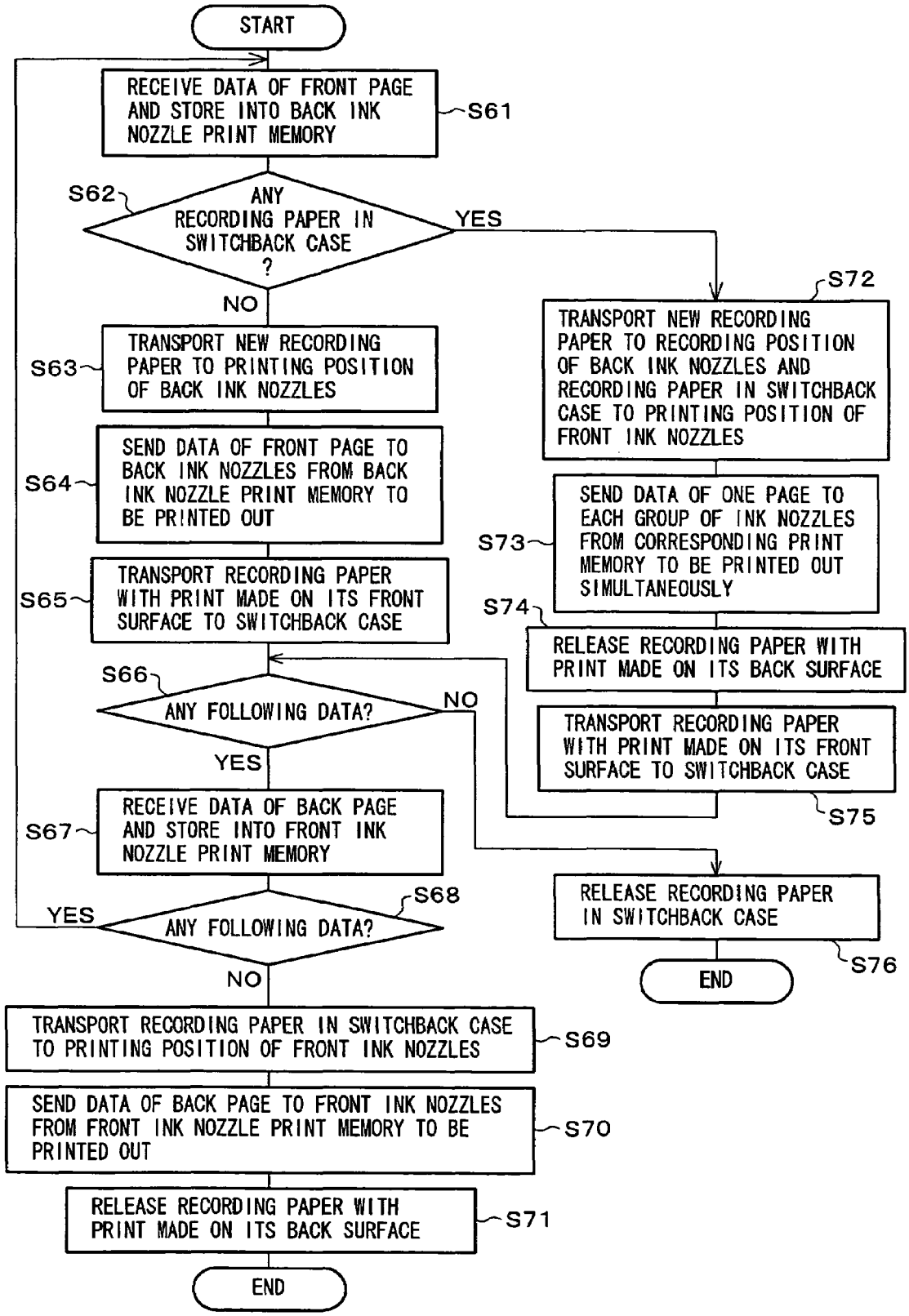
FIG. 32 is a flowchart detailing a control operation when the double-side printing is effected simultaneously on a plurality of recording papers by the ink jet printer provided with the switchback path mechanism.

The double-side printing operation of the above-arranged ink jet printer will be explained with reference to the flowchart of FIG. 32.

Initially, the ink jet printer receives data of one page, and stores the same in the back ink nozzle print memory (S61). Then, whether there is any recording paper 2 in the switchback case 41 or not is judged (S62). If not, a new recording paper 2 is transported to the printing position of the back ink nozzles 4*b* (S63).

Then, the data is sent to the back ink nozzles 4*b* from the back ink nozzle print memory to be printed out on the front surface of the recording paper 2 (S64).

Subsequently, the recording paper 2 is transported into the switchback case 41 after print is made on the front surface thereof (S65).

Then, whether there is any following data or not is judged (S66), and if not, the recording paper 2 in the switchback case 41 is released (S76).

On the other hand, when there is data of the following page, the ink jet printer receives data of one page of the back surface and stores the same in the front ink nozzle memory (S67).

Then, whether there is any following data or not is judged (S68), and if not, the recording paper 2 in the switchback case 41 is transported to the printing position of the front ink nozzles 4*a* (S69). Subsequently, the data is sent to the front ink nozzles 4*a* from the front ink nozzle print memory, and the data is printed out on the back surface of the recording paper 2 (S70). When the printing on the back surface of the recording paper 2 ends, the recording paper 2 is released (S71).

When it is judged in S68 that there is following data, the flow returns to S61, and the ink jet printer receives the data of one page for the front surface, and stores the same in the back ink nozzle print memory. Then, whether there is any recording paper 2 in the switchback case 41 or not is judged in S62.

In this case, because the recording paper 2 is in the switchback case 41, a new recording paper 2 is transported to the printing position of the back ink nozzles 4*b*, while at the same time the recording paper 2 in the switchback case 41 is transported to the printing position of the front ink nozzles 4*a* (S72).

Then, the data is sent to the front ink nozzles 4*a* and 4*b* separately from their respective print memories, after which data of one page is printed out simultaneously by each group of ink nozzles 4*a* and 4*b* (S73).

Subsequently, when the printing on the back surface of the recording paper 2 is completed, the recording paper 2 is released (S74). Also, the following recording paper 2 is transported to the switchback case 41 after print is made thereon at the front surface (S75).

Then, the flow moves to S66, where whether there is any data of a following page or not is judged, and when there is data, S66–S71 and S61–S62, and S72–S75 are repeated.

By the above procedure, the double-side printing on more than one recording paper 2 can be effected in a shorter time.

As has been discussed, according to the ink jet printer of the present embodiment, the switchback path mechanism 40 for reversing the surface of the recording paper 2 is provided on the transportation path of the recording paper 2 somewhere between the back ink nozzles 4*b* and front ink nozzles 4*a* facing their respective directions.

Thus, the double-side printing can be effected by effecting the printing on the front surface of the recording paper 2 by the back ink nozzles 4*b*, one of the two groups of ink nozzles facing their respective directions, then turning over the recording paper 2 by the switchback path mechanism 40, and effecting the printing on the back surface of the recording paper 2 by the other front ink nozzles 4*a*.

In addition, the mechanism for the double-side printing effects the printing on the recording paper 2 by using the back ink nozzles 4*b* and front ink nozzles 4*a* facing their respective directions while the recording paper 2 is transported through the single transportation path. Thus, the recording paper 2 only has to be turned over somewhere between the back ink nozzles 4*b* and front ink nozzles 4*a*. As a result, the switchback path mechanism can be simplified.

In addition, compared with a conventional case where the double-side printing is effected on the recording paper 2 by the ink nozzles facing only one direction, according to the present embodiment, the printing is effected on the front surface of the recording paper 2 by the back ink nozzles 4*b*, one of the two groups of ink nozzles facing their respective directions, while at the same time the printing is effected on the back surface of the preceding recording paper 2 by the other ink nozzles 4*a*. Consequently, when the double-side printing is effected on more than one recording paper 2, the time required for the double-side printing can be reduced to half the conventionally required time.

Consequently, there can be provided an ink jet printer which can improve printing efficiency by improving printing resolution, etc.

According to the switchback path mechanism 40 of the present embodiment, the paper guide 42 serving as a transportation changing guide is provided in the transportation path the recording paper 2 passes through after the printing is effected thereon by the back ink nozzles 4*b*, so that the transportation path is changed for the turned over recording paper 2. Accordingly the turned over recording paper 2 is transported to the printing position of the front ink nozzles 4*a*, and the printing is effected on the back surface thereof by the front ink nozzles 4*a*.

Since the printing can be effected on both the sides of the recording paper 2 by transporting the recording paper 2 through a single transportation path only once, the double-side printing time can be shortened. In addition, for example, by controlling the operation of the paper guide 42 independently, the transportation path can be changed accurately.

It should be appreciated that the present invention is not limited to the foregoing embodiments, and can be modified in various manners within the scope thereof. For example, in the above embodiment, the paper guide 42 changes its direction when rotated by the paper guide rotating axis 46 driven by an unillustrated motor. However, the arrangement is not limited to the foregoing, and the direction of the paper guide 42 can be changed by a solenoid or the like.

Figure 33:
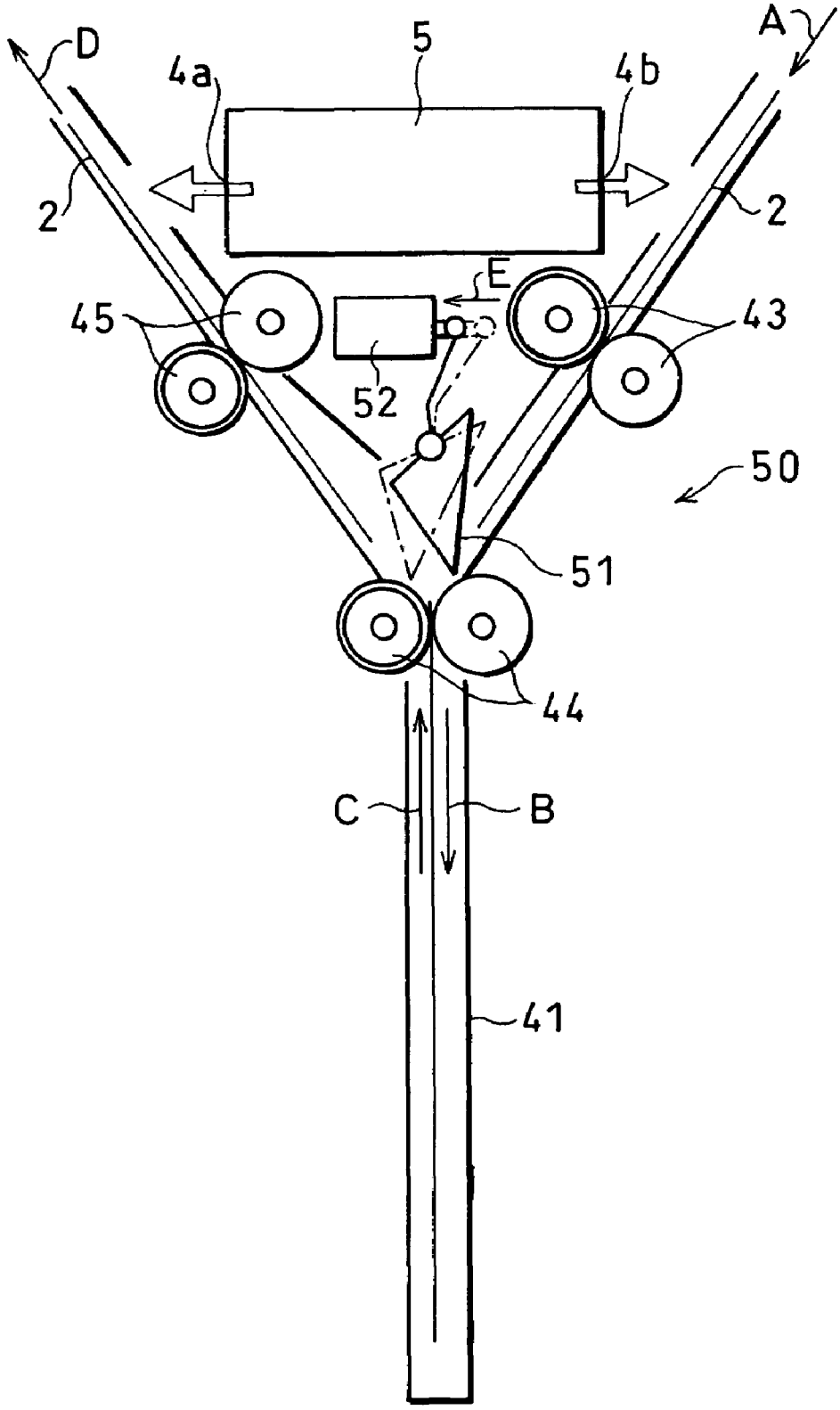
FIG. 33 is a view showing an arrangement of another switchback path mechanism provided to the ink jet printer.

More specifically, according to a switchback path mechanism 50 shown in FIG. 33, a paper direction switching guide 51 having a triangular cross section is provided prior to the pair of the paper direction switching rollers 44 formed in the vicinity of the inlet/outlet of the switchback case 41.

The paper direction switching guide 51 changes the direction of the recording paper 2 by a solenoid 52 provided above, for example.

To be more specific, the printing is effected by the back ink nozzles 4*b* on one surface of the recording paper 2 transported in the direction indicated by an arrow A in the drawing. Then, the recording paper 2 is transported near the pair of paper direction switching rollers 44 by the pair of back ink nozzles rollers 43.

During this operation, the solenoid 52 remains OFF, and the paper direction switching guide 51 is positioned as indicated by an alternate long and short dash line in the drawing, so that the recording paper 2 is transported into the switchback case 41 through a space between the pair of paper direction switching rollers 44.

Subsequently, the recording paper 2 is transported further in the direction indicated by an arrow B by the pair of paper direction switching rollers 44 until it is stored in the switchback case 41 entirely. After the recording paper 2 is stored entirely in the switchback case 41, the solenoid 52 linked to the paper direction switching guide 51 is switched ON, and moves in the direction indicated by an arrow E. Then, the paper direction switching guide 51 linked to the solenoid 52 moves in association, and the transportation path is changed as indicated by a solid line in the drawing.

After the paper direction switching guide 51 changed the transportation path, the pair of paper direction switching rollers 44 start to rotate in a reverse direction, whereby the recording paper 2 is transported in the direction indicated by an arrow C until it reaches the pair of front ink nozzle rollers 45. Then, the recording paper 2 is transported further in the direction indicated by an arrow D by the pair of front ink nozzle rollers 45. Thus, after the printing is effected on the back surface of the recording paper 2 by the front ink nozzles 4*a*, the recording paper 2 is released.

As has been discussed, according to the switchback path mechanism 50 of the present embodiment, by providing the paper direction switching guide 51 as the transportation changing guide in the transportation path the recording paper 2 passes through after the printing is effected thereon by the back ink nozzles 4*b*, and controlling the paper direction switching guide 51 by means of the solenoid 52, the recording paper 2 is turned over while the paper direction is reversed.

Consequently, because the paper direction switching guide 51 is switched by the solenoid 52, the recording paper 2 can be turned over while the paper direction is reversed in a reliable manner.

In the switchback path mechanism 50, the paper direction switching guide 51 is switched by the solenoid 52 in the above explanation. However, the arrangement is not limited to the foregoing. For example, the solenoid 52 can be replaced with a spring.

Figure 34:
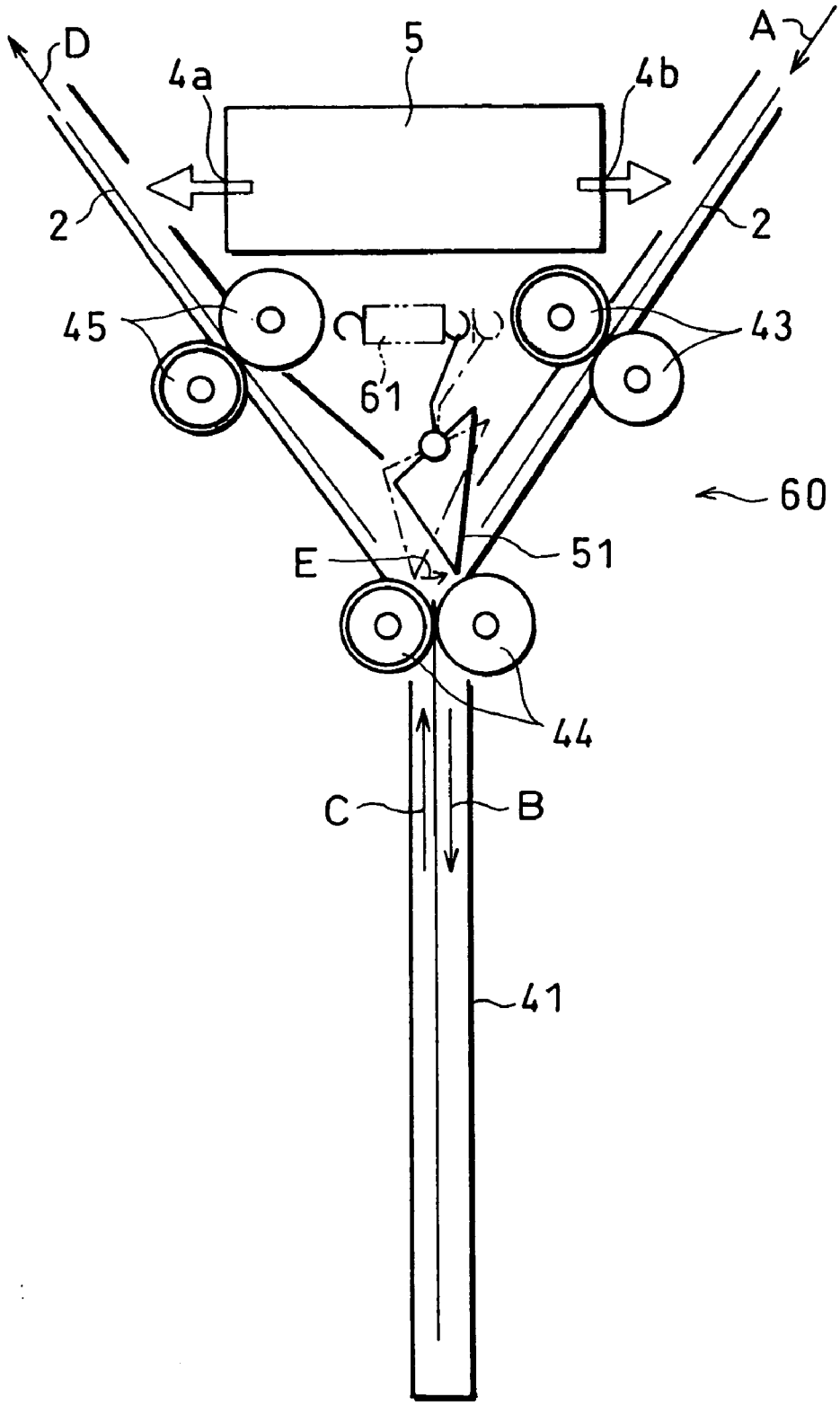
FIG. 34 is a view showing an arrangement of still another switchback path mechanism provided to the ink jet printer.

More specifically, as shown in FIG. 34, a switchback path mechanism 60 is provided with a spring 61 instead of the solenoid 52. The spring 61 constantly opens the transportation path, so that the paper direction switching guide 51 guides the recording paper 2 contained in the switchback case 41 to be transported toward the pair of the front ink nozzle rollers 45.

Thus, according to the switchback path mechanism 60, the printing is effected by the back ink nozzles 4*b* on one surface the recording paper 2 transported in the direction indicated by an arrow A, after which the recording paper 2 is transported forward by the pair of back ink nozzle rollers 43. Here, a force is constantly applied on the paper direction switching guide 51 provided in the transportation path in the direction indicated by an arrow E from the contracted spring.

However, the force produced by the spring 61 is so weak that, against that force, the paper direction switching guide 51 can be readily turned to the position indicated by an alternate long and short dash line in the drawing as the top end of the recording paper 2 touches the paper direction switching guide 51 by a transportation force. Accordingly, the recording paper 2 reaches the pair of paper direction switching rollers 44, and the recording paper 2 is stored in the switchback case 41 by the pair of paper direction switching rollers 44. Consequently, the engagement between the paper direction switching guide 51 and recording paper 2 is released, whereby the paper direction switching guide 51 is turned to a position indicated by a solid line in the drawing by a thrust of the spring 61.

Subsequently, the pair of paper direction switching rollers 44 start to rotate in a reverse direction, upon which the recording paper 2 is transported in the direction indicated by an arrow C by the pair of paper direction switching rollers 44. Because the paper direction switching guide 51 is in the position indicated by the solid line, the recording paper 2 is transported into a space between the pair of the front ink nozzle rollers 45. Then, the recording paper 2 is transported further in the direction indicated by an arrow D by the pair of front ink nozzle roller 45. Finally, after the printing is effected on the back surface by the front ink nozzles 4*a*, the recording paper 2 is released.

As has been discussed, according to the switchback path mechanism 60 of the present embodiment, the paper direction switching guide 51 serving as the transportation path changing guide is provided in the transportation path the recording paper 2 passes through after print is made thereon by the back ink nozzles 4*b* in such a manner that the transportation path is closed constantly by the same by using thrusting means, such as the spring 61. The recording paper 2 is transported in such a manner so as to push aside the paper direction switching guide 51 against a thrust from the paper direction switching guide 51, and after the recording paper 2 passed by the paper direction switching guide 51, the recording paper 2 is turned over and changes the transportation path, through which the recording paper 2 is transported to the printing position of the front ink nozzles 4*a* so that the printing is effected on the back surface thereof.

Consequently, because the printing is effected on both the surfaces of the recording paper 2 by transporting the same only once through the single transportation path, the time required for the double-side printing can be shortened. In addition, the paper direction switching guide 51 changes the transportation path by means of the spring 61 or the like, the arrangement can be simplified and the costs can be saved.

Incidentally, in the foregoing switchback path mechanisms 40, 50, and 60, the paper guide 42 and paper direction switching guide 51 are operated by the motor, solenoid 52, and spring 61. However, the arrangement is not limited to the foregoing, and these components can be omitted if desired.

Figure 35:
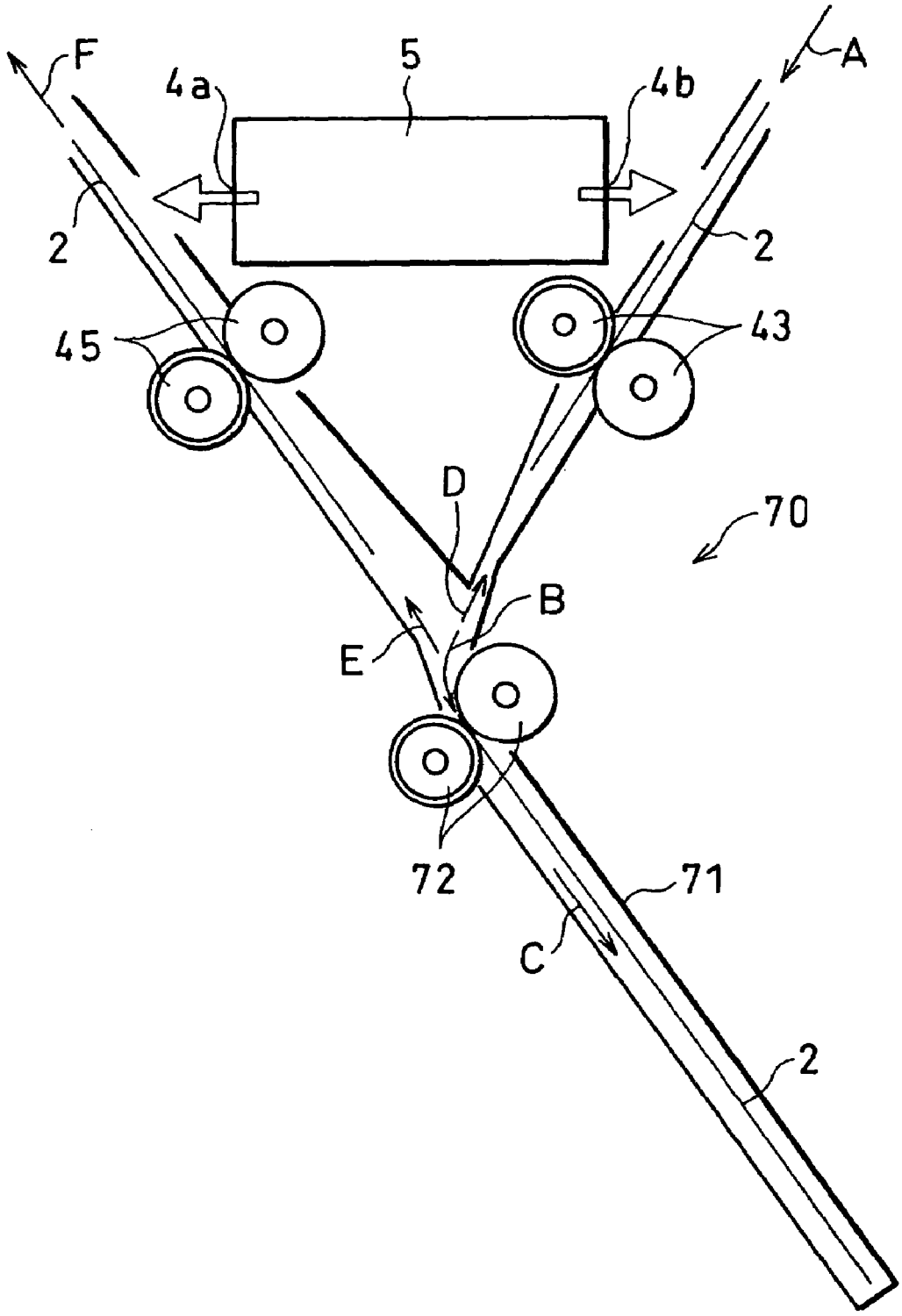
FIG. 35 is a view showing an arrangement of still another switchback path mechanism provided to the ink jet printer.

For example, as shown in FIG. 35, in a switchback path mechanism 70, a switchback case 71 and a pair of paper direction switching rollers 72 are tilted. The recording paper 2 can be switched back as desired by the above arrangement.

More specifically, the printing is effected on one surface of the recording paper 2 sent in the direction indicated by an arrow A by the back ink nozzles 4*b*, and the recording paper 2 is forwarded by the pair of ink nozzle rollers 43.

According to the switchback path mechanism 70, by giving an angle to the transportation path, the recording paper 2 is transported in the direction indicated by an arrow B. When the top end of the recording paper 2 touches a pair of the paper direction switching rollers 72, the recording paper 2 is transported by the pair of paper direction switching rollers 72 in such a manner that it is stored in the switchback path case 71 which forms a transportation path of substantially an U shape.

When the entire recording paper 2 is stored in the switchback case 71, the pair of paper direction switching rollers 72 start to rotate in a reverse direction. Because the recording paper 2 has some hardness, the recording paper 2 is not transported in the direction indicated by an arrow D, but in the direction indicated by an arrow E. When the recording paper 2 reaches the pair of the front ink nozzle rollers 45, it is transported in the direction indicated by an arrow F by the pair of front ink nozzle rollers 45. Then, after the printing is effected on the back surface of the recording paper 2 by the front ink nozzles 4*a*, the recording paper 2 is released.

As has been discussed, according to the switchback path mechanism 70 of the present embodiment, the recording paper 2 can be turned over and the transportation path of the same can be changed by tilting the switchback case 41 without using the solenoid 52, spring 61, etc.

Since the printing can be effected on both the sides of the recording paper 2 by transporting the recording paper 2 through a single transportation path only once, the double-side printing time can be shortened. Further, because the solenoid 52, spring 61, etc. are omitted when changing the transportation path by the paper direction switching guide 51, the arrangement can be simplified and the cost can be saved.

On the other hand, according to the switchback path mechanism 70, the pair of paper direction changing rollers 72 and switchback case 71 are not necessarily tilted when switching back the recording paper 2.

Figure 36:
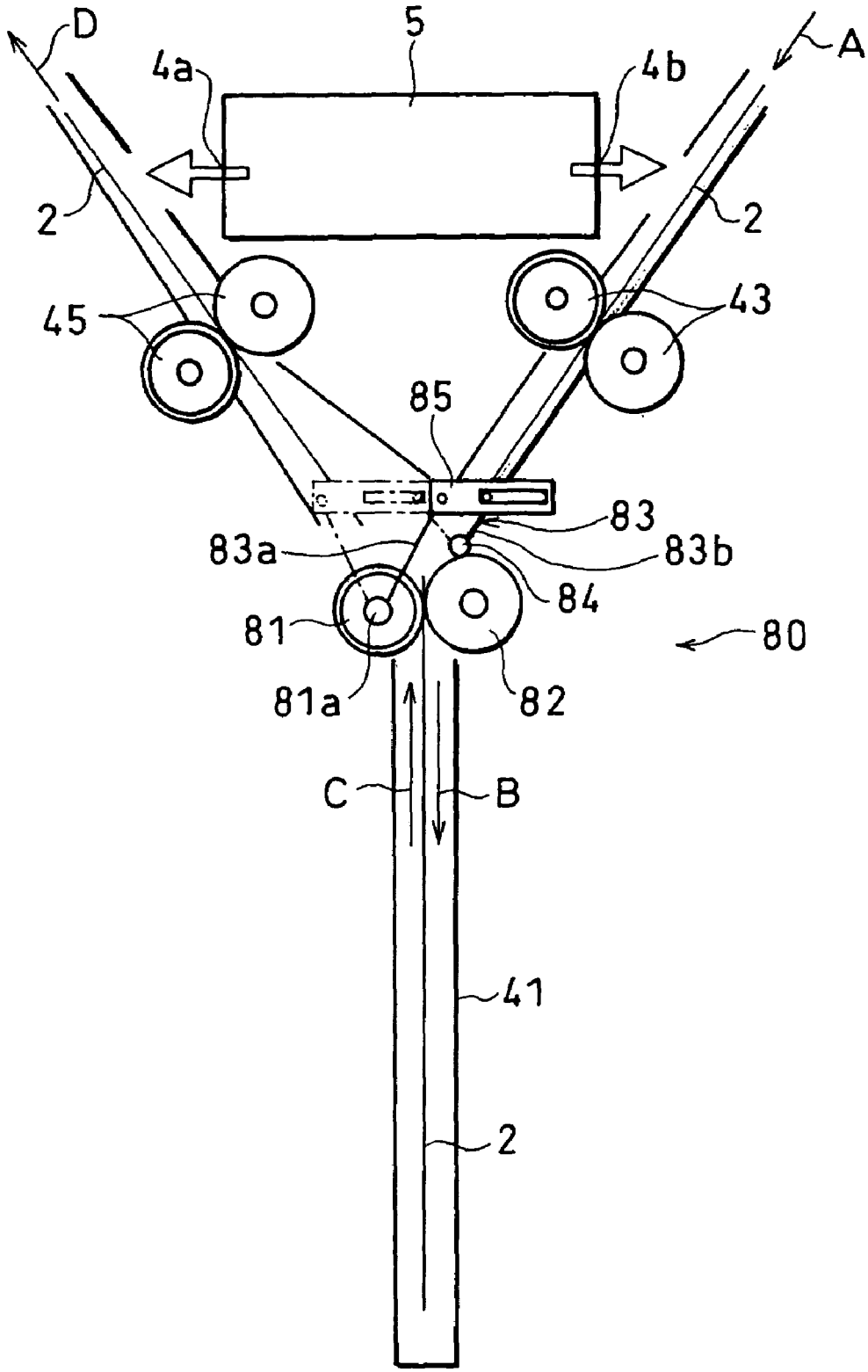
FIG. 36 is a view showing an arrangement of still another switchback path mechanism provided to the ink jet printer.

In other words, as shown in FIG. 36, according to a switchback path mechanism 80, the switching back case is provided upright, while the pair of paper direction switching rollers 81 and 82 are provided horizontally.

It should be noted, however, that a switching path 83 for switching the transportation path from the one in the direction indicated by the arrow A and to the one in the direction indicated by the arrow D is provided directly above the pair of the paper direction switching rollers 81 and 82.

The switching path 83 comprises a front guide 83*a* supported by an roller axis 81*a* of the paper direction switching roller 81 provided in the front transportation path end, that is, in the direction indicted by the arrow D so as to be rotatable, a back guide 83*b* supported by a rotation axis 84 provided directly above the paper direction switching roller 82 at the back transportation end, that is, in the direction indicated by the arrow A, and a linking bar for linking the front guide 83*a* and back guide 83*b* at their respective ends. The linking bar 85 is provided at the outside of the transportation path so as not to prevent the transportation of the recording paper 2 through the transportation path, and allowed to slide in the horizontal direction.

In the switching path 83, when the recording paper 2 is transported in the direction indicated by the arrow A to be stored in the switchback case 41, the pair of paper direction switching rollers 81 and 82 start to rotate in a direction such that the recording paper 2 will be stored in the switchback case 41. Hence, the paper direction switching roller 81 rotates clockwise, so does the front guide 83*a* supported by the roller axis 81*a* of the paper direction switching roller 81 in association. Accordingly, the back guide 83*b* rotates clockwise with respect to the rotating axis 84 through the link bar 85.

Consequently, the switching path 83 is switched to connect the back transportation path and switchback case 41, whereby the recording paper 2 transported in the direction indicated by the arrow A passes through the switching path 83 to be stored in the switchback case 41.

On the other hand, when transporting the recording paper 2 contained in the switchback case 41 through the front transportation path in the direction indicated by the arrow D, the pair of paper direction switching rollers 81 and 82 are rotated in the direction such that the recording paper 2 is released. Hence, the paper direction switching roller 81 rotates counterclockwise, so does the front guide 83*a* supported by the roller axis 81*a* of the paper direction switching roller 81 in association. Accordingly, the back guide 83*b* starts to rotate counterclockwise with respect to the rotating axis 84 through the link bar 85.

Consequently, the switching path 83 is switched to connect the switchback case 41 to the front transportation path as is indicated by an alternate long and short dash line in the drawing. Thus, the recording paper 2 transported in the direction indicted by the arrow D passes through the switching path 83 and is contained in the switchback case 41.

The front guide 83*a* supported by the roller axis 81*a* of the paper direction switching roller 81 rotates either clockwise or counterclockwise in association with the rotation of the paper direction switching roller 81. However, once the switching path 83 is set to the desired switching position, the paper direction switching roller 81 keeps rotating, but the front guide 83*a* does not rotate any further.

The concrete operation of the switchback path mechanism 80 from the start is detailed in FIG. 36. Initially, the recording paper 2 is transported in the direction indicated by the arrow A, and the printing is effected one surface of the same by the front ink nozzles 4*a*. Then, when the printing ends, the recording paper 2 is transported to the switchback case 41 provided below by the pair of back ink nozzle rollers 43. The pair of paper direction switching rollers 81 and 82 provided directly above the switchback case 41 rotate in the direction such that the recording paper 2 is stored in the switchback case 41, whereby the paper direction switching roller 81 rotates clockwise. Thus, the front guide 83*a* starts to rotate clockwise with respect to the roller axis 81*a* in association with the rotation of the paper direction switching roller 81, whereupon the back guide 83*b* starts to rotate clockwise with respect to the rotating axis 84 through the linking bar 85.

Consequently, the switching path 83 is switched such that the back transportation path is connected to the switchback case 41, whereby the recording paper 2 passes through the switching path 83 and touches the pair of paper direction switching rollers 81 and 82. Then, the recording paper 2 is stored in the switchback case 41 by the rotation of the pair of paper direction switching rollers 81 and 82.

Then, when the recording paper 2 is stored in the switchback case 41 entirely, the pair of paper direction switching rollers 81 and 82 start to rotate in a reverse direction. Accordingly, the front guide 83*a* start to rotate counterclockwise around the roller axis 81*a* by a rotating force produced by the inverse rotation of the paper direction switching roller 81. In association with this rotation, the back guide 83*b* starts to rotate counterclockwise around the rotating axis 84 through the linking bar 85. Consequently, the switching path 83 is switched in such a manner that the switchback case 41 is connected to the front transportation path, whereby the recording paper 2 is transported further in the direction indicated by the arrow C to the pair of the paper direction switching rollers 81 and 82, and to the front transportation path in the direction indicated by the arrow D through the switching path 83.

Subsequently, after the printing is effected on the back surface of the recording paper 2 by the front ink nozzles 4*a*, the recording paper 2 is released.

As has been discussed, according to the switchback path mechanism 80 of the present embodiment, the switching path 83 is attached rotatably to the roller axis 81*a*, which is one of the roller axes of the paper direction switching rollers 81 and 82 provided in the transportation path the recording paper 2 passes after the printing by the back ink nozzles 4*b* is effected thereon, and the path of the switching path 83 is changed and the recording paper 2 is turned over by utilizing the rotating force in the reverse direction produced by the pair of paper direction switching rollers 81 and 82 when the recording paper 2 is turned over.

Consequently, the printing can be effected on both the surfaces of the recording paper 2 by transporting the same through the single transportation path only once, thereby making it possible to shorten the time required for the double-side printing. In addition, because the transportation path is changed by moving the switching path 83 with a driving force of the pair of paper direction switching rollers 81 and 82 when turning over the recording paper 2. Hence, the transportation path can be changed by a simple arrangement in a reliable manner.

In addition, because an additional driving force is not required when changing the transportation path, the cost can be saved as well.

Further, still another switchback path mechanism 90 is available.

Figure 37:
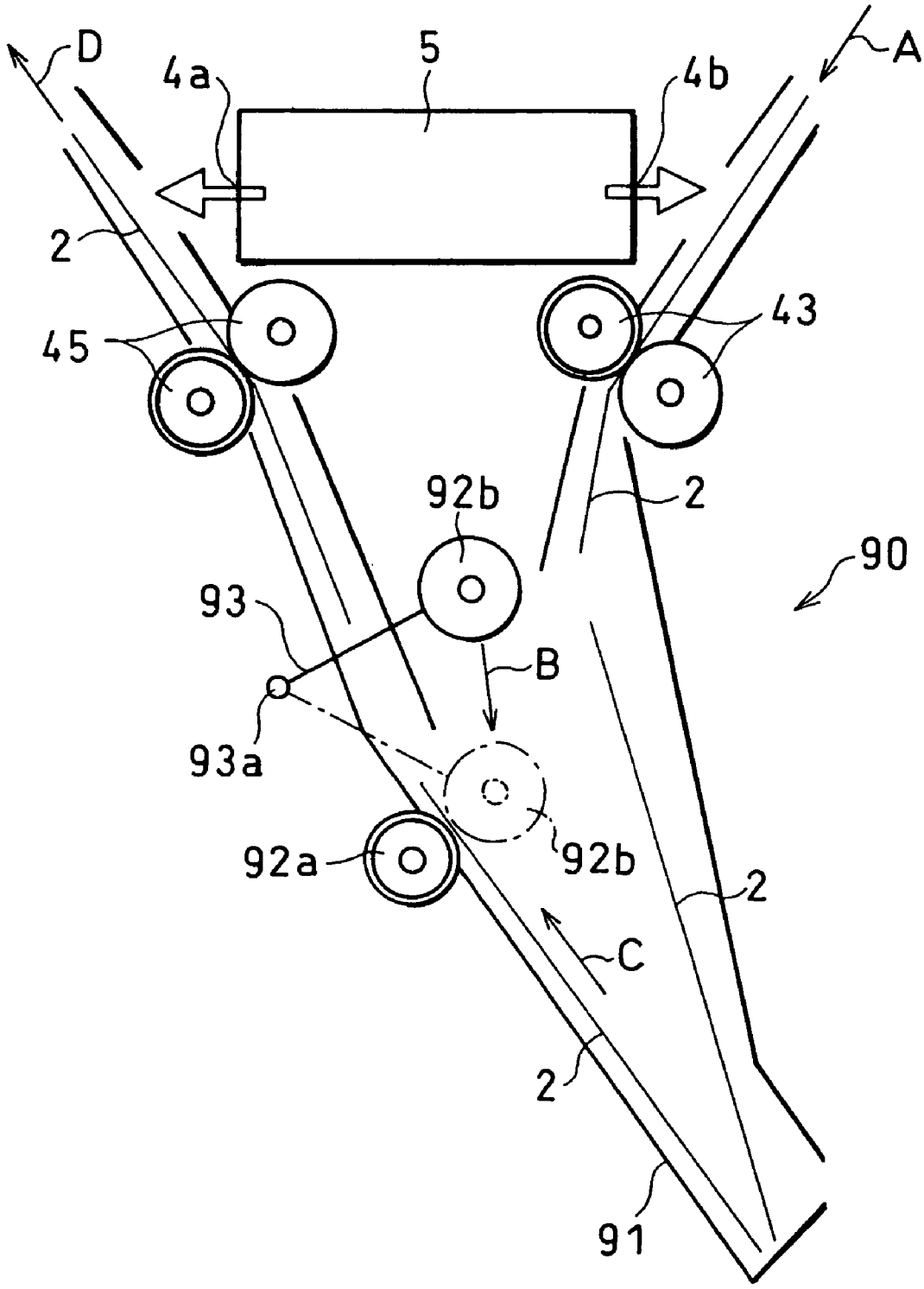
FIG. 37 is a view showing an arrangement of still another switchback path mechanism provided to the ink jet printer.

For example, as shown in FIG. 37, the switchback case 41 is replaced with a switchback path 90 provided with a stack tray 91 on which the recording paper 2 can be piled up. By picking up the recording paper 2 piled in the stack tray 91 by a pair of pickup rollers 92*a* and 92*b*, the recording paper 2 can be transported to the ink jet directing position of the front ink nozzles 4*a*.

In other words, the pickup roller 92*b*, one of the pickup rollers 92*a* and 92*b* that touches the surface of the recording paper 2 facing upward, includes an arm 93 which is allowed to rotate around an end portion axis 93*a*.

Thus, when the recording papers 2 are piled, the pick up roller 92*b* is in the stand-by position indicated by a solid line in the drawing. On the other hand, when picking up the recording paper 2 piled in the stack tray 91, the arm 93 rotates around the end portion axis 93*b*, whereby the pickup roller 92*b* starts to rotate in the direction indicated by the arrow B and moves to a position indicated by an alternate long and short dash line, so that the recording paper 2 is sandwiched by the pair of the pickup rollers 92*a* and 92*b*. Then, when the pair of pickup rollers 92*a* and 92*b* start to rotate under these conditions, the recording paper 2 is picked up and transported in the direction indicated by the arrow D.

The concrete operation of the switchback path mechanism 90 from the start is detailed in FIG. 37. Initially, the printing is effected on one surface of the recording paper 2 transported in the direction indicated by the arrow A by the back ink nozzles 4*b*. Then, the recording paper 2 is transported further by the pair of back ink nozzles rollers 43.

Then, the recording paper 2 passes through a space between the pair of back ink nozzle rollers 43 and is piled in the stack tray 91, after which the pickup roller 92*b* provided above the piled recording paper 2 turns in the direction indicated by the arrow B to the pickup position. The recording paper 2 is transported in the direction indicated by the arrow C by a pair of the pickup rollers 92*a* and 92*b* to reach the pair of front ink nozzle rollers 45. Then, the recording paper 2 is transported in the direction indicated by the arrow D by the pair of front ink nozzle rollers 45, and after the printing is effected on the back surface by the front ink nozzles 4*a*, the recording paper 2 is released.

As has been discussed, according to the switchback path mechanism 90 of the present embodiment, by providing the stack tray 91 on the transportation path of the recording paper 2 so that the recording paper 2 is piled in the stack tray 91 after print is made on its front surface by the back ink nozzles 4*b* and then picked up separately, the recording paper 2 can be transported to the front ink nozzles 4*a* so that print is made on its back surface by the same.

Consequently, the printing can be effected on both the surfaces of the recording paper 2 by transporting the same through a single transportation path only once, thereby making it possible to shorten the time required for the double-side printing. In addition, because more than one recording paper 2 can be piled in the stack tray 91, an arbitrary time interval can be set between the first and second recording papers 2. Consequently, the double-side printing rate from the second page can be accelerated further.

(Embodiment 6)

Figure 38:
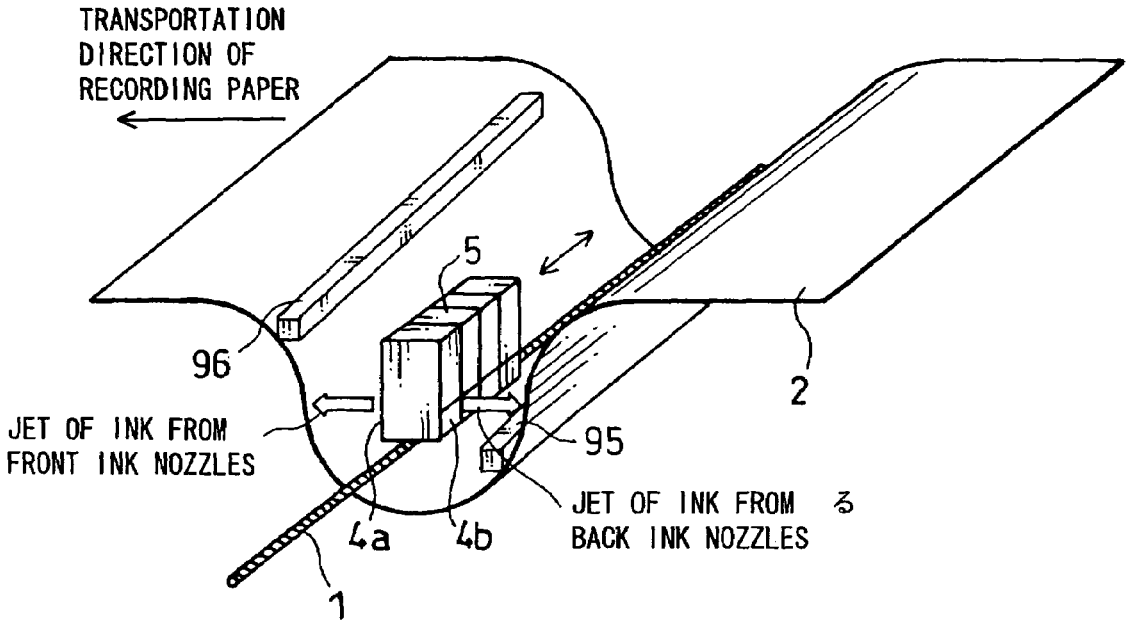
FIG. 38 shows an ink jet printer in accordance with still another embodiment of the present invention, and is a perspective view showing a drier device provided immediately after each group of ink nozzles.
Figure 39:
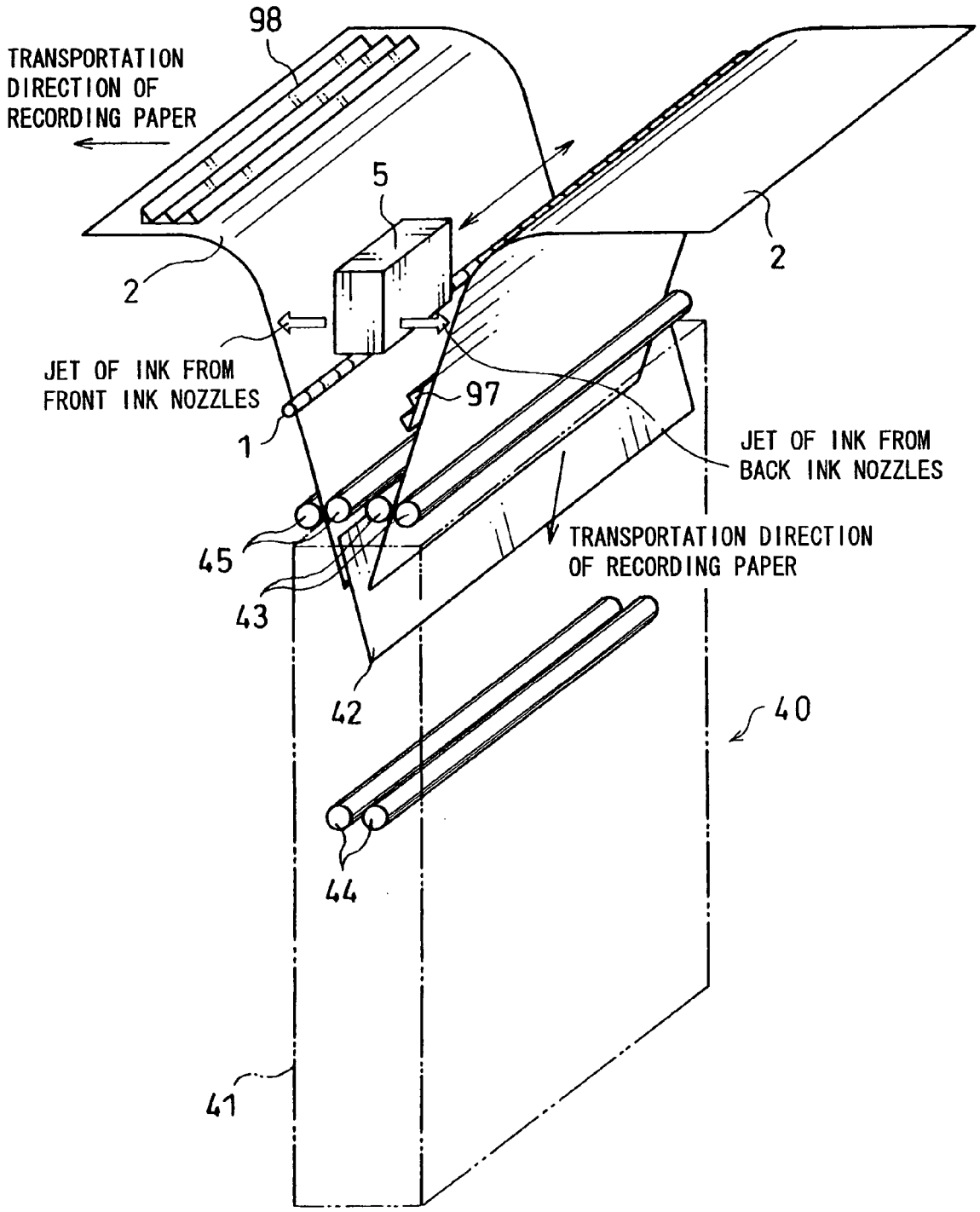
FIG. 39 is a perspective view showing a state when the direr device is installed in the ink jet printer provided with the switchback path mechanism.
Figure 40:
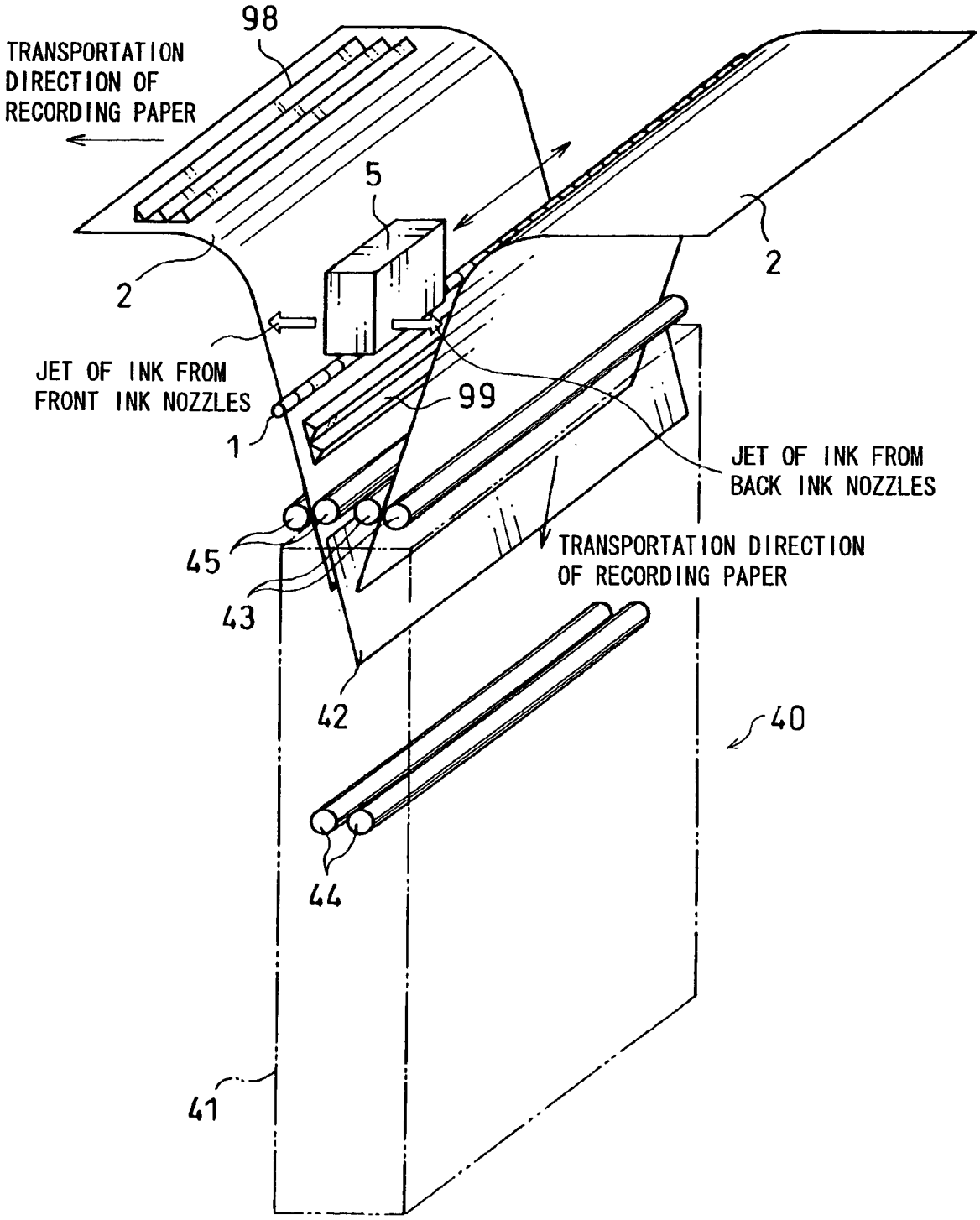
FIG. 40 is a perspective view showing a state when a back surface drying device is provided immediately after the switchback path mechanism.
Figure 41:
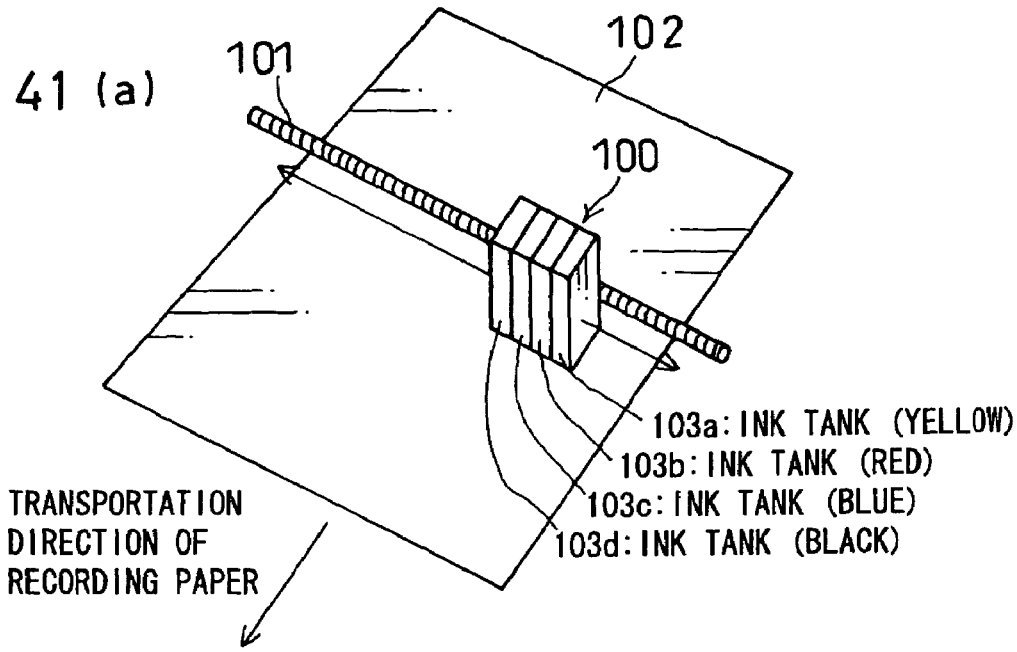
FIGS. 41(*a*) and 41(*b*) show a conventional ink jet printer, FIG. 41(*a*) being a perspective view showing a running state of an ink carriage, FIG. 41(*b*) being a bottom view showing an arrangement of an ink head provided on the ink carriage.
Figure 41:
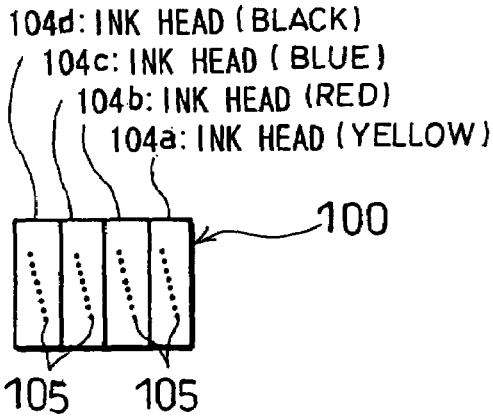
Figure 42:
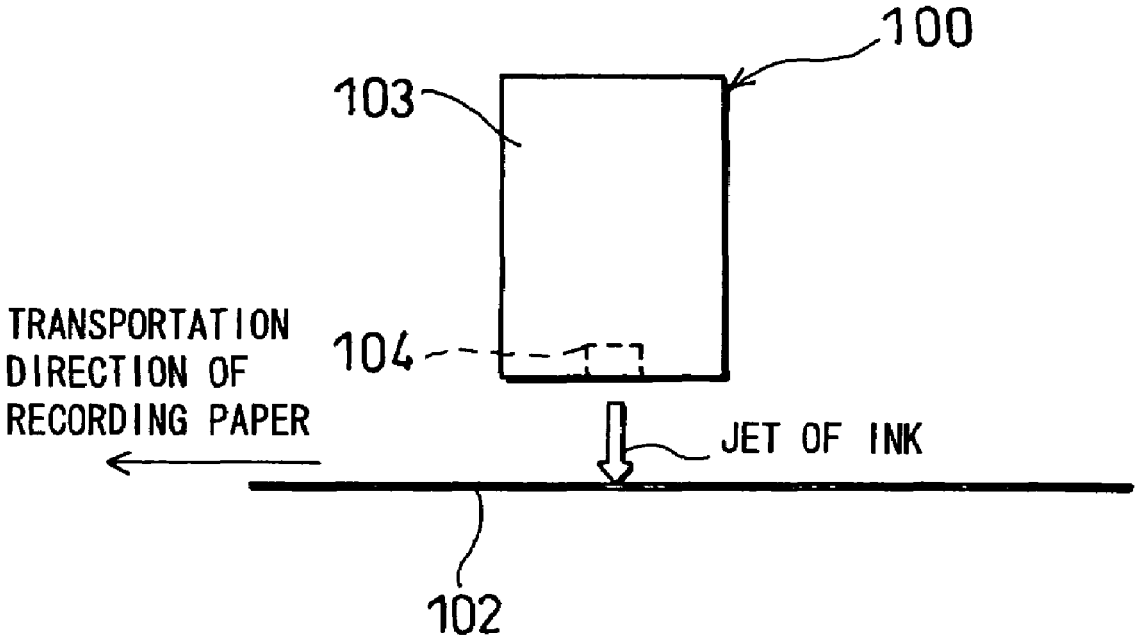
FIG. 42 is a side elevation of the ink jet printer when the printing is effected by directing a jet of ink.

Referring to FIGS. 38–40, the following description will describe still another embodiment of the present invention. Hereinafter, like components are labeled with like reference numerals with respect to Embodiments 1–5, and the description of these components is not repeated for ease of explanation.

An ink jet printer of the present embodiment is any of the ink jet printers of Embodiments 1–5 additionally provided with a drier device.

To be more specific, as shown in FIG. 38, the ink jet printer of the present embodiment is identical with the counterpart of Embodiment 1 except that a back drier device 95 is additionally provided at the position the recording paper 2 passes immediately after the printing is effected thereon by the back ink nozzles 4*b*, and a front drier device 96 is additionally provided at the position the recording paper 2 passes immediately after the printing is effected thereon by the front ink nozzles 4*a*.

Each of the front drier device 95 and back drier device 96 extends along the width direction of the recording paper 2, and is in the form of a bar provided in the vicinity of the recording paper 2.

Each of the bars of the back drier device 95 and front drier device 96 encloses a heater, for example, so that the heater is heated by allowing a current to flow through the same to dry the recording paper 2 when it passes by the back drier device 95 and front drier device 96.

When the back drier device 95 is not provided as shown in FIG. 5, after the printing by the back ink nozzles 4*b*, the recording paper 2 is transported toward the front ink nozzles 4*a* by the pair of paper length adjusting rollers 8. However, the latter half of the recording paper 2 passes through a space between the pair of the paper length adjusting rollers 8 before the print thereon is not dried. Hence, in order to prevent smear of the ink, a star roller smaller than a typical cylindrical roller having a smaller contact area is used as the upper paper length adjusting roller 8 that touches the print made on the recording paper 2. A cylindrical roller is used as the other lower paper length adjusting roller 8 that does not touch the print made on the recording paper 2 for transportation. Consequently, when the star roller is used, the transportation force with respect to the recording paper 2 tends to decrease.

However, if the back drier device 95 is provided, the latter half of the recording paper 2 passes through a space between the pair of paper length rollers 8 after the print made thereon is dried.

Thus, if the back drier device 95 is provided, a cylindrical roller can be used for each of the paper length adjusting rollers 8. Consequently, because the transportation force with respect to the recording paper 2 is increased, the printing time can be shortened.

On the other hand, as shown in FIG. 39, the ink jet printer having the switchback path mechanism 40 of Embodiment 4 can be also provided with a back drier device 97 at the position the recording paper 2 passes immediately after the printing is effected thereon by the back ink nozzles 4*b*, and a front drier device 98 at the position the recording paper 2 passes immediately after the printing is effected thereon by the front ink nozzles 4*a*.

Accordingly, after the printing is effected by the back ink nozzles 4*b* and the print is dried by the back drier device 97, the recording paper 2 passes through a space between the pair of back ink nozzle rollers 43 and is stored in the switchback case 41.

The recording paper 2 is turned over and transported from the switchback case 41, and after the printing is effected on the back surface by the front ink nozzles 4*a*, the print is dried by the front drier device 98.

When the recording paper 2 is dried by the front drier device 98, the recording paper 2 is already heated because the other surface is already dried by the back drier device 97. Thus, the drying of the recording paper 2 by the front drier device 98 consumes less power than the drying of the recording paper 2 by the back drier device 97.

If the front drier device 97 is provided to the ink jet printer having the switchback path mechanism 40, a cylindrical roller can be used as each of the pair of back ink nozzle rollers 43 and front ink nozzle rollers 45 for the same reason discussed above.

In case of the ink jet printer having the switchback path mechanism 40, as shown in FIG. 40, the back drier device 97 provided at the position the recording paper 2 passes immediately after the printing is effected thereon by the back ink nozzles 4*b* can be replaced with a back drier device 99 provided immediately after the switchback path mechanism 40.

In this case, one in each of the pair of back ink nozzle rollers 43 and the pair of the front ink nozzle rollers 45 should be a star roller, and therefore, the transportation force is reduced. However, because a distance between the back drier device 99 and front drier device 98 is short, the power consumption of the heater in the front drier device 98 can be reduced further compared with the case shown in FIG. 39 where the back drier device 97 and front drier device 98 are used.

According to the above arrangement, the double-side printing time can be shortened.

As has been discussed, according to the ink jet printer of the present embodiment, the back drier device 95 for drying the print made on the recording paper is provided at least somewhere between the two groups of back ink nozzles 4*b* and front ink nozzles 4*a* facing their respective directions on the transportation path of the recording paper 2.

To be more specific, when the printing is effected on one recording paper 2 sequentially by the back ink nozzles 4*b* and front ink nozzles 4*a* facing their respective directions in a short time, if the printing is effected by the front ink nozzles 4*a* when the print made by the other back ink nozzles 4*b* is not dried well, smear of the ink may occur or the ink adhered to the transportation roller or the like dirties the recording paper 2.

However, the back drier device 95, 97, or 99 for drying the print on the recording paper 2 is provided at least somewhere between the two groups of back ink nozzles 4*b* and front ink nozzles 4*a* facing their respective directions on the transportation path of the recording paper 2.

Hence, after the printing is effected by the ink nozzles 4*b* first, the printed portion is dried by the back drier device 95, 97, or 99.

For this reason, unwanted smear of the ink or the inconveniences such that the ink adhered to the transportation roller or the like dirties the recording paper 2 can be prevented, because by the time the printing is effected by the front ink nozzles 4*a*, the print made by the preceding printing effected by the back ink nozzles 4*b* is already dried.

Consequently, there can be provided an ink jet printer which can improve printing efficiency by increasing the printing rate and printing resolution, and realizing the printing of an overstrike character, simultaneous printing of mixed information, double-side printing, etc.

In the present embodiment, the back drier device 95, 97, or 97 is provided at least somewhere between the back ink nozzles 4*b* and front ink nozzles 4*a* as drying means. However, the drying means is not limited to the foregoing, and can be the front drier device 96 or 98.

More specifically, according to the present embodiment, the ink jet printer having two groups of back ink nozzles 4*b* and front ink nozzles 4*a* facing their respective directions is provided with the back drier device 95, 97, 99 for drying the print made on the recording paper 2 by the back ink nozzles 4*b*, and the front drier device 96 or 98 for drying the print made on the recording paper 2 by the front ink nozzles 4*a*.

Consequently, print made on each of the front and back surfaces of the recording paper 2 can be dried, thereby making it possible to increase the printing rate and efficiency. In addition, because a set of cylindrical rollers can be used as the pair of paper length adjusting rollers 8, the transportation rate can be increased. Further, because the print is dried by both the back drier device 95, 97, or 99 and the front drier device 96 or 98, drying efficiency can be increased.

In addition, the back drier device 97 of the present embodiment is provided somewhere between the back ink nozzles 4*b* and front ink nozzles 4*a*, and somewhere between the back ink nozzles 4*b* and the switchback case 41.

Consequently, the print made on one surface of the recording paper 2 by the back ink nozzles 4*b* can be dried in a reliable manner before the following printing is effected.

In addition, the back drier device 99 of the present embodiment is provided somewhere between the back ink nozzles 4*b* and front ink nozzles 4*a* after the switchback case 41, and the front drier device 98 of the present embodiment is provided after the front ink nozzles 4*a*.

Thus, both the front and back surfaces of the recording paper 2 can be dried during the double-side printing. In addition, because the recording paper 2 is dried by the back drier device 99 by the time the printing is effected by the front ink nozzles 4*a*, the print made by the front ink nozzles 4*a* can be readily dried by remaining heat. Consequently, the power consumption by the heater in the front drier device 98 can be saved.

In addition, according to the present embodiment, the ink jet printer having the switchback path mechanism 40, 50, 60, 70, 80, or 90 is provided with the back drier device 97 or 99 for drying print made on the recording paper 2 at least somewhere between the two groups of back ink nozzles 4*b* and front ink nozzles 4*a* facing their respective directions on the transportation path of the recording paper 2.

Thus, after the printing is effected by the back ink nozzles 4*b* first, the printed portion is dried by the back drier device 97 or 99.

For this reason, unwanted smear of the ink or the inconveniences such that the ink adhered to the transportation roller or the like dirties the recording paper 2 can be prevented, because by the time the printing is effected by the front ink nozzles 4*a*, the print made by the preceding printing effected by the back ink nozzles 4*b* is already dried.

Consequently, there can be provided an ink jet printer having the switchback path mechanism 40, 50, 60, 70, 80, or 90, and capable of improving printing efficiency by increasing a printing rate and realizing the double-side printing, etc.

According to the present embodiment, the ink jet printer having two groups of back ink nozzles 4*b* and front ink nozzles 4*a* facing their respective directions with respect to the transportation path of the recording paper 2 can be provided with the front drier device 96 or 98 at the position the recording paper 2 passes after the printing is effected thereon by the front ink nozzles 4*a*.

Consequently, the front drier device 96 or 98 not only can dry print made on the recording paper 2 by the front ink nozzles 4*a*, but also print made thereon by the back ink nozzles 4*b*.

For this reason, the recording paper 2 can be dried on both the front and back surfaces, thereby making it possible to increase the printing rate and efficiency.

Also, according to the present embodiment, the ink jet printer having the switchback path mechanism 40, 50, 60, 70, 80 or 90 is provided with the back drier device 97 or 99 for drying print made on the recording paper 2 by the back ink nozzles 4*b*, and the front drier device 96 or 98 for drying print made on the recording paper 2 by the front ink nozzles 4*a*. Further, the ink jet printer is arranged in such a manner that the front drier device 96 or 98 is supplied with predetermined power when the double-side printing is not effected, and with power smaller than the predetermined power when the double-side printing is effected.

In other words, in case of the double-side printing, when the time the front drier device 96 or 98 dries the print, there is remaining heat on the recording paper 2 from the drying by the back drier device 96 or 99 of the print made by the back ink nozzles 4*b*. Thus, the front drier device 96 or 98 consumes less power than the predetermined power source for the drying operation.

Consequently, overall power consumption can be saved.

Also, according to the present embodiment, in the ink jet printer having the switchback path mechanism 40, 50, 60, 70, 80 or 90, the back drier device 97 for drying print made on the recording paper 2 by the front ink nozzles 4*b* is provided before the pair of the back ink nozzle rollers 43 prior to the switchback path mechanism 40, 50, 60, 70, 80, or 90.

Consequently, the print made on the recording paper 2 by the back ink nozzles 4*b* can be dried before the recording paper 2 is transported to the switchback path mechanism 40, 50, 60, 70, 80 or 90.

Also, according to the present embodiment, in the ink jet printer having the switchback path mechanism 40, 50, 60, 70, 80, or 90, the back drier device 97 for drying print made on the recording paper 2 by the back ink nozzles 4*b* is provided before the pair of the back ink nozzle rollers 43 prior to the switching back path mechanism 40, 50, 60, 70, 80, or 90, and a pair of cylindrical rollers are used as each pair of the back ink nozzles rollers 43 and front ink nozzle rollers 45.

In other words, the print made on the recording paper 2 by the back ink nozzles 4*b* is dried by the back drier device 97 provided before the pair of back ink nozzle rollers 43. Thus, a conventionally used star roller is replaced with a cylindrical roller having a larger transportation force than the star roller. Consequently, the transportation efficiency can be increased and the printing effect can be enhanced.

According to the present embodiment, in the ink jet printer having (1) the switching back path mechanism 40, 50, 60, 70, 80, or 90, (2) the back drier device 99 for drying print made on the recording paper 2 by the back ink nozzles 4*b*, and (3) the front drier device 98 for drying print made on the recording paper 2 by the front ink nozzles 4*a*, in order to dry the print made on the recording paper 2 by the back ink nozzles 4*b*, the back drier device 99 is provided before the printing position of the front ink nozzles 4*a* behind the pair of the front ink nozzle rollers 45 immediately after the switchback path mechanism 40, 50, 60, 70, 80, or 90, and a star roller is used as the roller touching the print in each pair of the back ink nozzle rollers 43 and front ink nozzle rollers 45.

Hence, because the back drier device 99 is provided near the front drier device 98, the power consumption of the front drier device 98 can be saved.

Also, according to the present embodiment, when the front drier device 96 for drying print made on the recording paper 2 by the front ink nozzles 4*a* alone is provided, a star roller is used as the roller touching the print in each pair of the paper length adjusting rollers 8, back post-print transportation rollers 17, front pre-print transportation rollers 18, short paper length adjusting rollers 20, medium paper length adjusting rollers 21, and long paper length adjusting rollers 22, and a cylindrical roller is used as the other roller that does not touch the print in each of the foregoing pairs.

Consequently, the print made on the recording paper 2 by the back ink nozzles 4*b* is not dirtied, and the front drier device 96 can dry print made on the both surfaces of the recording paper 2 by the back ink nozzles 4*b* and front ink nozzles 4*a*, respectively.

An ink jet printer of the present invention is an ink jet printer which makes print on a recording paper by running an ink carriage along a supporting axis in a reciprocating motion, characterized in that the ink carriage includes ink heads each provided with an ink nozzle facing a different direction, so that printing is effected on the recording paper simultaneously at more than one portion along a transportation direction in which the recording paper is transported through a single transportation path one by one.

According to the above invention, the ink carriage includes the ink heads each provided with an ink nozzle facing a different direction, so that printing is effected on the recording paper simultaneously at more than one portion along a transportation direction in which the recording paper is transported through a single transportation path one by one.

Hence, print can be made simultaneously at more than one portion on the same recording paper by running one ink carriage. Thus, when the printing is effected simultaneously at more than one portion along the transportation direction of the recording paper in monochrome, the printing time can be shortened compared with an ink head provided with an ink nozzle facing only direction.

In addition, by allocating print data to each group of the ink nozzles facing their respective directions, an overstrike character can be printed out, printing resolution can be improved, and mixed information can be recorded by transporting the recording paper only once. Further, the double-side printing can be effected by providing a switchback path mechanism.

Consequently, there can be provided an ink jet printer which can improve printing efficiency by increasing a printing rate and printing resolution, and realizing printing of an overstrike character, simultaneous printing of mixed information, double-side printing, etc.

Another ink jet printer of the present invention is an ink jet printer which makes print on a recording paper by running an ink carriage along a supporting axis in a reciprocating motion, characterized in that the ink carriage includes two ink heads each provided with an ink nozzle facing a different direction, so that printing is effected on the recording paper simultaneously at two portions along a transportation direction in which the recording paper is transported through a single transportation path sequentially one by one.

According to the present invention, the ink carriage includes two ink heads each provided with an ink nozzle facing a different direction, so that printing is effected on the recording paper simultaneously at two portions along a transportation direction in which the recording paper is transported through a single transportation path sequentially one by one.

Hence, print can be made simultaneously at two portions on the same recording paper by running one ink carriage. Thus, when the printing is effected simultaneously at two portions along the transportation direction of the recording paper in monochrome, the printing time can be shortened to the half compared with an ink head provided with an ink nozzle facing only direction.

In addition, by allocating print data to the two ink nozzles facing their respective directions, an overstrike character can be printed out, printing resolution can be improved, and mixed information can be recorded by transporting the recording paper only once. Further, the double-side printing can be effected by providing the switchback path mechanism.

Consequently, there can be provided an ink jet printer which can improve printing efficiency by increasing a printing rate and printing resolution, and realizing printing of an overstrike character, simultaneous printing of mixed information, double-side printing, etc.

Still another ink jet printer of the present invention is the above ink jet printer, further characterized in that nozzle distance adjusting means for adjusting a distance between the two ink nozzles facing their respective directions is provided in the transportation path, so that printing is effect at two preset recording portions on the printing paper by the two ink heads provided with ink nozzles facing their respective directions.

In other words, unless a distance between the two ink nozzles in the transportation path along the transportation direction of the recording paper is adjusted, print can not be made exactly at the two preset recording positions by the ink head provided with the two ink nozzles facing their respective directions along the transportation direction of the recording paper.

Hence, by adjusting the distance between the two ink nozzles facing their respective directions in the transportation path by the nozzle distance adjusting means, printing can be effected exactly at two intended portions on the recording paper along the transportation direction thereof.

In addition, because the nozzle distance adjusting means adjusts the distance between the two ink nozzles facing their respective directions in the transportation path of the recording paper, print can be made exactly at two preset recording portions on the recording paper of any size.

Consequently, there can be provided an ink jet printer which can improve printing efficiency by increasing a printing rate and printing resolution, and realizing printing of an overstrike character, simultaneous printing of mixed information, double-side printing, etc.

Moreover, according to the above arrangement, the recording paper of any size can be used.

Still another ink jet printer of the present invention is the above ink jet printer further characterized in that extendable guiding means for guiding the recording paper being transported whether the transportation path is extended or shortened is provided on the transportation path between the two ink nozzles.

That is, when the distance between the two nozzles facing their respective directions is adjusted by the nozzle distance adjusting means, the recording paper can not be transported adequately through in the extended/shorten transportation path unless it is guided.

For this reason, extendable guiding means for guiding the recording paper which is transported through extended/shortened transportation path between the two ink nozzles facing their respective direction is provided in the present invention.

Hence, if the distance between the two ink nozzles facing their respective directions in the transportation path is extended/shortened by the nozzle distance adjusting means, the recording paper can be guided in response to the extended/shortened distance between the two ink nozzles facing their respective directions and transported adequately.

In addition, the extendable guiding means can guide the recording paper whether the distance between the two ink nozzles facing their respective directions in the transportation path is extended or not, the recording paper of any size can be guided in an adequate manner.

Consequently, there can be provided an ink jet printer which can improve printing efficiency by increasing a printing rate and printing resolution, and realizing printing of an overstrike character, simultaneous printing of mixed information, double-side printing, etc.

Moreover, according to the above arrangement, the recording paper of any size can be used.

Still another ink jet printer of the present invention is the above ink jet printer, further characterized in that each of the ink nozzles is provided with a plurality of ink holes aligned in a line slanted downward with respect to a running direction along the supporting axis and the transportation direction of the recording paper for each color; and the plurality of ink holes in one of the ink nozzles for each color are shifted by half the pitch from the plurality of ink holes in the other ink nozzle in intervals of the running direction along the supporting axis and/or the transportation direction of the recording paper.

According to the above arrangement, each of the two ink nozzles facing their respective directions along the transportation direction of the recording paper includes a plurality of ink holes aligned in a line slanted with respect to the running direction along the supporting axis and transportation direction of the recording paper for each color. In addition, the ink holes aligned in each ink nozzles for each color is shifted by half the pitch between the ink nozzles facing two different directions as to the interval in the running direction along the supporting axis and/or the intervals in the transportation direction of the recording paper.

Thus, the first printing is effected by the ink nozzle facing one direction, and the second print is effected by the ink nozzle facing the other direction so as to be superimposed on the print made by the first printing by shifting intervals in the running direction along the supporting axis and/or intervals along the transportation direction of the recording paper half the pitch. Hence, the resolution and printing density in the running direction along the supporting axis and/or transportation direction of the recording paper can be increased twice.

Consequently, there can be provided an ink jet printer which can improve printing efficiency by improving printing resolution, etc.

Still another ink jet printer of the present invention is the above ink jet printer, further characterized in that first print data, such as a watermark, is printed out by one of the two ink nozzles and second print data, which is different from the first print data, for example, text information, is printed out by the other ink nozzle.

According to the above invention, the first print data, such as a watermark, is printed out by one of the two ink nozzles facing their respective directions along the transportation path of the recording paper, and the second print data different from the first print data, such as text information, is printed out by the other ink nozzle.

In other words, the first print data, such as a watermark, is printed out by one of the two ink nozzles facing their respective directions, and the second print data, such as text information, is printed out by the other ink nozzle on the same recording paper.

Thus, mixed recording information can be printed out by transporting the recording paper once. Consequently, there can be provided an ink jet printer which can improve printing efficiency by increasing the printing rate and realizing simultaneous printing of mixed information.

Still another ink jet printer of the present invention is the above ink jet printer, further characterized in that paper turnover means for turning over the recording paper is provided in the transportation path between the two ink nozzles facing their respective directions.

According to the above invention, the paper turnover means for turning over the recording paper is provided in the transportation path between the two ink nozzles facing their respective directions. Thus, after the printing is effected on the front surface of the recording paper by one of the two ink nozzles facing their respective directions, the recording paper is turned over by the paper turnover means, then the printing is effected on the back surface of the recording paper.

According to the double-side printing mechanism, the printing is effected on the recording paper transported through the single transportation path by the two ink nozzles facing their respective directions. Thus, the double-side printing mechanism only has to turn over the recording paper between the ink nozzles facing two different directions, thereby making it possible to simplify the arrangement of the paper turnover means.

In addition, compared with a case of effecting the double-side printing by the conventional ink nozzle facing one direction, the printing is effected on the front surface of the recording paper by one of the two ink nozzles facing their respective directions, and on the back surface of the preceding recording paper by the other ink nozzle simultaneously. Thus, the double-side printing time can be reduced to the half compared with the conventional case when the double-side printing is effected on more than one recording paper.

Consequently, there can be provided an ink jet printer which can improve printing efficiency by improving printing resolution, etc.

Still another ink jet printer of the present invention is the above ink jet printer, further characterized in that drying means for drying print made on the recording paper is provided in the transportation path.

In other words, when the printing is effected on the same recording paper by the two ink nozzles facing their respective directions in succession with a short time interval, if print made by one of the two ink nozzles facing their respective directions is not dried well before the printing by the other ink nozzle starts, smear of ink may occur or ink adhered to the transportation roller may dirty the recording paper.

For this reason, in the present invention, the drying means for drying print made by the ink nozzle on the recording paper is provided in the transportation path of the recording paper. Thus, the print made by one ink nozzle first is dried by the drying means.

Thus, when the printing is effected by the other ink nozzles later, smear of ink does not occur or the ink adhered to the transportation roller or the like does not dirty the recording paper, because the print made first is dried well by the drying means.

Consequently, there can be provided an ink jet printer which can improve printing efficiency by increasing a printing rate and printing resolution, and realizing printing of an overstrike character, simultaneous printing of mixed information, double-side printing, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet printer for making print on at least one recording paper, comprising:

a supporting axis;

an ink carriage that reciprocates along the supporting axis, the ink carriage including two ink heads each provided with an ink nozzle facing a different direction, the recording paper being transported through a single transportation path sequentially one by one; and paper turnover means for switching back and turning over the recording paper in the transportation path between said ink nozzles, in a case where a first image is printed on one surface of the recording paper before the paper turnover means performs turnover and a second image is printed on an opposite surface of the recording paper after the paper turnover means performs the turnover, the first image and the second image being prevented from being upside down with each other, and hence a top of the first image being back to back with a top of the second image.

2. The ink jet printer as defined in claim 1, wherein, the paper turnover means is provided below said two ink heads.

3. The ink jet printer as defined in claim 2, wherein, said two ink heads are arranged so as to discharge ink in opposite directions.

4. The ink jet printer as defined in claim 3, wherein, said two ink heads are arranged so as to horizontally discharge ink.

5. The ink jet printer as defined in claim 1, wherein, the paper turnover means includes a switchback case for storing, in an upright manner, the recording paper that has a surface printed by said two ink heads.

6. The ink jet printer as defined in claim 5, wherein, the paper turnover means further includes, between said two ink heads and the switchback case, (i) a back ink nozzle roller, (ii) a front ink nozzle roller, (iii) and a paper direction switching roller that can rotate in both directions and is provided in the switchback case below the back ink nozzle roller and the front ink nozzle roller.

7. The ink jet printer as defined in claim 6, wherein, the paper turnover means further includes a paper guide extending downward at a halfway between the back ink nozzle roller and the front ink nozzle roller.

8. The ink jet printer as defined in claim 6, wherein, the switchback case is slanted so as to allow the recording paper in the switchback case to be transported to the front ink nozzle roller.

* * * * *